US012264835B2

(12) United States Patent
Bloemer et al.

(10) Patent No.: US 12,264,835 B2
(45) Date of Patent: Apr. 1, 2025

(54) WHOLE BUILDING AIR QUALITY CONTROL SYSTEM

(71) Applicant: RESEARCH PRODUCTS CORPORATION, Madison, WI (US)

(72) Inventors: John Bloemer, Madison, WI (US); Sundar Baladhandapani, Madison, WI (US); Jatin Khanpara, Madison, WI (US); Casey Klock, Madison, WI (US); Gerald McNerney, Madison, WI (US); David Detlefsen, Madison, WI (US); Daniel Parent, Madison, WI (US); Guolian Wu, Madison, WI (US); Travis J. Blackburn, Madison, WI (US)

(73) Assignee: Research Products Corporation, Madison, WI (US)

( * ) Notice: Subject to any disclaimer, the term of this patent is extended or adjusted under 35 U.S.C. 154(b) by 343 days.

(21) Appl. No.: 17/843,324

(22) Filed: Jun. 17, 2022

(65) Prior Publication Data

US 2022/0404056 A1 Dec. 22, 2022

Related U.S. Application Data

(60) Provisional application No. 63/211,790, filed on Jun. 17, 2021.

(51) Int. Cl.
*F24F 11/64* (2018.01)
*F24F 11/46* (2018.01)
(Continued)

(52) U.S. Cl.
CPC ..... *F24F 11/64* (2018.01); *F24F 2110/50* (2018.01)

(58) Field of Classification Search
CPC ..... F24F 11/64; F24F 2110/50; F24F 11/52; F24F 11/58; F24F 11/46
(Continued)

(56) References Cited

U.S. PATENT DOCUMENTS 6,170,480 B1 1/2001 Melink et al.
6,619,055 B1 9/2003 Addy
(Continued)

FOREIGN PATENT DOCUMENTS

CA 2474202 1/2006
CN 111198545 5/2020
(Continued)

OTHER PUBLICATIONS

International Search Report and Written Opinion from PCT/US2022/034007 dated Oct. 14, 2022 (11 pages).

*Primary Examiner* — Michael J Brown
(74) *Attorney, Agent, or Firm* — Foley & Lardner LLP

(57) ABSTRACT

A whole building air quality control system includes an indoor air quality (IAQ) component having at least one control state, a plurality of sensors configured to measure a plurality of building conditions of a building space, and a controller communicably coupled to the IAQ component and the plurality of sensors. The controller includes memory storing a desired air quality index (AQI). The AQI includes a categorical variable. The controller is configured to iteratively modify a control state of the IAQ component using a machine learning algorithm until the plurality of building conditions of the building space satisfy the desired AQI.

20 Claims, 21 Drawing Sheets

(51) Int. Cl.
*F24F 11/52* (2018.01)
*F24F 110/50* (2018.01)

(58) Field of Classification Search
USPC ..... 700/276
See application file for complete search history.

(56) References Cited

U.S. PATENT DOCUMENTS 6,726,111 B2 4/2004 Weimer et al.
7,001,263 B2 2/2006 Shaben
7,135,965 B2 11/2006 Chapman et al.
7,156,316 B2 1/2007 Kates
7,163,156 B2 1/2007 Kates
7,168,627 B2 1/2007 Kates
7,188,482 B2 3/2007 Sadegh et al.
7,204,093 B2 4/2007 Kwon et al.
7,243,004 B2 7/2007 Shah et al.
7,398,821 B2 7/2008 Rainer et al.
7,623,028 B2 11/2009 Kates
7,632,178 B2 12/2009 Meneely, Jr.
7,798,418 B1 9/2010 Rudd
7,925,383 B2 4/2011 Kwon et al.
8,020,777 B2 9/2011 Kates
8,020,780 B2 9/2011 Schultz et al.
8,073,570 B2 12/2011 Jeong
8,090,477 B1 1/2012 Steinberg et al.
8,100,746 B2 1/2012 Heidel et al.
8,109,101 B2 2/2012 Taras et al.
8,136,738 B1 3/2012 Kopp
8,195,313 B1 6/2012 Fadell et al.
8,219,249 B2 7/2012 Harrod et al.
8,429,566 B2 4/2013 Koushik et al.
8,433,446 B2 4/2013 Grohman et al.
8,442,693 B2 5/2013 Mirza et al.
8,478,447 B2 7/2013 Fadell et al.
8,543,243 B2 9/2013 Wallaert et al.
8,543,244 B2 9/2013 Keeling et al.
8,630,740 B2 1/2014 Matsuoka et al.
8,630,741 B1 1/2014 Matsuoka et al.
8,640,970 B2 2/2014 Dorendorf
8,655,490 B2 2/2014 Pavlak et al.
8,674,842 B2 3/2014 Zishaan
8,694,164 B2 4/2014 Grohman et al.
8,695,888 B2 4/2014 Kates
8,744,629 B2 6/2014 Wallaert et al.
8,768,521 B2 7/2014 Amundson et al.
8,878,854 B2 11/2014 Bias et al.
8,892,223 B2 11/2014 Leen et al.
8,893,032 B2 11/2014 Bruck et al.
8,907,803 B2 12/2014 Martin
8,994,539 B2 3/2015 Grohman et al.
9,063,555 B2 6/2015 Difulgentiz
9,075,419 B2 7/2015 Sloo et al.
9,143,344 B2 9/2015 Cho et al.
9,175,868 B2 11/2015 Fadell et al.
9,256,230 B2 2/2016 Matsuoka et al.
9,268,345 B2 2/2016 Mirza et al.
9,273,878 B2 3/2016 Kucera
9,279,596 B2 3/2016 Goldschmidt et al.
9,353,965 B1 5/2016 Goyal et al.
9,362,749 B2 6/2016 Lu et al.
9,389,599 B2 7/2016 Yun et al.
9,417,637 B2 8/2016 Matsuoka et al.
9,441,847 B2 9/2016 Grohman
9,459,018 B2 10/2016 Fadell et al.
9,477,239 B2 10/2016 Bergman et al.
9,477,241 B2 10/2016 Schultz et al.
9,506,665 B2 11/2016 Dorendorf et al.
9,507,493 B2 11/2016 Sasaki et al.
9,528,715 B2 12/2016 Aiken
9,535,431 B2 1/2017 Noriyuki
9,594,384 B2 3/2017 Bergman et al.
9,606,551 B2 3/2017 Sasaki et al.
9,606,552 B2 3/2017 Stefanski et al.
9,618,224 B2 4/2017 Emmons et al.
9,657,957 B2 5/2017 Bergman et al.
9,684,312 B1 6/2017 Eyring et al.
9,696,056 B1 7/2017 Rosenberg
9,741,023 B2 8/2017 Arensmeier et al.
9,765,984 B2 9/2017 Smith et al.
9,803,880 B2 10/2017 Jung et al.
9,823,672 B2 11/2017 McCurnin et al.
9,861,925 B2 1/2018 Chen et al.
9,909,777 B2 3/2018 Goyal et al.
9,939,167 B2 4/2018 Hoppe et al.
9,945,574 B1 4/2018 Sloo et al.
9,960,929 B2 5/2018 Fadell et al.
9,967,313 B2 5/2018 Sasaki et al.
9,968,877 B2 5/2018 Chan et al.
9,971,365 B2 5/2018 Lee et al.
10,001,293 B2 6/2018 Schmidlin
10,001,790 B2 6/2018 Oh et al.
10,013,873 B2 7/2018 Shan
10,018,372 B2 7/2018 Lemire et al.
10,047,970 B2 8/2018 Nelson et al.
10,060,643 B2 8/2018 Takeda et al.
10,067,640 B2 9/2018 Sasaki et al.
10,072,867 B2 9/2018 Isono et al.
10,088,192 B2 10/2018 Crimins et al.
10,101,050 B2 10/2018 Radovanovic et al.
10,126,005 B1 11/2018 Carson, Jr.
10,151,504 B2 12/2018 Kannan et al.
10,190,795 B2 1/2019 Ito et al.
10,203,126 B2 2/2019 Stefanski et al.
10,203,127 B2 2/2019 Leroy et al.
10,209,688 B2 2/2019 Stefanski et al.
10,240,802 B2 3/2019 Gonia et al.
10,241,527 B2 3/2019 Fadell et al.
10,248,092 B2 4/2019 Crimins et al.
10,248,143 B2 4/2019 Greene et al.
10,253,994 B2 4/2019 Tucker et al.
10,253,995 B1 4/2019 Grant
10,253,999 B2 4/2019 Leen et al.
10,254,001 B2 4/2019 Yoshikawa
10,284,385 B2 5/2019 Combe et al.
10,302,322 B2 5/2019 Quam et al.
10,317,100 B2 6/2019 Tucker
10,326,607 B2 6/2019 Sasaki et al.
10,344,995 B2 7/2019 Chinnaiyan
10,345,933 B2 7/2019 Sasaki et al.
10,353,362 B2 7/2019 Thomas
10,408,484 B2 9/2019 Honda et al.
10,408,489 B1 9/2019 Trishaun
10,443,879 B2 10/2019 Fadell et al.
10,451,304 B2 10/2019 Isono et al.
10,452,061 B2 10/2019 Yenni et al.
10,461,951 B2 10/2019 Smith et al.
10,473,412 B2 11/2019 Yoshikawa
2005/0082053 A1 4/2005 Halabi
2005/0270151 A1 12/2005 Winick
2008/0033599 A1 2/2008 Aminpour et al.
2008/0179053 A1 7/2008 Kates
2008/0182506 A1 7/2008 Jackson et al.
2009/0270023 A1 10/2009 Bartmann
2010/0107072 A1 4/2010 Mirza et al.
2010/0318230 A1 12/2010 Liu
2011/0151766 A1 6/2011 Sherman et al.
2013/0145784 A1 6/2013 Bias et al.
2013/0147723 A1 6/2013 Vendt
2013/0147812 A1 6/2013 Bias et al.
2013/0151014 A1 6/2013 Castillo
2013/0151016 A1 6/2013 Bias et al.
2013/0151017 A1 6/2013 Vendt
2013/0158720 A1 6/2013 Zywicki et al.
2013/0268129 A1 10/2013 Fadell et al.
2014/0000861 A1 1/2014 Barrett et al.
2014/0207289 A1 7/2014 Golden et al.
2014/0207291 A1 7/2014 Golden et al.
2014/0358294 A1 12/2014 Nichols et al.
2014/0365017 A1 12/2014 Hanna et al.
2015/0058741 A1 2/2015 Sasaki et al.
2015/0074569 A1 3/2015 Hirayama
2015/0148969 A1 5/2015 Sasaki et al.
2015/0267936 A1 9/2015 Wright et al.

(56) References Cited

U.S. PATENT DOCUMENTS

| | | | |
|---|---|---|---|
| 2015/0285524 | A1 | 10/2015 | Saunders |
| 2015/0316286 | A1 | 11/2015 | Roher |
| 2016/0258638 | A1 | 9/2016 | Waseen et al. |
| 2016/0305678 | A1 | 10/2016 | Pavlovski et al. |
| 2016/0327921 | A1 | 11/2016 | Ribbich et al. |
| 2016/0363339 | A1 | 12/2016 | Blackley |
| 2017/0060149 | A1 | 3/2017 | Giustina et al. |
| 2017/0328591 | A1 | 11/2017 | Kelly et al. |
| 2018/0017274 | A1 | 1/2018 | Erdman et al. |
| 2018/0017278 | A1 | 1/2018 | Klein et al. |
| 2018/0023836 | A1 | 1/2018 | Quam et al. |
| 2018/0023837 | A1 | 1/2018 | Kraft et al. |
| 2018/0031260 | A1 | 2/2018 | Bernbom et al. |
| 2018/0032069 | A1 | 2/2018 | Ren |
| 2018/0051900 | A1 | 2/2018 | Van Goor et al. |
| 2018/0058712 | A1 | 3/2018 | Miyaura |
| 2018/0059694 | A1 | 3/2018 | Rezny et al. |
| 2018/0073759 | A1 | 3/2018 | Zhang et al. |
| 2018/0119974 | A1 | 5/2018 | Kotake et al. |
| 2018/0119979 | A1 | 5/2018 | Reed et al. |
| 2018/0129232 | A1 | 5/2018 | Hriljac et al. |
| 2018/0167547 | A1 | 6/2018 | Casey et al. |
| 2018/0195752 | A1 | 7/2018 | Sasaki et al. |
| 2018/0209679 | A1 | 7/2018 | Bon et al. |
| 2018/0224139 | A1 | 8/2018 | Watkins |
| 2018/0299155 | A1 | 10/2018 | Mowris |
| 2019/0024928 | A1 | 1/2019 | Li et al. |
| 2019/0033279 | A1 | 1/2019 | Mou et al. |
| 2019/0037024 | A1 | 1/2019 | Mighdoll et al. |
| 2019/0056125 | A1 | 2/2019 | Mou et al. |
| 2019/0086106 | A1 | 3/2019 | Okita et al. |
| 2019/0086108 | A1 | 3/2019 | Okita et al. |
| 2019/0107302 | A1 | 4/2019 | Liu et al. |
| 2019/0162438 | A1 | 5/2019 | Fokou et al. |
| 2019/0170396 | A1 | 6/2019 | Azulay et al. |
| 2019/0178523 | A1 | 6/2019 | Zimmerman et al. |
| 2019/0186766 | A1 | 6/2019 | Maslekar et al. |
| 2019/0212022 | A1 | 7/2019 | Aeberhard et al. |
| 2019/0242605 | A1 | 8/2019 | Shekhar Nalajala et al. |
| 2019/0257543 | A1 | 8/2019 | Martin |
| 2019/0271480 | A1 | 9/2019 | Vallikannu et al. |
| 2019/0277529 | A1 | 9/2019 | Madonna et al. |
| 2019/0360711 | A1 | 11/2019 | Sohn et al. |
| 2020/0223292 | A1* | 7/2020 | Kazyak ..... B60H 1/00292 |
| 2020/0224915 | A1* | 7/2020 | Nourbakhsh ..... F24F 11/54 |

FOREIGN PATENT DOCUMENTS

| | | | |
|---|---|---|---|
| JP | 11-030432 | | 2/1999 |
| JP | 2009-300064 | | 12/2009 |
| JP | 2018-035957 | | 3/2013 |
| JP | 2014-031957 | | 2/2014 |
| JP | 2015-010735 | | 1/2015 |
| JP | 2015-125693 | | 7/2015 |
| JP | 2017-219253 | | 12/2017 |
| JP | 2018-106922 | | 7/2018 |
| JP | 2018-169070 | | 3/2019 |
| KR | 20120070726 | | 7/2012 |
| KR | 20120080873 | | 7/2012 |
| KR | 1020200030452 | | 5/2021 |
| WO | WO-2017/208344 | A1 | 12/2017 |
| WO | WO-2018/105004 | A1 | 6/2018 |
| WO | WO-2018/163283 | A1 | 9/2018 |
| WO | WO-2018/216115 | A1 | 11/2018 |

* cited by examiner 750 752 754

| | | Product | Measure | Weighting | Low | Recommended | Excellent | Automatic |
|---|---|---|---|---|---|---|---|---|
| IAQ | Air Cleaning | Filtration | <11 (S) | 0 | 0 | | | |
| | | | 11 (S) | 1 | | | | |
| | | | 13 (S) | 2 | | 2 | | |
| | | | 16 (S) | 3 | | | 3 | 3 |
| | | | PM 2.5 Sensor Actuation Time (C) | 3.5 | | | | 3.5 |
| | | Gaseous Removal | None (S) | 0 | 0 | | | |
| | | | Carbon Filter (S) | 1 | | | | |
| | | | Ventilation => Min (S) | 2 | | 2 | 2 | 2 |
| | | | VOC Sensor Acuation time (C) | 2.5 | | | | 2.5 |
| | | Run Time | With Heat & Cool (S) | 0 | 0 | | | |
| | | | Air Cycling (S) | 1 | | 1 | 1 | |
| | | | Actual Run Time Greater than Fan Cycling (C) | 1.5 | | | | |
| | | | | | | | | |
| | Humidifier | Time < Set Point | None (S) | 0 | 0 | | | |
| | | | Humidifier (S) | 2 | | | 2 | 2 |
| | | | <12 hrs/day (C) | 1 | | 1 | | |
| | | | <8 hrs/day (C) | 2 | | | | 2 |
| | | | | | | | | |
| | Dehumidifier | Time > Set Point | None (S) | 0 | 0 | | | |
| | | | Dehumidifier (S) | 2 | | | 2 | 2 |
| | | | <12 hrs/day (C) | 1 | | 1 | | |
| | | | < 8 hrs/day (C) | 2 | | | | 2 |
| | | | | | | | | |
| | Temp | Set Point | 1 stat (S) | 0 | 0 | | | |
| | | | Avg Sensor (S) | 1 | | 1 | | |
| | | | Zoning (S) | 2 | | | 2 | 2 |
| | | | < 4hrs from Setpoint (C) | 2 | | | | 2 |
| | Ventilation | Amount | None (S) | 0 | 0 | | | |
| | | | Min (62.2/code) (S) | 1 | | 1 | 1 | 1 |
| | | | Run Time Not at Extreme Outdoor Temp/RH <4hrs/day | 1.5 | | | | |
| | | | Max (>62.2/code) (C) | 2 | | | | 2 |
| | | | | | | | | |
| | Fan Operation | Mixing (run time) | With Heat & Cool (S) | 0 | 0 | | | |
| | | | Fan Cycling (S) | 1 | | 1 | 1 | 1 |
| | | | Time > Fan Cycling (C) | 1.5 | | | | 1.5 |
| | | | | | | | | |
| | | | | Rating Value | 0 | 10 | 14 | 28.5 |

FIG. 8

775

776

RED YELLOW GREEN

| | | | | | |
|---|---|---|---|---|---|
| HUMIDITY | <25% (R) | 25-40% (Y) | 40-60% (G) | 60-70% (Y) | >70% (R) |
| ACTION PLAN | POOR LOW HUMIDITY LEVELS - DRY/ITCHY SKIN, INCREASED RISK OF VIRUSES | | MAINTAIN YOUR HEALTHY LEVELS | POOR HIGH HUMIDITY LEVELS - RISK OF FUNGUS/MICROBIAL GROWTH ASTHMA TRIGGERS DUE TO PROLIFERATION OF DUST MITES | |
| HOW TO MITIGATE | HUMIDIFIER | | | DEHUMIDIFIER | |
| RADON | 0-1.3 pCi/L (G) | 1.4-2.7pCi/L (G) | 2.7-4.0pCi/L (Y) | >4.0pCi/L (R) | |
| ACTION PLAN | NO ACTION REQUIRED | EXPERIMENT WITH VENTILATION AND SEALING CRACKS TO REDUCE LEVELS. | KEEP MEASURING. IF LEVELS ARE MAINTAINED FOR MORE THAN 3 MONTHS, CONTACT A PROFESSIONAL RADON MITIGATION. | KEEP MEASURING. IF LEVELS ARE MAINTAINED FOR MORE THAN 1 MONTH, CONTACT A PROFESSIONAL RADON MITIGATION. | |
| HOW TO MITIGATE | | | RADON MITIGATION SYSTEM | RADON MITIGATION SYSTEM | |
| $CO_2$ (CARBON DIOXIDE) | 250-400 ppm (G) | 400-1,000 ppm (G) | 1,000-2,000 ppm (Y) | 2,000-5,000 ppm (R) | |
| ACTION PLAN | NORMAL BACKGROUND CONCENTRATION OUTDOOR AMBIENT AIR | CONCENTRATIONS TYPICAL OF OCCUPIED INDOOR SPACES WITH GOOD AIR EXCHANGE | COMPLAINTS OF DROWSINESS AND POOR AIR | HEADACHES, SLEEPINESS AND STAGNANT, STALE, STUFFY AIR. POOR CONCENTRATION, LOSS OF ATTENTION, INCREASED HEART RATE AND SLIGHT NAUSEA | |
| HOW TO MITIGATE | FRESH AIR VENTILATION / AIR FILTRATION (MERV 13+) | | | | |
| TVOC (TOTAL VOLATILE ORGANIC COMPOUNDS) | <250 ppb (G) | | 250-2,000 ppb (Y) | > 2,000 ppb (R) | |
| ACTION PLAN | THE VOC CONTENTS IN THE AIR ARE LOW | | LOOK FOR VOC SOURCES IF THIS AVERAGE LEVEL PERSISTS FOR A MONTH | THE VOC CONTENTS ARE VERY HIGH - CONSIDER TAKING ACTION/VENTILATING RIGHT NOW | |
| HOW TO MITIGATE | | | FRESH AIR VENTILATION / AIR FILTRATION (MERV 13+) | | |
| PM2.5 (PARTICULATE MATTER) | < 10 $\mu g/m^3$ (G) | | 10 $\mu g/m^3$ - 25 $\mu g/m^3$ (Y) | > 25 $\mu g/m^3$ (R) | |
| PM10 | < 50 $\mu g/m^3$ (G) | | 50 $\mu g/m^3$ - 150 $\mu g/m^3$ (Y) | > 150 $\mu g/m^3$ (R) | |
| ACTION PLAN | MAINTAIN THEM BY MONITORING, YOU CAN BE ALERTED TO POLLUTION INCREASES IN YOUR HOME | | KEEP MONITORING TO ENSURE THEY DO NOT INCREASE. TRY TO NEUTRALIZE PM SOURCES; INDOOR CLEANING HABITS, POOR APPLIANCE VENTILATION & OUTDOOR PM POLLUTION COULD BE THE CULPIT | VENTILATION IMPROVEMENTS, AIR PURIFIERS, REGULAR FILTER CLEANING AND MORE CAN HELP IMPROVE INDOOR PM LEVELS. HIGH PM OUTDOORS WILL ALSO HAVE AN IMPACT | |
| HOW TO MITIGATE | | | AIR FILTRATION (MERV 13+) / FRESH AIR VENTILATION | | |

FIG. 9

950

PREDICTED AQI → ACTUAL AQI - (DRIVES MITIGATION) → SMART HEALTHY AIR INDEX (HAI)

| PRODUCTS | VENTILATOR, HUMIDIFIER, DEHUMIDIFIER, AIR CLEANING, THERMOSTATS, ZONE CONTROL, PORTABLES | | | | |
|---|---|---|---|---|---|
| SENSORS & CALCULATIONS 952 | -TEMPERATURE<br>-RH<br>-DEW POINT<br>-OUTDOOR TEMP<br>-OUTDOOR RH<br>-OUTDOOR DEW POINT<br>-EQUIPMENT INFORMATION | PLUS:<br>-ADVANCE VENT. LOGIC<br>-PREDICTIVE LOGIC BASED ON RUN TIME<br>-REAL TIME FEEDBACK ON IAQ<br>-GIVE WAYS TO IMPROVE IAQ | PLUS:<br>-PARTICULATE MATTER (PM) | PLUS:<br>-VOC<br>-CO2 | PLUS<br>-CO<br>-RADON<br>-ETC. |
| AQI ASSESSMENT 954 | PREDICTED & MEASURED AIR QUALITY BASED ON INSTALLED PRODUCTS | IAQ FEEDBACK AND SUGGESTIONS FOR IMPROVING | ABILITY TO REACT TO EVENTS IN THE HOME | ABILITY TO REACT TO MORE EVENTS | ABILITY TO INFORM OF POSSIBLE ISSUES |
| INTELLIGENCE 956 | CODE DRIVEN SOLUTIONS | DATA DRIVEN SOLUTIONS FOR THE MASSES | | CUSTOMIZED "BIG DATA" SMART SOLUTIONS | |
| AQI DELIVERABLE 958 | DYNAMIC METRIC BASED ON INSTALLED PRODUCTS AND DYNAMIC BASED ON SENSORS, CALCULATIONS AND OPERATION | PROVIDING MORE FEEDBACK TO CONSUMER FOR OPPORTUNITIES TO IMPROVE IAQ | ABILITY TO MITIGATE THE EVENTS, INFORM CONSUMER ACTIONS BEING TAKEN AND PROVIDE POSSIBLE SOLUTIONS TO REDUCE EVENTS IN THE FUTURE. | ADDITIONAL SENSORS | INFORMING OF POSSIBLE ISSUES |
| AQI DELIVERABLE EXAMPLE | IN THE GOOD RANGE AT 7 OUT OF 10. BASED ON PRODUCT PERFORMANCE. CLICK HERE TO LEARN HOW TO IMPROVE YOUR AIR FURTHER.<br>EXAMPLE: "YOU HAVE GOOD AIR QUALITY, TO IMPROVE YOUR AIR QUALITY FURTHER, CONSIDER ADDING A MERV16 FILTER." | IN THE GOOD RANGE AT 7 OUT OF 10. CLICK HERE TO LEARN HOW TO IMPROVE YOUR AIR FURTHER. CAN START TO EDUCATE BASED ON ACTUAL SENSOR READINGS.<br>EXAMPLE: "YOU HAVE GOOD AIR QUALITY, TO IMPROVE YOUR AIR QUALITY, REDUCE YOUR HUMIDITY LEVEL WITH AN APRILAIRE WHOLE HOME HUMIDIFIER." | IN THE GOOD RANGE AT 7 OUT OF 10. CLICK HERE TO LEARN HOW TO IMPROVE YOUR AIR FURTHER. CAN EDUCATE BASED ON ACTUAL SENSOR READINGS.<br>EXAMPLE: "THE PARTICLE LEVELS ARE HIGH IN YOUR HOME, THE AIR CLEANER WILL CLEAN THE AIR WHILE THE FAN IS RUNNING." | 25 OUT OF 100 IS IN THE GOOD RANGE. NUMERIC VALUE BASED ON ACTUAL AIR QUALITY. CLICK HERE FOR DETAILS ON AQI AND EDUCATE BASED ON ACTUAL SENSOR READINGS.<br>EXAMPLE: "THE CO2 LEVELS WERE HIGH IN YOUR HOME YESTERDAY SO THE APRILAIRE WHOLE HOME FRESH AIR VENTILATOR TURNED ON TO REDUCE THE LEVELS." | 25 OUT OF 100 IS IN THE GOOD RANGE. NUMBERIC VALUE WITH SOME CORRELATION TO OUTDOORS. CLICK HERE FOR DETAILS ON AQI AND EDUCATE BASED ON ACTUAL SENSOR READINGS.<br>EXAMPLE: "THE CO2 LEVELS WERE HIGH IN YOUR HOME YESTERDAY SO THE APRILAIRE WHOLE HOME FRESH AIR VENTILATOR TURNED ON TO REDUCE THE LEVELS." |

*FIG. 12*

AIR QUALITY INDEX

1072

| | AQI | PM 2.5 (ug/m3) | PM 10 (ug/m3) | VOC (ppm) | CO2 (ppm) | FORMALDEHYDE (ppm) |
|---|---|---|---|---|---|---|
| GOOD | 0 - 50 | 0 - 12 | 0 - 54 | 0 - 15 | 400 - 650 | 0 - 0.2 |
| MODERATE | 51-100 | 12.1 - 35.4 | 55 - 154 | 16 - 25 | 651 - 1500 | 0.21 - 0.4 |
| UNHEALTHY FOR SENSITIVE GROUPS | 101-150 | 35.5 - 55.4 | 155 - 254 | 26 - 50 | 1501 - 2000 | 0.41 - 0.6 |
| UNHEALTHY | 151-200 | 55.5 -150.4 | 255 - 354 | 51 - 75 | 2001 - 2500 | 0.61 - 0.8 |
| VERY UNHEALTHY | 201-300 | 150.5 - 250.4 | 355 - 424 | 76 - 100 | 2501 - 5000 | 0.81 - 1 |
| HAZARDOUS | 301-500 | 250.5 - 500 | 425 - 600 | 101 - 150 | 5001 - 15000 | 1.01 - 1.2 |

GREEN YELLOW ORANGE RED PURPLE BROWN

1200

1202 1204

| | Comfort (MAX) | Energy (MAX) |
|---|---|---|
| Temperature | 0.5 | 3 |
| Humidity | 1 | 2 |
| A/C | 0.5 | 0 |

WHOLE BUILDING AIR QUALITY CONTROL SYSTEM

CROSS-REFERENCE TO RELATED PATENT APPLICATIONS

This application claims the benefit of and priority to U.S. Provisional Patent Application No. 63/211,790, filed Jun. 17, 2021, the entire contents of which are hereby incorporated by reference herein.

BACKGROUND

The present disclosure relates generally to the field of indoor air quality (IAQ) for buildings. More specifically, the present disclosure relates to devices, control systems, and algorithms for managing indoor air quality.

SUMMARY

According to one aspect of the present disclosure, a whole building air quality control system includes an indoor air quality (IAQ) component having at least one control state, a plurality of sensors configured to measure a plurality of building conditions of a building space, and a controller communicably coupled to the IAQ component and the plurality of sensors. The controller includes memory storing a desired air quality index (AQI). The AQI includes a categorical variable. The controller is configured to iteratively modify a control state of the IAQ component using a machine learning algorithm until the plurality of building conditions of the building space satisfy the desired AQI.

According to another aspect of the present disclosure, a non-transitory computer-readable medium having instructions stored thereon that, upon execution by a computing device, cause the computing device to (i) perform operations including receiving a desired AQI, where the desired AQI includes a categorical variable; (ii) determine a predicted control state of an IAQ component based on the desired AQI using a machine learning algorithm; (iii) transmit a command to the IAQ component based on the predicted control state; (iv) receive from a plurality of sensors, a plurality of building conditions of a building space; and (v) iteratively modify the predicted control state using the machine learning algorithm until the plurality of building conditions of the building space satisfy the desired AQI.

According to yet another aspect of the present disclosure, a control device includes a communications interface configured to communicably couple the control device to an IAQ component and a plurality of sensors configured to measure a plurality of building conditions of a building space, a user interface configured to receive user input including a qualitative parameter, memory storing a desired AQI, where the desired AQI includes a categorical variable, and a processing circuit communicably coupled to the communications interface, the user interface, and the memory. The processing circuit is configured to determine a predicted control state based on both the qualitative parameter and the desired AQI, and transmit a control signal to the IAQ component based on the predicted control state.

Yet another aspect of the present disclosure relates to a whole building air quality control system. The control system includes an IAQ component, a sensor, a user interface, and a controller. The sensor is configured to measure an environmental condition. The user interface is configured to receive user input that includes a plurality of baseline parameters. The controller is communicably coupled to the IAQ component, the sensor, and the user interface. The controller is configured to determine (i) a weighting factor from the plurality of baseline parameters; and (ii) an environmental set point based on the weighting factor. Additionally, the controller is configured to control the IAQ component based on the environmental condition and the environmental set point.

Yet another aspect of the present disclosure relates to a control device. The control device includes a communications interface, a display, and a graphical user interface. The communications interface is configured to communicably couple the control device to IAQ equipment. The display includes a screen. The graphical user interface is displayed on the screen. The graphical user interface includes a plurality of parameter axes, a selection indicator, and a real-time parameter indicator. Each parameter axis is indicative of a qualitative parameter. The selection indicator is positioned along the at least one of the parameter axes and is used to select a position along the parameter axis. The real-time parameter indicator is indicative of an actual value of the qualitative parameter.

Yet another aspect of the present disclosure relates to a control device. The control device includes a communications interface, a user interface, memory, and a processing circuit. The communications interface is configured to communicably couple the control device to IAQ equipment. The user interface is configured to receive user input including a qualitative parameter. The memory stores IAQ factors. The processing circuit is communicably coupled to the communications interface, the user interface, and the memory. The processing circuit is configured to determine a plurality of control points based on the qualitative parameter and the IAQ factors. Additionally, the processing circuit is configured to control the IAQ equipment based on the plurality of control points.

BRIEF DESCRIPTION OF THE FIGURES

FIG. 8 is a scoring chart for a whole building air quality control system, according to an embodiment.

FIG. 9 is a scoring chart for a whole building air quality control system, according to another embodiment.

FIG. 12 is a roadmap of control strategies for a whole building air quality control system, according to another embodiment.

DETAILED DESCRIPTION

Overview

Figure 1:
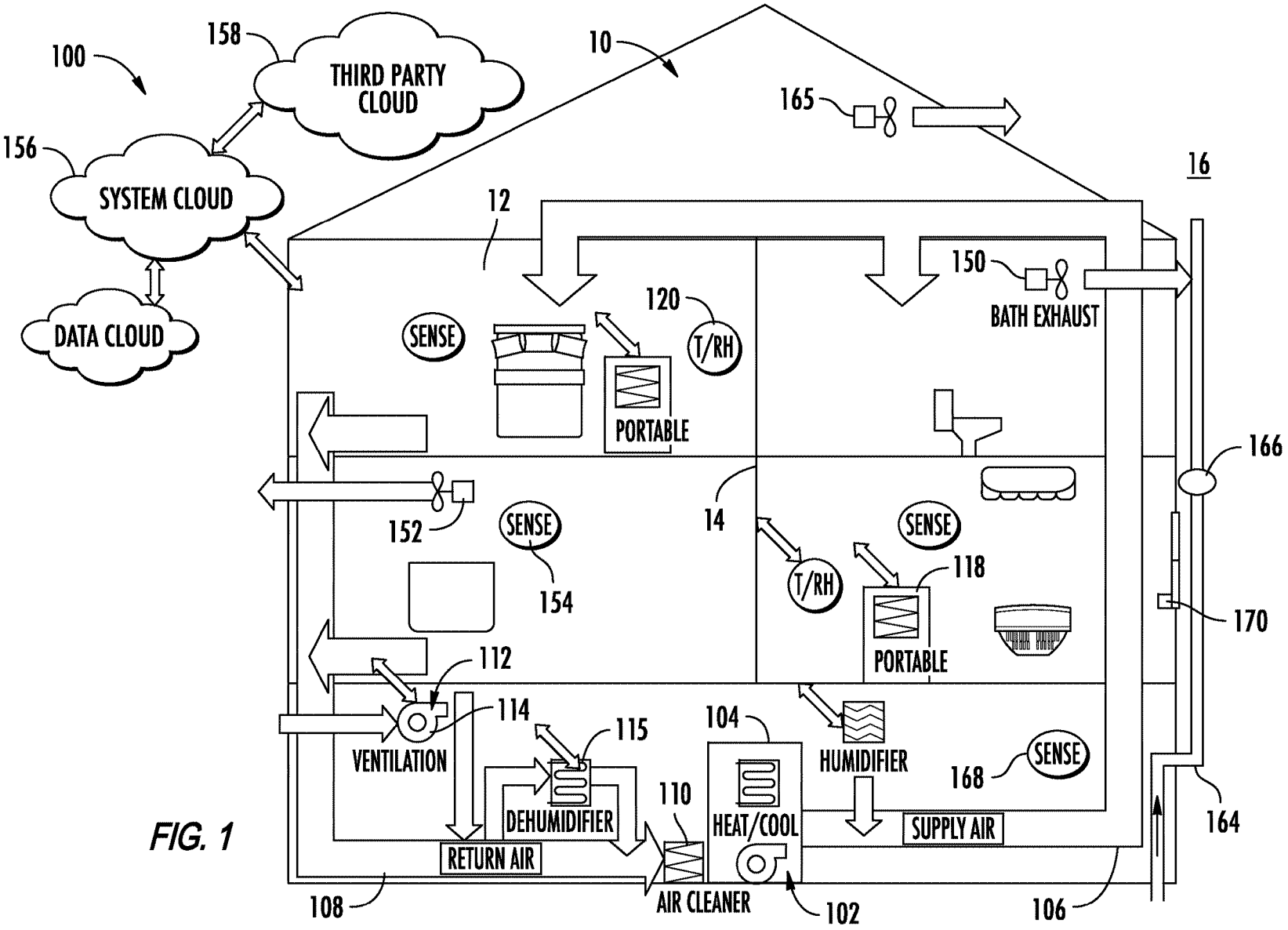
FIG. 1 is schematic representation of a whole building air quality control system, according to an embodiment.

Referring generally to the figures, a whole building air quality control system is shown, according to various embodiments. The whole building air quality control system is configured to provide customized air quality and purity control throughout an entire building, and/or to specific areas within the building based on user preferences. The system integrates a variety of different indoor air quality (IAQ) components (e.g., IAQ equipment) that are configured to affect a quality of air within the building. Some examples of IAQ components that may be located throughout the building include (i) heating, ventilation, and air conditioning (HVAC) system components, such as a thermostat, furnace, boiler, air conditioner, humidifier, dehumidifier, indoor/outdoor air exchanger, air cleaner, and portable IAQ equipment; and (ii) non-HVAC components such as a room fan, bathroom exhaust fan, range hood, and other equipment that can be used to facilitate IAQ control. The system may also integrate at least one remote sensor, which may be part of an IAQ component, such as a temperature sensor in a thermostat, and/or a standalone device such as a particle sensor, volatile organic compound sensor, carbon dioxide sensor, or another type of monitoring device configured to determine an environmental condition and/or system operating condition. The system may also include other types of sensors such as sensors that indicate building arrangement conditions (e.g., states of the building that are known to have effects on environmental factors). For example, the system may include window position sensors, door position sensors, sunlight sensor, and/or other types of building arrangement sensors. The system may also include window temperature sensors and/or moisture sensors to detect the presence of or conditions for condensation on exterior windows and/or walls of the building. Such building arrangement sensors may be used to notify the system of structural arrangements of the building that impact the quality of air inside the building, even if they do not measure air quality directly. Additionally, the system may integrate remote computing devices (e.g., cloud computing devices) such as data clouds and/or partner clouds to facilitate data exchange, service improvements, and troubleshooting/product support services. Among other benefits, combining these devices and services into one single integrated system allows for better control of IAQ, more advanced control logic, and more opportunities for efficient and reactive IAQ, energy, and quality control.

According to an illustrative embodiment, the whole building air quality system includes a control device that is configured to determine a baseline operating condition (e.g., a baseline IAQ) tailored to the particular needs of the building and its occupants. The baseline operating condition may be based on industry and/or engineering standards for what is known to provide a healthy home (e.g., proper ventilation in accordance with ASHRAE 62.2, air filtration using a filter element with a rating of at least MERV 13 operating for at least 20 min/hr, threshold humidity ranges for a healthy home, and/or other standards promulgated by professional and/or research organizations such as ASHRAE, CDC, AHRI, EPA, LBNL, DOE, FSEC, Energy Star, Codes, etc.) The user control device may use the baseline operating condition to establish target and/or recommended environmental parameters for the building, without the need for a user to manually specify environmental set points on their own. Among other benefits, this control functionality can significantly reduce the amount of effort and input needed from a user during the initial setup of the whole building air quality system. This control functionality also reduces operator error in buildings that include different types of IAQ components, and arrangements in which changing two or more environmental set points may impact the comfort of an occupant in similar ways (e.g., temperature and humidity).

The control device is also configured to determine how changing environmental conditions within the building affects the actual IAQ (e.g., will raise or lower the IAQ), and specifically, how the actual IAQ compares to the baseline IAQ. For example, the control device may be configured to determine an IAQ metric that is representative of a combination of multiple environmental conditions within the building. Among other benefits, the IAQ metric alerts the user to how well the system is performing overall. The IAQ metric can also be used to (i) alert the user to potential issues with the performance of the IAQ component, (ii) show how changes/modifications to the IAQ component might improve IAQ, and (iii) show how changes to environmental conditions, based on user preferences, impact the actual IAQ.

According to an illustrative embodiment, the control device is configured to control the IAQ component based on qualitative parameters (e.g., subjective inputs) input by the user, rather than traditional, user-specified environmental set points. The qualitative parameters are performance characteristics that are associated with the system as a whole (e.g., macro-scale operating characteristics, system level performance characteristics, etc.), and relate to the response elicited by controlling the different IAQ components together in a specific way. For example, in one embodiment, the qualitative parameter is a comfort metric that is indicative of how the regulation of environmental conditions within the building makes the occupant "feel." Does the temperature within the home fluctuate too much before the system kicks in? Is the air flow rate through the building bothersome to the building's occupants? In another embodiment, the qualitative parameter is an energy metric that is indicative of an energy efficiency of the whole building air quality control system that results from how the different IAQ components are operated. In yet another embodiment, the qualitative parameter is a health metric that is indicative of how well the system is adjusted to suit the health needs of its occupants.

The qualitative parameters affect the control scheme (e.g., paradigm, etc.) that is used by the air quality controller to operate the different IAQ components. In one embodiment, the control device is configured to interpret the qualitative parameters and to determine a set of control points (e.g., upper and lower thresholds and/or tolerance bands for environmental set points, relative duty cycles for different IAQ components, etc.) that will elicit the desired response. The control points may be specific to a single piece of IAQ equipment or apply to multiple pieces of IAQ equipment. Among other benefits, by controlling operation of the IAQ components using qualitative parameters, a user can tailor operation of the system to suit his/her priorities and lifestyle, rather than performing a guess-and-check with traditional environmental set point control of individual pieces of IAQ equipment to establish the desired system operation.

According to an illustrative embodiment, the control device includes a human-machine interface including a graphical user interface (GUI) that is configured to present the qualitative parameters to the user and through which the user may modify the qualitative parameters to change how the IAQ components are controlled. In one aspect, the GUI includes multiple parameter axes, where each axis is indicative of a respective one of the qualitative parameters. For example, a first axis may be indicative of a level of occupant comfort (e.g., whether the occupant is feeling too cold, too hot, etc.). A second axis may be indicative of a level of air quality as it pertains to health factors (e.g., a factor relating to respiratory effects associated with the indoor air quality). A third axis may be indicative of an amount of energy consumption of the whole building air quality system (e.g., the IAQ equipment). The GUI may include a selection indicator that is associated with each parameter, and which may be manipulated by a user to select a desired position along the parameter axes and/or value of the qualitative parameter. In other embodiments, a single selection indicator may be shared between multiple parameter axes. In one embodiment, each of the qualitative parameters may be interrelated such that a change in one parameter also changes the value of another parameter (and/or limits an allowable selection range of another parameter).

System Components and Arrangement

Referring to FIG. 1, a building 10 is shown that includes a whole building air quality control system 100, according to an embodiment. In the embodiment of FIG. 1, the building 10 is a residential home, apartment, or duplex. In other embodiments, the building may be a commercial property such as a warehouse, office space, or the like. A space inside the building 10 is subdivided into a plurality of rooms 12 by walls 14. The walls 14 at least partially isolate the rooms 12 from one another such that each room 12 may have different environmental conditions (e.g., temperature, humidity, etc.) from adjacent rooms 12. In this way, the rooms 12 may form separate environmental zones within the building 10. In other embodiments, one or more rooms 12 may be connected by vents or other openings, such that the one or more rooms 12 form a single environmental zone. In yet other embodiments, the environmental zones may be distributed across different floors (e.g., levels, etc.) of the building 10.

As shown in FIG. 1, the system 100 includes a plurality of IAQ components located in different rooms 12 throughout the building 10. For example, the system 100 includes a heating, ventilation, and air conditioning (HVAC) system 102 configured to heat and/or cool the space within the building 10. The HVAC system 102 includes HVAC components including one or more conditioning units 104. In the embodiment of FIG. 1, the conditioning unit 104 is a heat pump that may provide hot air or cool air depending on how the heat pump is configured. In other embodiments, the conditioning unit 104 may be a furnace such as a natural gas fueled furnace, a boiler, a gas-fired space heater, an electric heater, a wood-burning and/or pellet stove, or another form of heating device. In another embodiment, the conditioning unit 104 is an air conditioning unit such as an evaporative cooler, or another form of cooling device.

As shown in FIG. 1, the conditioning unit 104 is disposed in a lower level (e.g., basement) of the building 10 and is fluidly connected to different rooms 12 throughout the building 10 by air conduits (e.g., ducts, flow lines, etc.). The air conduits include supply lines 106 that provide conditioned air to the different rooms 12 and/or spaces within the building 10, and return lines 108 that return air from different rooms 12 and/or spaces within the building 10 back toward the conditioning unit 104. The HVAC system 102 also includes an air cleaner 110 disposed in the return line 108 where the air enters the conditioning unit 104. The air cleaner 110 is configured to clean the air and remove any particulate matter (e.g., dust, dirt, etc.) before the air enters the conditioning unit 104. The air cleaner 110 may be a replaceable or reusable particulate filter, an electrostatic filter, an electronic air cleaner, an activated carbon filter, or another type of air cleaning device.

In some embodiments, the conditioning unit 104 may also be fluidly connected to an environment surrounding the building 10 (e.g., outdoor environment 16), such that the conditioning unit 104 may receive or otherwise exchange air with the environment surrounding the building 10. In the embodiment of FIG. 1, the conditioning unit 104 is fluidly connected to the outdoor environment by a ventilation system 112. The ventilation system 112 includes a fluid driver 114 (e.g., blower, fan, etc.) that routes fresh outdoor air through ducts that are connected to the return lines 108. In one embodiment, the fluid driver may be integrated with or otherwise part of the conditioning unit 104. The ventilation system 112 may further include heat exchangers that pre-warm/cool the air entering the building 10, depending on outdoor conditions, to bring the outdoor air closer to the temperature of the air in the rooms 12, and to thereby reduce the input power required to condition the incoming air.

The HVAC system 102 also includes a dehumidifier 115 and a humidifier 116, which are configured to control an amount of humidity (e.g., a relative humidity, an absolute humidity, etc.) of the air within the building 10. As shown in FIG. 1, the dehumidifier 115 is fluidly connected to the return line 108 upstream from the conditioning unit 104. The humidifier 116 is fluidly connected to the supply line 106 downstream from the conditioning unit 104. The operation of the dehumidifier 115 and the humidifier 116 may vary depending on the time of year, the humidity of the outdoor environment, the type of HVAC component used to heat and/or cool the building 10, and/or other factors. For example, in the wintertime, where the outdoor humidity is low, the HVAC system 102 may be configured to deactivate the dehumidifier 115 and activate the humidifier 116 to maintain the building 10 at comfortable humidity levels for occupancy, whereas in the summertime, where the outdoor humidity may be elevated, the HVAC system 102 may be configured to activate the dehumidifier 115 to enhance user comfort and improve cooling performance.

The HVAC system 102 may also include one or more portable HVAC units, shown, for example, as portable unit 118. Portable unit 118 may be configured to provide heated and/or cooled air to specific zones/areas within the building 10. In the embodiment of FIG. 1, the HVAC system 102 includes a plurality of portable units 118, each portable unit 118 located in a different room 12 of the building 10 (e.g., the living room, a bedroom, etc.). The portable units 118 are repositionable and may be relocated to different areas within the building 10 based on user preferences. The portable units 118 may be configured to operate independently from the conditioning unit 104, and/or in combination with the conditioning unit 104. The portable units 118 may be or include portable electric heaters, portable air conditions, portable humidifiers, portable dehumidifiers, portable air filtration units, portable automatics dispensers and/or other types of portable HVAC units.

As shown in FIG. 1, the HVAC system 102 further includes a user control device 120 configured to operate one or more of the HVAC components based on environmental conditions within the building 10 (e.g., at least one room 12), environmental conditions outside the building 10, and/or user preferences. The user control device 120 may include sensors (e.g., temperature sensors, humidity sensors, etc.) configured to monitor environmental conditions within the building 10. In at least one embodiment, the sensor may be a circuit within the user control device 120. For example, the sensor may be a circuit that measures or otherwise determines whether one or more of the HVAC components is activated/deactivated or any operational status of equipment that is communicably coupled to the user control device 120. The user control device 120 may also include a user interface configured to receive an environmental condition set point, and to control operation of the HVAC component based on the set point and the measured environmental conditions within at least one room 12. In one embodiment, the user control device is a thermostat that is configured to control operation of the conditioning unit 104 based on a sensed temperature within at least one room 12 of the building 10 (e.g., a living room as shown in FIG. 1). In some embodiments, the HVAC system 102 includes multiple user control devices 120 that communicate with one another to help balance environmental conditions between multiple rooms 12 and/or spaces. Among other benefits, using multiple user control devices 120 allows an occupant to adjust environmental conditions from more than one room 12, and/or to maintain different environmental conditions within different rooms or areas. For example, each user control device 120 may be configured to selectively control operation of electronic dampers, valves, and HVAC component(s) to provide independent environmental control of different zones within the building 10 (e.g., to maintain the bedroom at a different temperature than the living room, etc.).

The system 100 also includes non-HVAC components including fans, window blinds, and other non-cooling and/or heating components. For example, as shown in FIG. 1, the building 10 includes a bathroom exhaust fan 150 that fluidly connects a bathroom space within the building 10 to the outdoor environment, and that can be operated to remove excessive moisture and odors from the bathroom. The building 10 additionally includes a kitchen hood 152 (e.g., range hood, stove fan, etc.) that fluidly connects a kitchen space, above a stove/range, with the outdoor environment, to reroute grease, moisture, and cooking odors outside of the kitchen. In some embodiments, the building 10 may further include an attic fan 165 or another type of indoor air ventilation device. In yet other embodiments, the building 10 may also include a radon mitigation system 164 including a flow conduit and inline fan 166 to remove radon from beneath the building 10 (and/or from other areas in the vicinity of the building 10). In other embodiments, the building 10 may include additional, fewer, and/or different devices that can be used to affect IAQ.

As shown in FIG. 1, the non-HVAC components may also include a plurality of remote sensors, shown as sensors 154. The sensors 154 are each located in a separate room 12 of the building 10. The sensors 154 are standalone devices that are configured to monitor various environmental conditions and/or occupancy conditions in different areas within the building 10. In other embodiments, the sensors 154 may form part of an IAQ/HVAC system, such as HVAC system 102. For example, the sensors 154 may be communicably coupled to the conditioning unit 104. The sensors 154 may be indoor/outdoor temperature sensors, humidity sensors (e.g., condensation sensors), or another form of environmental condition sensor. In an embodiment, the sensors 154 include at least one radon sensor or detector configured to detect elevated levels of radon in the building. The radon sensor may be positioned in a lowest building level such as a basement (e.g., sensor 168) of the building to detect radon before it passes into the building 10. In other embodiments, the radon sensor and/or other remove sensors 154 could be located at any other location within or adjacent to the building 10. In yet other embodiments, the sensors 154 may include window and/or door position sensors/switches (e.g., sensor 170) configured to measure or otherwise monitor a position of the window and/or door, air flow sensors configured to measure an amount of air passing through the window and/or door, air speed sensors configured to measure an air velocity passing through the window and/or door, sunlight sensors configured to measure an amount of light received within the building 10, and/or other types building arrangement or building condition monitoring sensors. The system may also include window temperature sensors and/or moisture sensors to detect the presence of—or conditions suitable for accumulation of—moisture (e.g., condensation) on exterior windows and/or walls of the building. Such building arrangement sensors may be used to notify the system of structural arrangements of the building that impact the quality of air inside the building, even if they do not measure air quality directly. In some embodiments, the sensors 154 also include pressure sensors (e.g., barometric pressure sensors) configured to monitor a pressure inside of or external to the building 10.

The system 100 also includes a remote computing device and/or system cloud 156. The system cloud 156 is communicably coupled to the various HVAC components and non-HVAC components within the building 10 (e.g., through the user control device 120, through an internet gateway for the building 10, etc.). In an embodiment, the system cloud 156 is a cloud service that is configured to update and maintain software for the user control device 120. The system cloud 156 may also be configured to coordinate operations of the various IAQ components based on (i) sensor data from the user control devices 120 and/or remote sensors 154 (data from a supplier cloud 157 that is communicably coupled to the remote sensors 154), (ii) inputs from the user control device 120, and/or (iii) inputs from other data clouds and wireless/wired devices that are communicably coupled to the system cloud 156 (e.g., personal computing devices such as laptops, mobile phones, tablets, etc.). For example, the system cloud 156 may be configured for bi-directional communication with a third-party cloud 158 (e.g., third-party-hosted cloud) such as a weather service, emergency service, security service, or another information database. In other embodiments, the system 100 may include additional, fewer, and/or different components.

As shown in FIG. 1, all of the IAQ components including both the HVAC equipment and non-HVAC equipment may be communicably coupled to and controlled by a single control device (e.g., central controller). In other words, all of the IAQ components are centrally and collectively controlled to modify the environmental conditions within the building. For example, all of the IAQ components may be controlled by the user control device 120, the remote computing device (e.g., utilizing the supplier cloud 156 or another data cloud), or another suitable central or remotely controlled control device. In some embodiments, the IAQ component(s) may be controlled using a third-party controller from an HVAC equipment manufacturer or home automations system manufacturer that is authorized as a partner controller to communicate with the IAQ component(s). In such implementations, the partner controller may serve as the central controller. In other embodiments, a controller in one or more IAQ components may be used to control the others. Commands may be issued to the single control device via a graphical user interface on the control device, or from inputs received from other remote computing devices (e.g., a mobile phone, a laptop, a tablet, etc.) that are communicably coupled to the single control device.

Figure 2:
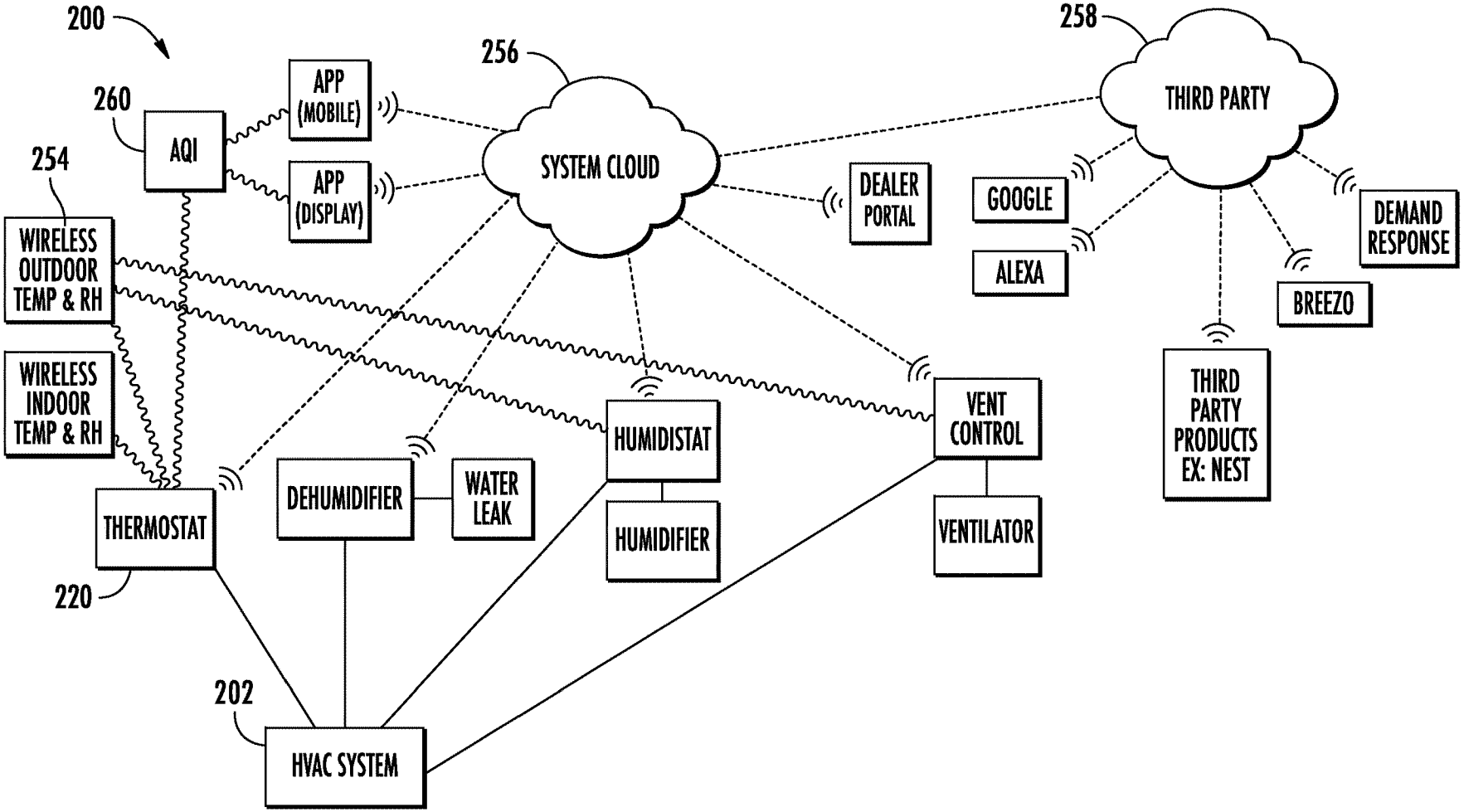
FIG. 2 is a block diagram of a whole building air quality control system, according to an embodiment.

Referring to FIG. 2, a block diagram of a whole building air quality control system 200 is shown that illustrates one manner of arranging and connecting the various control devices and components that form the system 200, according to an embodiment. In other embodiments, the connections between the control devices and/or components of the system 200 may be different. Unlike conventional systems (e.g., home automation, smart home, etc.), the whole building air quality control system 200 goes beyond basic on/off control (e.g., if this than that (IFTTT) control logic) for interconnected IAQ components. Rather, the whole building air quality control system 200 determines conditions through measurements, user preferences, and the like and makes engineering decisions based on these inputs using algorithms (empirical data, industry guidelines, etc.), look up tables, and the like, which are embedded into controller logic. As shown in FIG. 2, the system 200 includes an HVAC system 202 that includes various IAQ components. The system 200 additionally includes a plurality of user control devices 220, including a thermostat, a dehumidistat, a humidistat, and a vent controller that are, for example, operably connected to the HVAC system 202 via wired connections. The system 200 further includes a plurality of sensors 254 that are configured to measure environmental conditions within (or outside of) a building and report the environmental conditions to at least one user control device 220. As shown in FIG. 2, the sensors 254 include an outdoor temperature and relative humidity sensor coupled to the humidistat and the vent controller and an indoor temperature and relative humidity sensor coupled to the thermostat and the dehumidistat. The sensors may be, for example, wirelessly coupled to at least one user control device via a router, Bluetooth, wireless gateway, and/or another form of short range or long range communication format.

As shown in FIG. 2, the system 200 also includes a human-machine interface (HMI) 260 which may be implemented as computer software via one of the user control devices 220 (e.g., the thermostat) and/or a remote computing device (e.g., a mobile phone, a tablet, a laptop computer, etc.). The HMI 260 may be configured to receive and interpret user inputs, which are analyzed by the software to determine operating instructions for the HVAC system 202 (e.g., IAQ components). As shown in FIG. 2, the system 200 further includes a plurality of data clouds, including a system cloud 256 and a third-party cloud 258. As described above, the system cloud 256 may be a cloud service (e.g., computing device, server, etc.) that is used to coordinate operations of the whole building air quality control system 200. The system 200 may also include at least one supplier cloud that is hosted by or otherwise associated with one or more IAQ components or one or more sensors. The supplier cloud may receive data from one or more IAQ components in the system 200 and may be configured to output data from the one or more IAQ components to the system cloud 256 or the third-party cloud 258. For example, the supplier cloud may be hosted by or associated with a manufacturer of an individual piece of IAQ equipment or sensor. For example, the supplier cloud may support a radon sensor within the building. Measurements from the radon sensor may be transmitted to the supplier cloud and from the supplier cloud to the system cloud 256 or third-party cloud 258. The third-party cloud 258 (e.g., partner cloud, etc.) is a cloud which may be hosted by or associated with a manufacturer of a system or provider of a third-party service which a user desires to attach to or use in conjunction with the whole building air quality control system 200. For example, the third-party cloud 258 may be a cloud service for a security system, which may have its own sensors and logic, and may be configured to transmit and receive information to other third-party clouds 258. For example, the third-party cloud for a security system may be configured to receive information from the system cloud 256. The security system may display output on their own user interface based on this data. In some embodiments, the third-party cloud 258 can be used to adjust control parameters (e.g., temperature) for the whole building air quality control system 200 by direct communication with the system cloud 256, whereas the supplier cloud 256 may only be able to transmit data to the whole building air quality control system 200 (and not take any direct control actions). The system cloud 256, supplier cloud(s), and third-party cloud(s) 258 may be communicably coupled to each other and/or the user control device 220 (and also may be accessible from any remote computing device) via a communications link (e.g., via the internet). The whole building air quality control system 200 may also include local network links to facilitate communication between building equipment. For example, building equipment may communicate via wired connection or wirelessly (e.g., via Zigbee, Wi-Fi, BACNET (and/or another commercial HVAC industry protocol), a proprietary protocol of a third-party supplier or HVAC equipment manufacturers, internet, or another short range or long range communications format). In one embodiment, the system cloud 256 is configured to receive and distribute control signals from the user control device 220 and/or remote computing device. In such an embodiment, the system cloud 256 is a central controller for the system 200 that may be configured to coordinate operation of the various HVAC system 202 equipment and non-HVAC equipment. In other embodiments, the system cloud 256 is also configured to receive and interpret user inputs from the user control device 220 and to determine environmental control set points based on the user inputs, as will be further described.

As shown in FIG. 2, the system cloud 256 is communicably coupled to the third-party cloud 258 and is configured to receive data from the third-party cloud 258. The third-party cloud 258 may provide communication between the system 200 and other third-party products such as smart home products, third-party user control devices (e.g., third party thermostats, etc.), wireless sensors (e.g., outdoor air quality meters, outdoor pollen sensors, outdoor smoke detectors, etc.), and/or other internet of things (IoT) devices and wireless services (e.g., IFTTT, etc.). In one embodiment, the third-party cloud 258 includes a weather services database that may provide local outdoor conditions and other weather information. In another embodiment, the third-party cloud 258 includes an emergency services database that may provide information regarding nearby hazards or events that might impact the conditions outside of the building (e.g., fires causing heat, increased amount of smoke and/or other noxious gases, building collapse causing particulate matter dispersal, etc.). In another embodiment, the third-party cloud 258 reports outdoor conditions such as ozone, high pollen, or other metrics that can affect a person's health.

Figure 3:
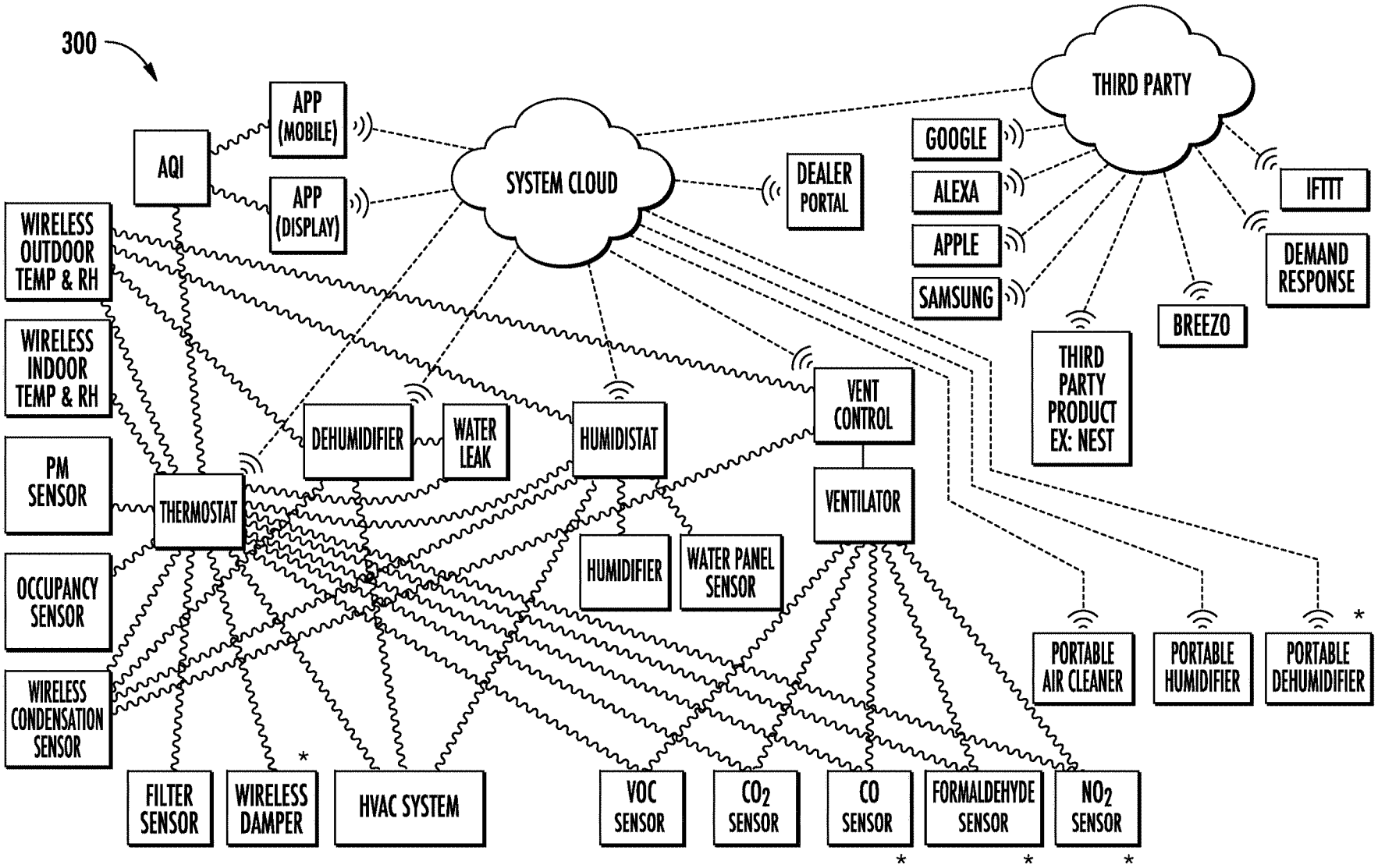
FIG. 3 is a block diagram of a whole building air quality control system, according to another embodiment.

FIG. 3 shows an expanded whole building air quality control system 300. The system 300 integrates additional IAQ components positioned within the building as compared to system 200 including, for example, wireless and/or wired vent damper actuators (e.g., HVAC vent dampers), and portable equipment such as an air cleaner, a humidifier, and a dehumidifier. Other IAQ components may include vent fans throughout the building (e.g., range hoods and bathroom fans as described with reference to FIG. 1, etc.), radon and/or other noxious gas mitigation systems, and others. The system 300 also integrates various additional sensors including particulate matter sensors, occupancy sensors, carbon monoxide (CO) sensors, carbon dioxide (CO2) sensors, nitrogen dioxide sensors (NO2), volatile organic compounds (VOC) sensors, formaldehyde sensors, radon sensors, condensation sensors, barometric pressure sensors, filter sensors (e.g., restriction and/or pressure drop sensors), water panel sensors, and other sensor types. In some embodiments, the system 300 also includes circuits, sensors, or the like that are configured to provide operational information regarding IAQ components such as operational status of a furnace, service alerts or health status information for IAQ components, and/or other diagnostic information.

Figure 4:
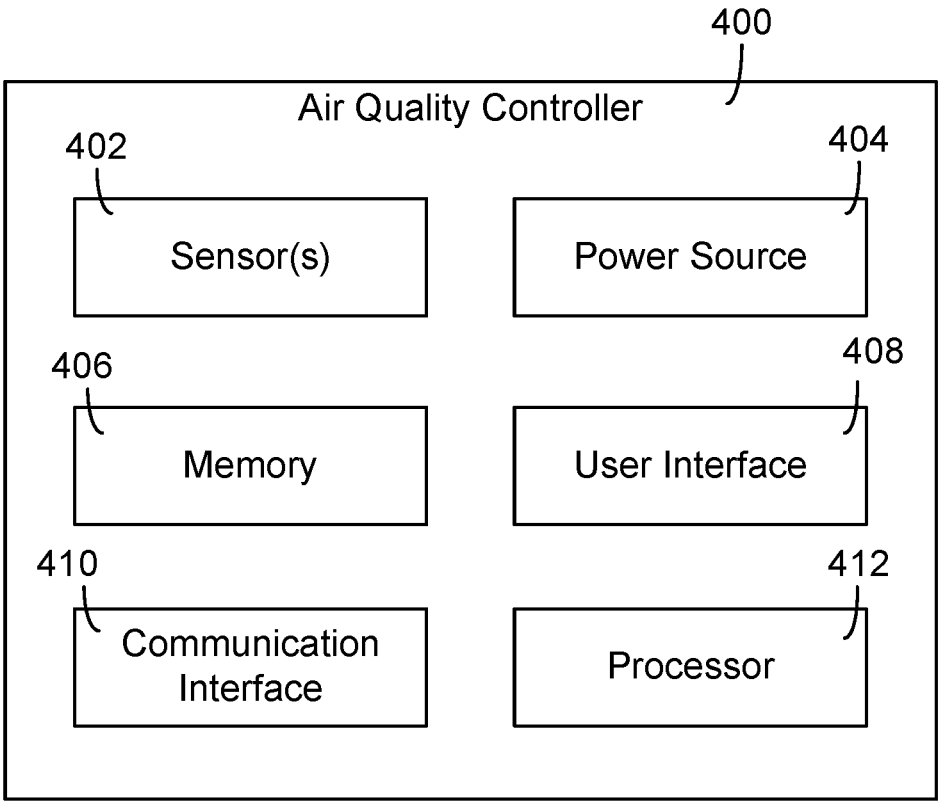
FIG. 4 is a block diagram of an air quality controller, according to an embodiment.

Referring to FIG. 4, a user control device is shown as air quality controller 400 (e.g., computing device, etc.). The air quality controller 400 may be the same as or similar to the user control devices 120, 220 described with reference to FIGS. 1 and 2, respectively. In one embodiment, the air quality controller 400 is a thermostat that is contained within a thermostat or other control device. In another embodiment, the air quality controller 400 is a remote computing device such as a mobile phone, a tablet, a laptop computer, or another portable computing device. In yet another embodiment, the air quality controller 400 forms part of a data cloud (e.g., the system cloud 156 of FIG. 1) configured to receive commands from a user control device within the building and/or a remote computing device. In at least one embodiment, the air quality controller 400 forms part of a control circuit (e.g., and air quality control circuit, an air quality control unit, and air quality control module, etc.) for one of the thermostat, remote computing device, or data cloud. The air quality controller 400 includes a sensor 402, a power source 404, memory 406, a user interface 408, a communications interface 410, and a processor 412 (e.g., a processing circuit, etc.). In other embodiments, air quality controller 400 may include additional, fewer, and/or different components. The sensor 402 may be any form of environmental condition sensor (e.g., at least one of the environmental sensors described with reference to FIG. 3). In one embodiment, the air quality controller 400 includes a plurality of sensors 402. Additionally, although the sensor 402 is shown as an integral part of the air quality controller 400, it will be appreciated that the sensor 402 may be positioned remote from the air quality controller 400 in various illustrative embodiments.

The power source 404 may be any type of power supply. For example, the power source 404 may include a battery pack. Alternatively, or in combination, the air quality controller 400 may be hard-wired to a municipal power supply (e.g., a utility grid, a generator, a solar cell, a fuel cell, etc.).

Memory 406 for the air quality controller 400 may be configured to store sensor data from the at least one sensor 402 over a given period of time. Memory 406 may also be configured to receive and store information from the system cloud 256, the third party cloud 258, and/or the supplier could. For example, memory 406 may be configured to receive weather data from a weather service that is coupled to the system cloud 256, via the internet, and/or another third party. Memory 406 may also be configured to store user inputs received via the user interface 408. The user inputs may include qualitative parameters (e.g., comfort, energy, health, etc.), device information (e.g., sensor and/or controller position within the building, model information for the IAQ components, etc.), building-specific information (e.g., building type, square footage, room layout, number of floors, energy rating, etc.), occupancy information (e.g., family size, occupant age, etc.), occupant lifestyle and/or personal health information (e.g., medical conditions, etc.), personal preferences (e.g., a desired temperature throughout the building or another measureable environmental parameter, etc.), and/or another user input.

Additionally, memory 406 may include a non-transitory computer-readable medium configured to store computer-readable instructions for the air quality controller 400 that when executed by the computing device (e.g., controller 400, processor 412), cause the air quality controller 400 to provide a variety of functionalities as described herein. For example, memory 406 may be configured to store instructions for processing raw data from the sensor(s) 402 to determine a measured environmental condition (e.g., temperature, relative humidity, an amount of particulate, etc.). Memory 406 may also be configured to store instructions for processing raw data from cloud data sources (e.g., the system cloud 256, the third party cloud 258, the supplier cloud, the internet, etc.). The instructions may also include calculation instructions used to determine an actual air quality metric (e.g., an actual IAQ) for the air quality control system based on information from the sensor(s) 402. In another embodiment, the instructions include calculation instructions used to determine a baseline air quality metric (e.g., a baseline IAQ, etc.) for the air quality control system based on user inputs. In yet another embodiment, the instructions include conversion instructions used to convert at least one qualitative parameter (e.g., comfort, energy, health, etc.) into a plurality of control points for the IAQ components. In yet another embodiment, memory 406 is configured to store a time history of at least one calculated IAQ metric (e.g., the actual IAQ, the baseline IAQ, a qualitative parameter, etc.). In yet another embodiment, the instructions may include display information used to generate the GUI for the air quality controller 400.

Memory 406 may also be configured to receive updates with new and/or different instructions and algorithms. For example, memory 406 may be configured to receive over-the-air updates from cloud data sources (e.g., the system cloud 256, the third party cloud 258, the supplier cloud, the internet, etc.). The updates may include completely new versions of operating software, bug and/or security fixes, and/or updated values for key tuning parameters that affect operation of the controller 400 in the building 10.

The user interface 408 is configured to display system operating parameters and receive user inputs. The user interface 408 may include one or more controls, displays, speakers, haptic feedback actuators (e.g., vibration) or other computer user interface for conveying and receiving information. According to an illustrative embodiment, the user interface 408 includes a touch-screen display (e.g., a liquid crystal display (LCD), etc.) for presenting a GUI of the air quality controller 400 to a user. The user interface 408 can be, for example, a touch-screen display of a thermostat, a mobile phone, or another computing device that is communicably coupled to a supplier cloud (e.g., supplier clouds 156, 256 of FIGS. 1 and 2, respectively). The user interface 408 may also include other forms of HMI, including—but not limited to—microphones for receiving verbal commands, or another form of over-the-air interface (e.g., a voice controlled ambient computing input).

The communications interface 410 may be configured for wired and/or wireless communications between sensors, one or more IAQ components, user control devices, and/or data clouds. In one embodiment, the communications interface 410 is a transceiver (i.e., transmitter-receiver) that both receives and transmits wireless signals from the various components of the air quality control system. For example, the communications interface 410 may be configured to receive inputs from the user interface 408 and sensor data from the sensor(s) 402. Additionally, the communications interface 410 may be configured to transmit control signals from the air quality controller 400 to the IAQ component(s) to control operation of the IAQ component(s).

According to an illustrative embodiment, the processor 412 is operatively coupled to each of the components of the air quality controller 400, and is configured to control interaction between the components. For example, the processor 412 may be configured to control the collection, processing, and transmission of sensor data from the sensor(s) 402, inputs from the user interface 408, cloud data, and/or operation data from the IAQ component(s). Additionally, the processor 412 may be configured to interpret operating instructions from memory 406 to determine at least one of (i) a baseline air quality metric (e.g., a baseline IAQ, etc.) for the air quality control system based on user inputs (e.g., based on inputs received by the communication interface 410 from user interface 408); (ii) an actual air quality metric (e.g., an actual IAQ) for the air quality control system based on information from the sensor(s) 202; and (iii) a plurality of control points for the IAQ component(s) based on at least one user-specified qualitative parameter. The processor 412 may also be configured to control operation of the IAQ component(s), for example, based on at least one of the foregoing metrics and/or parameters. For example, the processor 412 may be configured to control the IAQ component(s) based on measured environmental conditions and the environmental set points determined in (iii) above.

Baseline Indoor Air Quality

The air quality controller 400 is configured to establish a baseline (e.g., target, recommended, etc.) IAQ that is tailored to the specific and/or unique needs of the building and/or its occupants. The controller 400 is configured to operate the IAQ component(s) to achieve environmental conditions within the building that correspond with the baseline IAQ. According to an illustrative embodiment, the baseline IAQ is determined by the control device during initial startup after installation into the building, and is periodically or continuously updated during use, as conditions change either within the building or in the outdoor environment. In addition, the baseline IAQ may be updated based on revised or changing preferences of one or more occupants of the building. In contrast with traditional HVAC control system implementations, which rely on a user to individually select the desired environmental set points after installation, the air quality controller 400 of the present disclosure may automatically determine a target and/or recommended environmental set point(s) (and/or control point(s) such as upper and lower thresholds and/or tolerances for the environmental set points) based on various baseline parameters. As used herein, the term "baseline parameters" refers to inputs that affect the environmental set points used to control IAQ component(s). For example, the baseline parameters may include occupant preferences (e.g., manual user inputs), building and/or IAQ equipment design information, the arrangement of IAQ components within the building, and other inputs that affect the environmental set points. Among other benefits, establishing a baseline IAQ from these different baseline parameters simplifies installation, setup, and user control of the air quality control system and reduces variability in environmental conditions between different locations, in different climates, and different building types. The control approach may also help ensure that at least an average, best possible indoor air quality is established at startup, regardless of the IAQ equipment that is being used.

Figure 5:
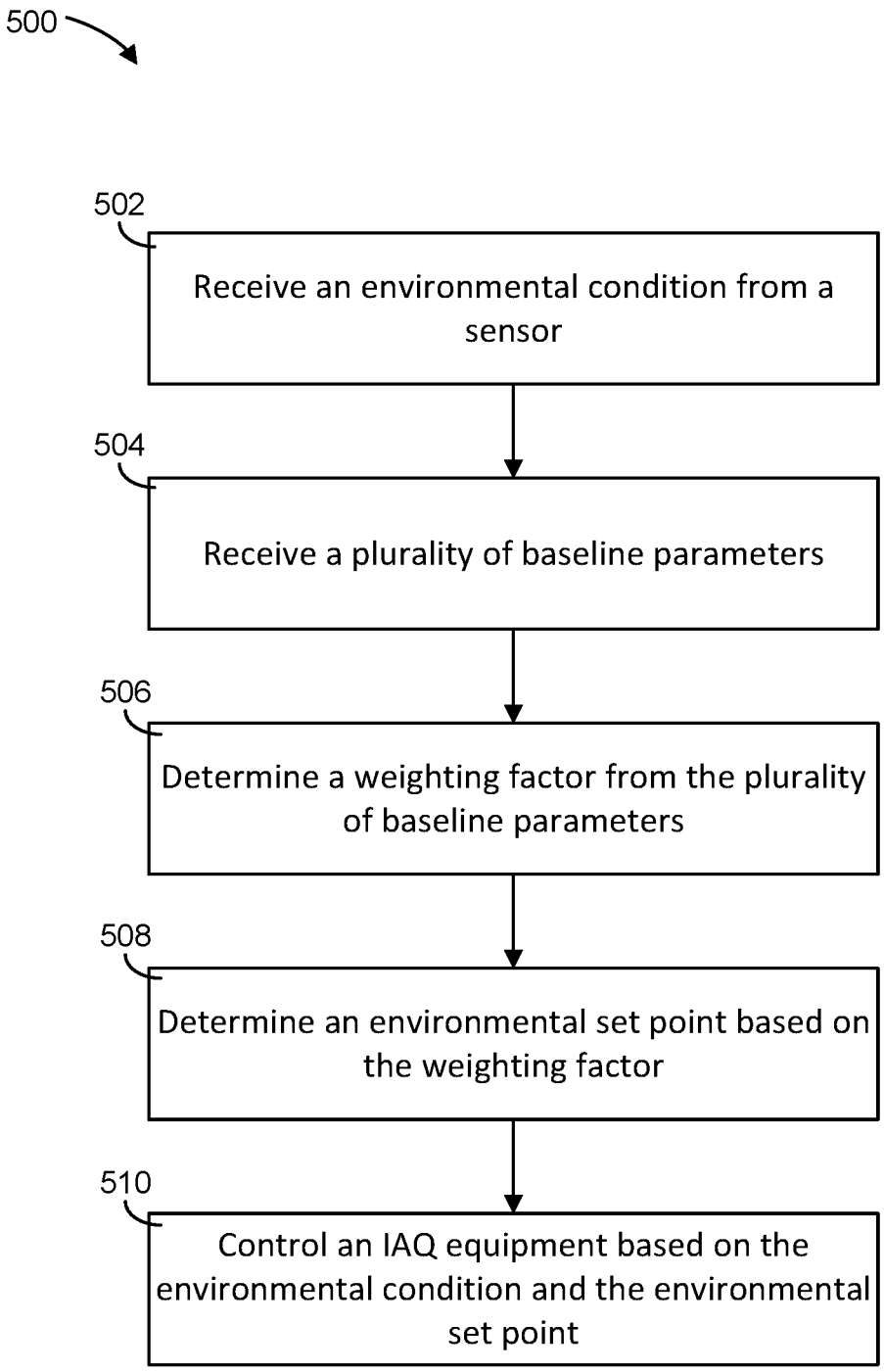
FIG. 5 is a flow diagram of a method of controlling IAQ equipment, according to an embodiment.

Referring to FIG. 5, a flow diagram of a method 500 to determine a baseline IAQ for a specific building is shown, according to an illustrative embodiment. The method 500 may be implemented using the air quality controller 400 of FIG. 4, for example, through a software application installed on the air quality controller 400. As such, reference will be made to the air quality controller 400 when describing method 500. In another embodiment, the method 500 may be implemented through the cloud (e.g., the system cloud 156 of FIG. 1, etc.) such that the control and processing components of the system can be located remotely and/or users can perform the setup remotely using, for example, a mobile phone, a laptop computer, a tablet, or another type of remote computing device. In another embodiment, additional, fewer, and/or different operations may be performed. It will be appreciated that the use of a flow diagram and arrows is not meant to be limiting with respect to the order or flow of operations. For example, in an illustrative embodiment, two or more of the operations of method 500 may be performed simultaneously.

At operation 502, the air quality controller 400 receives an environmental condition, building arrangement condition, and/or another condition impacting IAQ from a sensor (e.g., sensor 402). Operation 502 may include measuring an environmental condition using the sensor. For example, operation 502 may include measuring a temperature of a room of the building, near the air quality controller 400, or in different rooms using remote sensors. The sensor data (e.g., temperature data) may be received by the air quality controller 400 via communications interface 410. In another embodiment, operation 502 may include receiving a plurality of measured environmental conditions associated with the building. The sensor may be a temperature sensor configured to measure an indoor temperature, a humidity sensor configured to measure an indoor relative humidity, a particulate matter sensor, a CO sensor, a CO2 sensor, an NO2 sensor, a VOC sensor, barometric pressure sensor, a radon sensor, and/or another sensor type. In yet other embodiments, operation 502 may include receiving at least one building arrangement condition such as a window or door position from a position sensor, an air flow from an flow rate sensor, an air velocity from an air speed sensor, moisture amount and/or location from a moisture/condensation sensor (e.g., on windows, etc.), and/or other sensors that may represent changes in the condition of indoor air.

At operation 504, the air quality controller 400 receives a plurality of baseline parameters (e.g., baseline factors, etc.). The baseline parameters may be manually input into the system by a user (via the HMI, etc.). In another embodiment, the baseline parameters may be preprogrammed into memory by a manufacturer. For example, the baseline parameters may be default recommendations that are used by the controller when certain user inputs are not provided. In yet another embodiment, the baseline parameters may be based on sensor data (e.g., outdoor and/or indoor environmental condition sensors, data from a cloud data source such as the system cloud, third party cloud, supplier cloud, the internet, etc.). In another embodiment, the baseline parameters may include occupant preferences for one or more individuals that need to be balanced (e.g., balancing one occupant's desire for energy efficiency, with another occupant's desire for comfort, etc.). The baseline parameters are inputs that distinguish the building from other residences and commercial spaces. The baseline parameters may include the unique conditions of the environment in which the building is located, unique environmental conditions within the building, the system configuration, and/or the building layout/design. For example, the baseline parameters may include the types of IAQ components that are installed in the home, the geographic location of the building, seasonal information, and building type and/or energy rating (e.g., the home's energy system rating (HERS) index, etc.). The baseline parameters may also include occupant specific information. For example, the baseline parameters may include a family size (e.g., number of occupants), personal preferences of at least one occupant (e.g., a temperature that maximizes his/her feeling of comfort), times of occupancy (e.g., work schedule, etc.), heath information (e.g., whether the occupants have pre-existing health conditions, respiratory illnesses, the age of the occupants, etc.), and other life style information, etc. In one embodiment, the baseline parameters may include energy usage goals, information regarding the utility of one or more rooms within the building (e.g., which rooms are used the most), and/or information regarding rooms where IAQ is most concerning. The baseline parameters may also include information regarding the type of HVAC equipment being used and the overall system design (e.g., control zoning within the building, etc.). These equipment-related baseline parameters may be provided by the user by specifying the make and/or model of the equipment. The system may be configured to determine the baseline parameters from a lookup table based on these user inputs (e.g., via a lookup table, communication with a cloud data source, and/or through the internet). In other embodiments, the system is configured, via the communication interface (e.g., transceiver, etc.) to automatically discover the equipment make, model, and/or capabilities as part of the pairing process with building equipment (e.g., via a digital tag that is transmitted to the system from the building equipment). The baseline parameters may also include cooling habits, information relating to pets within the building, the cleanliness of the building, locations where chemicals are stored, number and location of rooms or spaces within the building, and the like (e.g., does the building have a basement?). The baseline parameters may also include parameters gathered from neighboring buildings (e.g., buildings within the same region, etc.), as will be further described.

Figure 6:
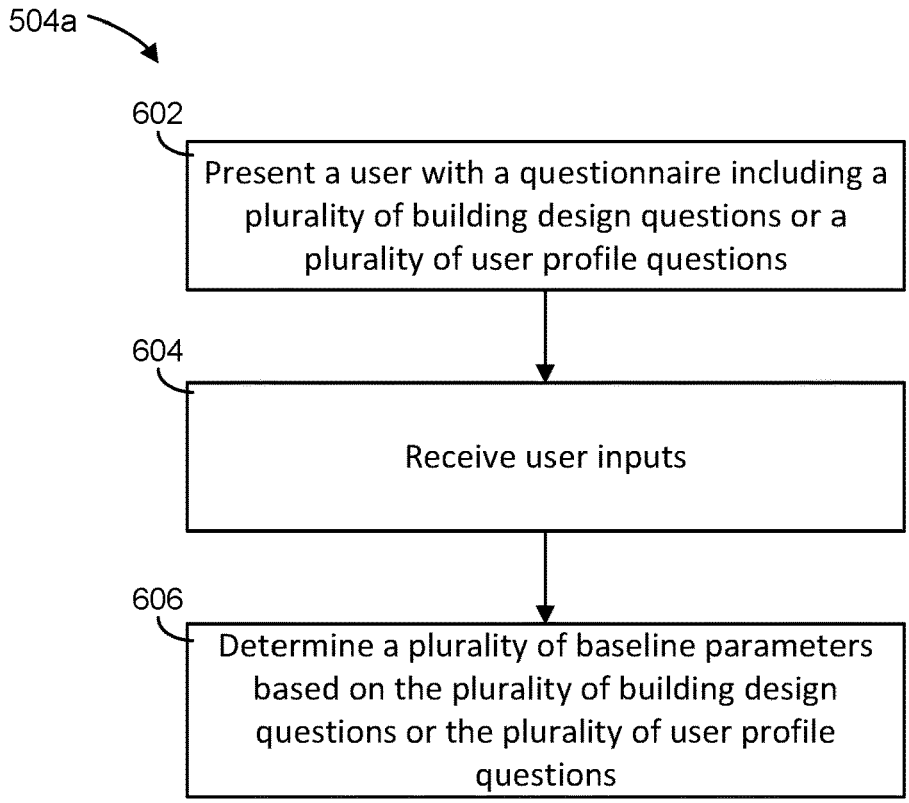
FIG. 6 is a flow diagram of a method of determining a plurality of baseline parameters for the method of FIG. 5, according to an embodiment.

As shown in FIG. 6, operation 504 (e.g., method 504*a*) may include determining the baseline parameters from user inputs that are received via the user interface 408, and/or from a computing device that is communicably coupled to the controller 400 (e.g., via a mobile phone, tablet, or ambient computing digital assistant such as Amazon Alexa, etc.). For example, operation 504 may include presenting the user with a questionnaire via the user interface 408 and querying user inputs (operation 602). The questionnaire may ask the user to individually specify one or more of the baseline parameters. For example, the questionnaire may ask the user to enter model number information for each piece of IAQ equipment that is connected to the air quality controller 400 or otherwise associated with the air quality controller 400 or building itself. The questionnaire may further include questions directed to the operating range/capacity of each piece of IAQ equipment. Alternatively or additionally, the questionnaire may include building design questions that relate to at least one baseline parameter. For example, the questionnaire may ask the user to specify an approximate size of the building, in addition to or rather than the particular model numbers or performance data of the IAQ equipment. The air quality controller 400 may be configured to receive the user inputs (operation 604) and determine, from the building size and known industry standards, the approximate performance of the IAQ equipment (operation 606). For example, the air quality controller 400 (e.g., processor 412) may be configured to access an algorithm that calculates an approximate amount of energy (e.g., BTU, etc.) from the square footage of the home. In another embodiment, the air quality controller 400 may be configured to access a database that includes lookup tables of HVAC equipment sizes and performance ranges as a function of different building design parameters. The database may also include information regarding the types of air cleaners that may be installed, type of ventilation used for the building of a given size, humidity control requirements, and the like.

A similar approach may be implemented by the controller 400 to determine personal preferences and occupant health information. For example, in one embodiment, the questionnaire or over-the-air prompts (e.g., voice prompts) may ask the user to enter his/her health information and personal preferences. In another embodiment, the questionnaire may include user profile questions that relate to a person's environmental preferences (e.g., based on the person's psychophysiological functions and responses, etc.). For example, the user may be presented with a Myers-Briggs-type test that can be used by the air quality controller 400 to determine user (i.e., occupant) preferences. For example, the test may ask the user to specify the outdoor environmental conditions that have been observed to be particularly problematic for the user (e.g., "where have you lived previously," "what seasons and/or times of year are your allergies most problematic in regions where you have previously lived?"). From this information, the air quality controller 400 may be configured to determine the types of allergens that the user is most sensitive to (e.g., ragweed, tree pollen, etc.). In some embodiments, the questionnaire may ask the user to specify any skin conditions they may have, breathing problems (e.g., particulate and asthma triggers, etc.), immunity concerns (e.g., autoimmune diseases, concerns with infection (COVID)), health risks, odor and gas sensitivities, whether the user smokes, etc. Such information can be used by the controller 400 to determine the necessary IAQ to improve the user's health.

Figure 7:
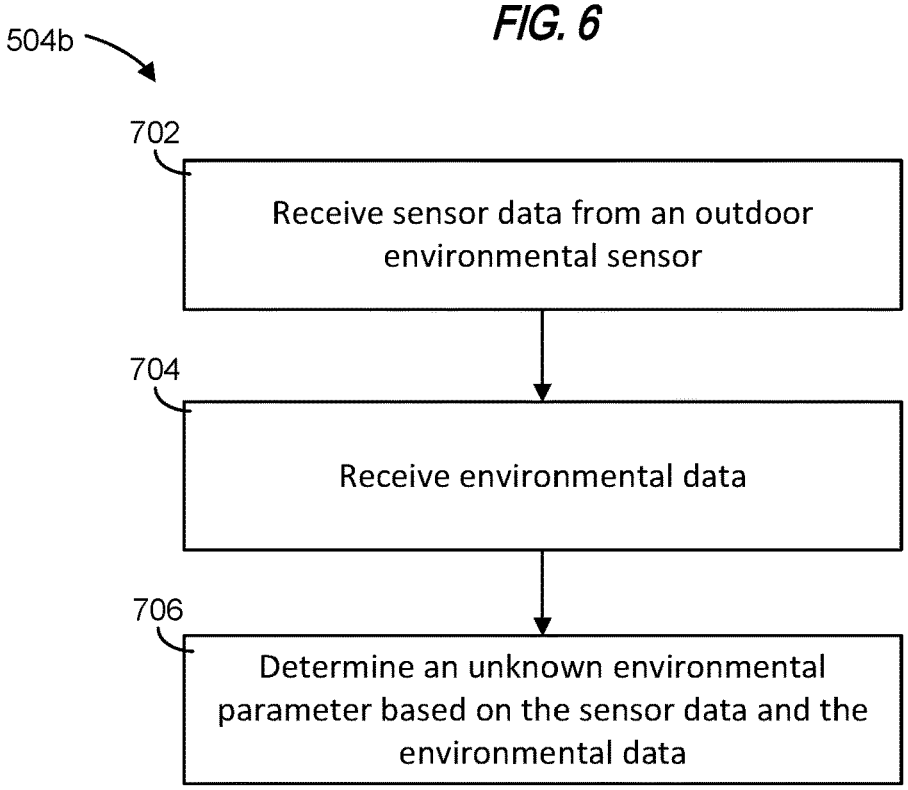
FIG. 7 is a flow diagram of a method of determining an unknown environmental parameter for the method of FIG. 5, according to an embodiment.

In another embodiment, as shown in FIG. 7, operation 504 (e.g., method 504*b*) includes determining baseline factors using sensor data from the sensor(s) 402. For example, operation 504 may include obtaining indoor and/or outdoor environmental conditions using at least one sensor, so that these unique conditions can be accounted for by the system when establishing the baseline IAQ. Although the following operation (504*b*) is described with reference to collecting and using data from at least one outdoor sensor, it will be appreciated that a similar operation would include using indoor sensor data from at least one indoor sensor to establish baseline IAQ. As shown in FIG. 7, operation 504 may include receiving outdoor sensor data from an outdoor sensor (operation 702). Operation 504 may include determining outdoor air quality directly from the outdoor sensor data (e.g., temperature, an outdoor humidity sensor, and/or an outdoor particulate matter sensor). In another embodiment, operation 504 may include determining an outdoor environmental condition that is not directly measured by any one of the sensors 402; for example, by comparing the outdoor sensor data to known environmental conditions in different locations during different times of the year (operations 704-706). Among other benefits, this control functionality allows the air quality controller 400 to determine environmental conditions that are not directly measured by any of the sensors 402. For example, this control functionality may allow the air quality controller 400 to determine an amount of particulate matter (e.g., pollen or other allergens, etc.) present in the outdoor environment based on temperature and/or humidity data from at least one outdoor sensor. Alternatively, or in combination, data regarding local outdoor environmental conditions may be determined by accessing lookup tables with tabulated climate information as a function of one of the measured environmental parameters. In yet another embodiment, local outdoor environmental conditions for the building are determined without using outdoor sensors, for example, by accessing a third-party weather service (e.g., through a supplier cloud and/or a third-party-hosted cloud, the internet, etc.) that can provide outdoor information based on the geographic location of the air quality controller 400.

In yet another embodiment, the air quality controller 400 may be configured to determine baseline parameters by crowdsourcing data from other whole building air quality control systems in the vicinity of the building. For example, the air quality controller 400 may be configured to identify other air quality control systems in a community surrounding the building (in a community where the building is located), and to copy the baseline parameters from the neighboring systems. This operation may be simplified in embodiments that include a supplier cloud, which may store baseline parameters and other setup/calibration data from neighboring air quality controllers. In other embodiments, the baseline parameters determined using any combination of the foregoing operations may be used to establish baseline IAQ.

Returning to FIG. 5, method 500 additionally includes determining at least one weighting factor from the plurality of baseline parameters (at operation 506). In one embodiment, the weighting factor(s) may be used to determine a global IAQ metric that can be compared to other whole building air quality control systems (e.g., to compare the performance of different air quality control systems). In such an implementation, the weighting factors are used as scoring factors to determine the global IAQ metric. Note that these scoring factors could be assigned by a technician or user during the initial setup of the control system. By way of example, FIG. 8 shows a scoring chart 750 for a whole building air quality control system, according to at least one embodiment. Columns two through four (from left) of the scoring chart show IAQ equipment (e.g., product) categories and different types of IAQ equipment that could be installed as part of the whole building air quality control system. In particular, the fourth column 752 shows different IAQ products and configurations that can be implemented by the air control system (where "(S)" indicates a parameter that may be entered at setup, and "(C)" indicates a value that may be calculated during operation, etc.). The fifth column 754 shows the different scoring factors assigned for each IAQ equipment configuration. For example, a filtration product that includes a MERV 11 filter (or a filter with a lower rating) is assigned a scoring factor of 0 (indicating the worst relative performance) whereas a MERV 16 filter is assigned a scoring factor of 3. Adding a particulate matter sensor to the control system (e.g., a PM 2.5 sensor, etc.) raises the scoring factor to 3.5 (an improved scoring factor is associated with systems that are able measure actual values of particulate matter in the air).

As shown in FIG. 8, columns four 752 and five 754 also indicate how the scoring factors are influenced by operating conditions of the IAQ equipment. For example, fan run time has a direct impact on the air quality within the building (e.g., without the fan running, no air is forced through the filter so particulate matter remains in the air). Longer fan run times will increase the quality of the air within the home (e.g., reduce particulate matter within the air) and therefore larger run times will result in higher values of the scoring factor. If the fan runs only in response to heating/cooling demand, the scoring factor will be low (e.g., 0). If the fan is operated in an air cycling mode (e.g., 20 min/hr or another suitable duty cycle), the scoring factor is increased (e.g., from 0 to 1). If the fan is operated continuously or due to frequent heating/cooling cycles (e.g., in the hot summer months, etc.), the scoring factor will increase even more (e.g., up to 1.5).

FIG. 9 shows another illustrative embodiment of a scoring chart 775. The scoring chart 775 includes a listing of different IAQ parameters (e.g., humidity, radon, CO2, TVOC, PM2.5, PM10, etc.) and values of each parameter that correspond with different IAQ levels. The IAQ levels are marked with identifiers 776 that correspond with colors that would be presented in the GUI for each level (e.g., "(G)" for green, "(Y)" for yellow, "(R)" for red, etc.). The colors provide visual indication to a user which IAQ parameters are outside of recommended levels. In some embodiments, the scoring chart 775 is accessible to a user via the GUI and/or editable so that the user may adjust parameter ranges corresponding with different IAQ levels. The scoring chart 775 may also provide recommendations that a user could reference to help address specific issues with building IAQ.

Other scoring factors may depend on the types of IAQ components that are installed in the building. For example, a higher scoring factor may be applied to control systems that include a humidifier as compared to those that don't. Additional scoring factors may be applied based on historical operating data, such as how long a building remains below a desired relative humidity set point during the day. In a scenario where the building remains below the relative humidity set point for a prolonged period of time, the scoring factor may be reduced. For example, if the system has averaged a relative humidity within a range of 47-52% over a first monitoring period (e.g., 2 weeks), the system may apply a higher scoring factor than if the system averages a relative humidity within a range between approximately 45%-55% over the first monitoring period. In this way, the global IAQ metric will increase or decrease in real time depending on how the system operates.

In at least one embodiment, the system may determine a scoring factor based on an operating condition of building equipment. For example, the system may be configured to monitor HVAC equipment and determine current operating conditions that could indicate changes in the building environment (e.g., air temperature, humidity, etc.). In one embodiment, the system includes an air conditioning unit equipped with flow condition sensors that monitor a temperature and/or pressure of the working fluid at different parts of the vapor-compression cycle. For example, the system may include a first sensor disposed at a low pressure side of a compressor (e.g., between the compressor and an evaporator, etc.); a second sensor disposed between the compressor and a condenser (e.g., at an inlet to the condenser); a third sensor between the condenser and an expansion valve or orifice; and/or a fourth sensor disposed between the expansion valve and an evaporator. The system may be configured to monitor the first sensor, second sensor, third sensor, and/or fourth sensor and to determine thermodynamic operating conditions (e.g., enthalpy, entropy, etc.) of the air conditioning unit at different parts of the cycle. In one embodiment, the system is configured to compare these thermodynamic conditions to ideal conditions for the air conditioner based on measured indoor and/or outdoor air temperatures (or other measured environmental conditions). In other embodiments, the system monitors and records historical operating conditions and/or determines average historical operating conditions. The system may be configured to compare the historical operating conditions to the thermodynamic conditions (in real time) and to notify the occupants or system cloud if the deviations are greater than threshold values. These differences may indicate, for example, potential air quality issues within the building that aren't directly measured by the sensors, and/or issues with the functioning and/or mechanical operation of the air conditioning unit (or other HVAC equipment). The system may be configured to generate a scoring factor that is indicative of the deviations between ideal or historical operating conditions and measured thermodynamic conditions.

In some embodiments, the system implements a machine learning algorithm for at least one piece of HVAC system equipment. For example, in the context of the air conditioning unit above, the system may implement a machine learning algorithm that controls operation of the air conditioning unit based on control inputs (e.g., a desired temperature, pressure, etc.), and one, or a combination of, measured environmental conditions and the thermodynamic operating conditions of the air conditioning unit. The system may issue different commands to control the compressor of the air conditioning unit and/or expansion valve, in an iterative fashion, to determine operations needed to match the measured outputs with the control inputs. The machine learning algorithm may monitor operating conditions over time and may detect anomalies that could indicate potential air quality issues within the building or equipment malfunction based on deviations between the measured and historical values as described above.

The global IAQ metric is determined by combining the weighting factors from the scoring chart. The global IAQ metric may then be displayed visually to a user via the user interface of the air quality controller 400. In the example embodiment of FIG. 8, the global IAQ metric is shown on a color scale that indicates the performance of the system relative to minimum and maximum operating thresholds. An arrow on the scale indicates the current global IAQ metric. A separate scale could be used to indicate the rating for each aspect of IAQ (e.g., one scale to represent humidity, another for temperature, another for ventilation, another for air cleaning, etc.). The global IAQ is a composite scale that indicates the overall performance resulting from the combination of these different aspects. Note that such a scale and scoring chart could be used to inform the user of their system's performance relative to other systems in the marketplace, and to help users make decisions at time of purchase or when deciding to upgrade various IAQ components. For example, filtration performance will be limited by the rating of the filter element (e.g., the scoring factor for filtration in this example is the amount of filtration multiplied by run time). As such, no matter how long the control system runs the fan in the building, the filtration performance will never exceed that of a similarly operated system with a higher rated filter. The scoring chart and scale allows a user to take these factors into account when making purchasing decisions. Different products (e.g., sensors, etc.) could also be added to the scoring chart and contribute to the global IAQ metric. For example, a CO2 sensor could be added and used to control ventilation to improve an amount of fresh air introduction into the building or to selectively control the IAQ component(s) to prevent unnecessary ventilation events and thereby improve the overall efficiency of the system.

The scoring chart and scale can also be used to facilitate purchasing decisions. For example, the controller 400 may be configured to monitor operating conditions of building equipment, such as a filter for an air conditioning or fresh air ventilation system. In one embodiment, the controller 400 is configured to adjust the scoring factor based on a relative restriction of the filter. The controller 400 may also be configured to make purchasing decisions automatically in response to certain operating conditions and/or levels of IAQ. For example, in an embodiment in which the system includes an air filter, the controller 400 may be configured to monitor a restriction and/or pressure drop across the air filter and to calculate an IAQ metric based at least partially on the measured restriction and/or pressure drop. The controller 400 may be configured to automatically order a replacement filter in response to a determination that the IAQ has fallen below (or increased above) a threshold value. For example, the controller 400 may be configured to automatically order a replacement air filter in response to a determination that the IAQ has fallen below good or moderate values of IAQ (e.g., based on particular values of an IAQ metric as will be discussed in further detail below). The controller 400 may transmit the request to the system cloud, a third party cloud, a supplier cloud, and/or the internet to order the replacement air filter. In other embodiments, the system may be configured to transmit a notification to a user of a need to replace the air filter or another replacement component (e.g., via a text message, push notification, over-the-air notification, etc.).

Note that other qualitative parameters could also be determined from this scoring chart. For example, a qualitative parameter such as energy use may be added that is indicative of the relative energy consumption compared to other systems and/or baseline operating conditions. By way of example, studies have shown that running an air cleaner in certain scenarios for a time interval of approximately 20 min/hr has the same relative effect (in terms of air quality) as running the air cleaner with the fan running continuously. As a result, a scale indicating the relative air quality performance of the system would not change if a home owner operated the air cleaner with partial to constant fan. However, a scale indicating the energy consumption of the system would account for this performance difference. The energy use scale could therefore be utilized by a user to reduce energy consumption without significantly impacting air quality within their home. For example, a scoring chart for system efficiency could include different scores associated with different duty cycles for an air conditioning unit or other HVAC equipment (e.g., a lower efficiency score for lower duty cycles). The scoring chart could further include scores associated with the relative amount of time that a vent fan is used instead of higher powered equipment such as the air conditioning unit or dehumidifier. The scoring chart may be an efficiency scoring chart that is maintained separately from the air quality scoring chart (e.g., separately from the air quality scoring chart that is associated with "healthy" air).

The controller 400 could control building equipment using the scoring chart to reduce energy costs. For example, in a scenario where a user indicated to the control system that energy consumption was more important to them than air cleaning, the system (e.g., controller 400) may be configured reduce fan operation to only operate in response to heating or cooling demands. Conversely, in a scenario where the user indicates that air cleaning is more important than energy consumption, the system (e.g., controller 400) may be configured operate the fan continuously or operate in an air cycling mode to increase the air quality to the extent possible. The control approach may be improved in scenarios where the system includes a particulate matter sensor, which can be used to measure the actual amount of particulate matter in the air. In such a scenario, the system could decide how to operate the fan for the air cleaner based on actual measurements, subjective input (energy efficiency vs. air quality), and/or the history of the measured air quality within the home (e.g., PM 2.5 over time). For example, a global IAQ metric related to air cleaning could be determined by multiplying the actual measured data, subjective input score, and historical particulate matter data.

In another embodiment, the weighting factor(s) may be used to determine a target environmental set point (e.g., a baseline environmental set point) for the building in the baseline operating condition. It will be appreciated that different types of environmental set points will depend on different numbers and/or types of baseline parameters. Additionally, the weighting factors that correspond to each baseline parameter may vary depending on the type of environmental set point being determined.

In the following example, the environmental set point is a target temperature set point for the building in the baseline operating condition. For the purposes of this example, it is assumed that the system does not include a humidification and/or dehumidification system other than an air conditioner, and that the humidity inside the building depends at least partially on the humidity of the air in the outdoor environment. Additionally, it is assumed that the building does not include any indoor humidity sensors to measure the relative humidity of the indoor air directly. In this scenario, the target temperature set point may be a function of a first plurality of baseline parameters, as shown in Equation 1:

$$T=f(L,S,PP) \tag{1}$$

where L is a geographical location of the building (a city, zip code, etc.), S corresponds with the meteorological season (e.g., spring, summer, fall, winter) or time of year, and PP is a personal preference. In another embodiment, the target temperature set point may depend on additional, fewer, and/or different baseline parameters. For example, the baseline parameters could include indoor humidity data from an indoor humidity sensor, rather than requiring building location and seasonal information to determine the indoor humidity. In another embodiment, the baseline parameters could include a combination of the building's location, seasonal information, and indoor sensor data. In yet another embodiment, the baseline parameters could include another parameter that affects the desired temperature set point (e.g., outdoor air quality from an outdoor sensor, etc.). In at least one embodiment, the baseline parameters could include consideration of a desired, calculated, and/or actual percentage of outdoor vent air that is directed into the building using an economizer (rather than or in combination with the location and seasonal information), as the humidity of air within the building will vary depending the quantity and humidity of this outdoor air. For example, the economizer may be configured to vent outdoor air based on the following control equations to reduce cooling requirements within the building:

$$T_{mix}=(T_{OA}\times(\%\ OA))+(T_{RA}\times(\%\ RA)) \tag{1-1}$$

where $T_{mix}$ is the dry bulb temperature of mixed air entering the building (returned/recirculated air mixed with vent air), % OA is the outside air flow rate (into the building) as a percentage of the total flow rate through the economizer, $T_{OA}$ is the temperature of the outdoor air, and $T_{RA}$ is the temperature of the return/recirculated air. The air quality controller 400 may also be configured to determine the humidity of the mixed air introduced into the building by the economizer, as follows:

$$x_{mix}=(Q_{OA}x_{OA}+Q_{RA}x_{R}A)/(Q_{OA}+Q_{RA}) \tag{1-2}$$

Where $x_{mix}$ is the specific humidity (humidity ratio) of the mixed air, $Q_{OA}$ is the volume of outdoor air (or mass of outdoor air) in the mixture, $Q_{RA}$ is the volume of return air (or mass of return air) in the mixture, $x_{OA}$ is the specific humidity (humidity ratio) of the outdoor air, and $x_{RA}$ is the specific humidity (humidity ratio) of the return/recirculated air. In some embodiments, the air quality controller 400 may also implement mixing ratio calculations to limit the amount of vent air from the outdoor environment in scenarios where the outdoor air humidity may result in excess condensation within the building, as follows:

$$W = 6.11\times 10^{\frac{7.5*TD}{237.7+TD}} \tag{1-3}$$

$$WS = 6.11\times 10^{\frac{7.5*TD}{237.7+T}} \tag{1-4}$$

-continued $$RH = \frac{W}{WS} \tag{1-5}$$

where W is the actual mixing ratio of the air, TD is the dew point in Celsius, T is the air temperature in Celsius, WS is the saturated mixing ratio, and RH is the relative humidity. The air quality controller 400 may be configured to adjust the target temperature set point from Equation (1) based on these parameters in real time to compensate for changes in the indoor air humidity that may result from operation of the economizer.

Returning to the example in Equation (1) above, the personal preference is a user-specified temperature that maximizes the user's feeling of comfort. In another embodiment, the personal preference is a predefined temperature set point based on "average" user comfort (e.g., empirical data, etc.). In some embodiments, and particularly in systems where the humidity and/or particulate levels are separately controlled, the controller may select a temperature set point that is equal to the predefined temperature set point without any other corrections (e.g., without corrections based on baseline parameters).

Some people generally prefer warmer temperatures in their homes and office spaces (e.g., 73°), while others may prefer colder temperatures (e.g., 68°). However, in most instances the actual temperature that a user "feels" will vary depending on other environmental parameters besides the controlled temperature. In the example above, the temperature that a user actually feels will vary based on outdoor environmental conditions (e.g., outdoor air humidity, etc.), because the outdoor air is being circulated through the home without controlled humidification of the vented air from the outdoor environment. In humid environments, maintaining a temperature set point in the building that is based solely on a user's preference may result in the user actually feeling warmer than the temperature would indicate. In contrast, circulating dry outdoor air throughout the building at the user's preferred temperature may cause the user to feel colder than the temperature would indicate.

In operation 508, the additional baseline parameters (e.g., location, season, etc.) are used to correct and/or scale the personal preference to determine the actual temperature set point that is needed to maximize user comfort.

Figure 10:
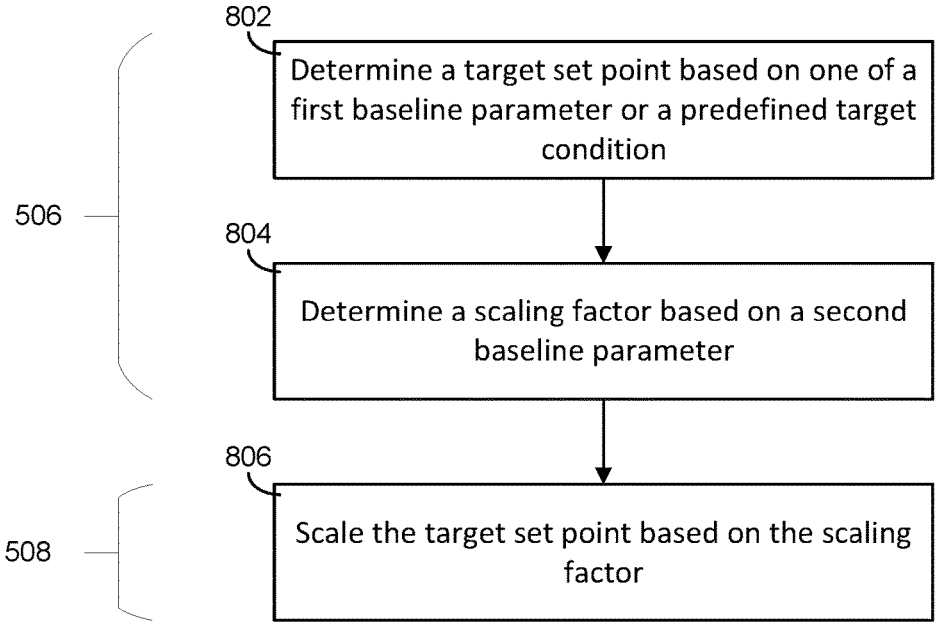
FIG. 10 is a flow diagram of a method of determining an environmental set point for the method of FIG. 5, according to an embodiment.

FIG. 10 shows a flow diagram of operations 506 and 508, according to an illustrative embodiment. At 802, the air quality controller 400 determines a target set point based on one of a first baseline parameter or a predefined target condition (e.g., a predefined target environmental set point as described above). At 804, the air quality controller 400 determines a scaling factor based on a second baseline parameter. In the temperature set point example outlined above, operation 804 includes determining separate scaling factors for the building's location and the meteorological season. In one embodiment, operation 804 may include accessing lookup tables that provide scaling factors as a function of the building's location and the season. In another embodiment, operation 804 may include calculating a single scaling factor based on a combination of baseline parameters using a predefined algorithm (e.g., an empirical algorithm based on average weather data).

At 806, the air quality controller 400 scales the target set point based on the scaling factor. For example, operation 806 may include multiplying the target set point by each individual scaling factor as shown in Equation (2) below:

$$T=PP*L_s*S_s \tag{2}$$

where $L_s$ is the scaling factor associated with the geographic location of the building, and $S_s$ is the scaling factor associated with the meteorological season.

A similar process may be used to evaluate other target/recommended environmental set points for the controller 400 to use in the baseline condition. For example, in a system that includes humidification/dehumidification equipment, method 500 may be used to determine a target humidity set point at the baseline condition as shown in Equation (3):

$$H=f(L,S,PP) \tag{3}$$

According to an illustrative embodiment (as shown in Equation (3)), the target humidity (e.g., relative humidity) set point is a function of similar baseline parameters as the target temperature set point above. For example, the personal preference for the humidity set point may be specified by the user (e.g., in operation 502). Alternatively or additionally, the personal preference may be a recommended humidity set point that is determined based on empirical data. For example, the recommended humidity set point may be determined from data that shows how variations in relative humidity impact a person's health. In particular, the personal preference may be determined by the air quality controller 400 to be within the optimum relative humidity range from the Sterling Chart (e.g., 30%, 35%, 40%, 45%, 50%, 55%, 60% or a range between and including any two of the foregoing values). For example, the recommended humidity set point may be determined to be within a preferred range of between 40% and 60% relative humidity, or as close to this range as possible depending on building construction and location. In some embodiments, the air quality controller 400 may be configured to determine the target humidity, in part, based on the indoor humidity at which water will begin to condense on windows and interior surfaces of the building (e.g., based on outdoor air temperature, and window and/or other structural properties, condensation resistance factors, etc.). In this way, the air quality controller 400 will attempt to keep the indoor air humidity as high as possible during winter months to improve occupant comfort, but without raising the humidity to levels where water will begin to collect on colder surfaces such as walls and windows. In another embodiment, the algorithms used by the controller to select the temperature set point and the humidity set point at baseline conditions may be interrelated.

Method 500 may also be used to determine a target ventilation set point at the baseline condition. The ventilation set point corresponds to the target ventilation air flow rate (e.g., CFM) that air is exchanged between the building and the outdoor environment. The ventilation set point may additionally relate to the ventilation frequency (e.g., how often the fan for the ventilation system is operated, in min/hr). According to an illustrative embodiment, the target ventilation set point depends on different baseline parameters than the temperature and humidity set points. One reason for this difference is that the ventilation performance is more sensitive to the particular IAQ equipment that is installed within the building. An example set of baseline parameters that may be used to calculated the target ventilation set point is shown in Equation (4) below:

$$V=V_{st}+f(OAQ,E,PH) \tag{4}$$

Where $V_{st}$ is a level of ventilation indicated by standards (e.g., a default value, an empirically derived value that is known to provide sufficient ventilation to reduce pollutant concentrations, etc.), OAQ is an outdoor air quality metric (e.g., outdoor particulate size and density, outdoor humidity, outdoor temperature, etc.), E is indicative of the type of IAQ equipment installed within the building, and PH is a health metric that is determined based on user-specified health and/or lifestyle information (e.g., respiratory issues such as asthma, chronic obstructive pulmonary disease (COPD), allergies, etc.). In another embodiment, the target ventilation set point may depend on additional, fewer, and/or different baseline parameters.

As shown in Equation (4), the target ventilation set point will vary based on the type of IAQ equipment installed within the building. The type of IAQ equipment may be specified by the user at startup, for example, by providing a model number associated with the IAQ equipment, the type of IAQ equipment (e.g., furnace, ventilation fan, etc.), and/or the operating capacities of the IAQ equipment. In one embodiment, the controller 400 is configured to automatically determine the type of IAQ equipment by operating the equipment and monitoring how the environmental conditions within the home change in response to the operation.

The target ventilation set point may vary depending on the type of air cleaner used to filter incoming ventilation air. According to an illustrative embodiment, the air quality controller 400 is configured to determine a recommended ventilation set point for "healthy" air based on known empirical formulas and/or manufacturer guidelines. The controller 400 is configured to correct the recommended ventilation set point based on outdoor conditions and/or user health considerations.

By way of example, operation 506 may include accessing lookup tables that include recommended values of ventilation flow for different filter types (e.g., different filter elements). The recommended vent flow rate and vent period (e.g., frequency) will be vary depending on the type of air filter that is installed within the building and the maximum recommended concentration of particulate matter within the building. For example, a filter having a 13 minimum efficiency reporting value (MERV) may allow for greater ventilation of fresh outdoor air through the building without exceeding the recommended concentration of particulate matter as compared to an 8 MERV filter or other reduced efficiency filters.

Operation 506 further includes determine weighting factors for each of the remaining baseline parameters (e.g., outdoor air quality (OAQ) and personal health (PH)). In particular, operation 506 may include using an algorithm to determine a weighting factor that reduces the target ventilation set point when detected levels of particulate matter (e.g., allergens, etc.) outside the building are high, or when the user has health conditions (e.g., respiratory conditions, COPD, smoking, asthma, allergies, etc.) that require cleaner air flow. Operation 508 may include scaling the target ventilation set point by the weighting factor(s).

Again referring to FIG. 5, the method 500 further includes controlling IAQ equipment based on the environmental condition and the environmental set point (operation 510). Operation 510 may include generating a control signal (e.g., via processor 412) to activate, deactivate, or otherwise control a piece of IAQ equipment and transmitting the control signal to the IAQ equipment (e.g., via communications interface 410). In another embodiment, operation 510 may include coordinating the operation of multiple pieces of IAQ equipment. Operation 510 may include monitoring the sensor data (e.g., environmental conditions) and adjusting the control signal to maintain the environmental conditions within a predefined range of the environmental set points.

The control strategy and functionality described with reference to FIGS. 5-7 and FIG. 10 has numerous advantageous. For example, the baseline conditions established by the air quality controller 400 ensure consistent (and healthy) air quality between different buildings, and in different locations and environments, without the need for independent calibration of the various pieces of IAQ equipment (separate controllers) by experienced technicians. Additionally, the control functionality provided by the air quality controller 400 improves overall user comfort at startup by tailoring the building IAQ to user-specific preferences.

Air Quality Metrics

According to an illustrative embodiment, the various baseline environmental set points may be combined to determine a building-specific (and user-specific) baseline IAQ metric (e.g., index, value, etc.) that is indicative of the baseline IAQ. Equation (5) shows an example relationship between the baseline IAQ ($IAQ_B$) metric and other example target environmental set points:

$$IAQ_B = f(T, H, V, P, \ldots) \quad (5)$$

where T is the target temperature set point, H is the target humidity set point, V is the target ventilation flow set point. In Equation (5) above, P is an environmental set point that cannot be controlled separately from the other parameters. For example, P may be a barometric pressure within the building, which is a function of vent flow into and out of the building. In this case, P is a characteristic of the combination of IAQ equipment used within the building. Even though P is uncontrolled (or indirectly controlled), it will have some impact on the baseline IAQ. In other embodiments, the baseline IAQ may be a function of additional, fewer, and/or different parameters. For example, the baseline IAQ may account for equipment capacities (e.g., heating/cooling/ventilation capacity) or other parameters. In at least one embodiment, the baseline IAQ may also account clean air metrics such as a clean air delivery rate (CADR), which is an amount of clean air being delivered into the building. By way of example, an air cleaning system (e.g., air cleaner) operating at 1000 cfm with 90% efficiency (e.g., 90% particle removal efficiency) will deliver 900 cfm of clean air into the home. The CADR may also account for clean air delivered into the building from multiple pieces of IAQ equipment. For example, a vent system being used to route 100 cfm of clean air into the building in addition to the air cleaning system will increase the total CADR to 1000 cfm. Similarly, a portable in the building that delivers 300 cfm of clean air will increase the total CADR to 1300 CADR, and so on.

In addition to the baseline IAQ metric, the air quality controller 400 may be configured to calculate an actual IAQ metric (e.g., a real-time IAQ metric, $IAQ_A$) that is representative of measured environmental conditions within the building, rather than environmental parameter set points. According to an illustrative embodiment, the actual IAQ metric is determined using the same formula as the baseline IAQ metric, but where each individual environmental parameter (e.g., T, H, V, P, etc.) is determined based on sensor data from sensors 402. Among other benefits, the actual IAQ metric may provide the user/occupant with an indication of how his/her actions are impacting IAQ. For example, in a scenario where the user changes a control parameter or setting, the actual IAQ metric will indicate the extent to which that change either harms or benefits them. The actual IAQ metric may also be used to alert the user to potential issues with the performance of IAQ equipment. For example, the actual IAQ metric may drop in response to poorly functioning equipment, or in scenarios where certain pieces of IAQ equipment go offline (e.g., become damaged). The actual IAQ metric may also provide the user with an indication that their system is in need of an upgrade. For example, in a situation where the home is equipped with poorly rated filter (e.g., <8 MERV, etc.), the controller 400 may be unable to raise the actual IAQ to the same level as the recommended baseline IAQ.

In at least one embodiment, the controller 400 is configured to determine an air quality index (AQI) that is indicative of how closely the actual air quality corresponds with certain ranges and/or values (e.g., recommended ranges and/or values based on empirical data, desirable ranges and/or values, etc.) of temperature, humidity, CO2 levels, and/or other building conditions. In some embodiments, the AQI indicates a difference between actual and baseline conditions (e.g., a difference between $IAQ_A$ and $IAQ_B$ as described above, etc.).

In one embodiment, the AQI is expressed as a categorical variable that is indicative of a category of air quality that encompasses a range of values for at least one building condition. For example, an AQI of "good" may indicate that measured CO2 levels in the building fall within a first range, an AQI of "unhealthy" may indicate that CO2 levels in the building fall within a second range that is above the first range (e.g., a range that has been found to result in poor occupant health), and an AQI of "moderate" may indicate that CO2 levels in the building fall within a third range that is in between the first and second ranges. In another embodiment, the AQI is expressed as a continuous variable (e.g., number, etc.) that corresponds with specific values of at least one building condition. For example, the AQI may be any value between 0 and 100 (e.g., an AQI of 100 may indicate that the measured temperature is the same as the baseline temperature, an AQI of 95 may indicate that the measured temperature is 0.5° F. off from the baseline temperature, and AQIs between 100 and 95 may indicate that deviations in temperature between 0° F. and 0.5° F., etc.). In some embodiments, the controller 400 is configured to determine a categorical variable of the AQI from the continuous variable (e.g., a categorical variable of "good" IAQ may correspond with a range of continuous variable values such as 95-100, etc.).

The AQI may include an appropriate constant value so that performance can be determined relative to a constant scale (e.g., 0 to 100, etc.). The AQI may be also include weighting factors for each environmental condition, depending on the relative importance of those conditions to maintaining healthy values of indoor air quality. For example, the AQI may be determined as follows:

$$AQI = AQI_0 - \left[W_T\frac{|T_a - T_b|}{T_b} + W_H\frac{|H_a - H_b|}{H_b} + W_{Vo}\frac{(Vo_a - Vo_b)}{Vo_b} + W_P\frac{(P_a - P_b)}{P_b} + W_{CO2}\frac{(CO2_a - CO2_b)}{CO2_b} + W_R\frac{(R_a - R_b)}{R_b} + W_{CO}\frac{(CO_a - CO_b)}{CO_b}\right] \quad (6\text{-}1)$$

or $$AQI = AQI_0 + \left[W_T\frac{|T_a - T_b|}{T_b} + W_H\frac{|H_a - H_b|}{H_b} + W_{Vo}\frac{(Vo_a - Vo_b)}{Vo_b} + W_P\frac{(P_a - P_b)}{P_b} + W_{CO2}\frac{(CO2_a - CO2_b)}{CO2_b} + W_R\frac{(R_a - R_b)}{R_b} + W_{CO}\frac{(CO_a - CO_b)}{CO_b}\right] \quad (6\text{-}2)$$

where $AQI_0$ is a constant value selected based on consumer preferences (e.g., 0, 1, 10, 100, etc.), T is the temperature, H is the humidity (e.g., dew point, etc.), Vo is an amount/level of volatile organic compounds, P is an amount/level of particulate matter, CO2 is an amount/level of carbon dioxide, CO is an amount/level of carbon monoxide, R is an amount/level of radon, W is a weighting factor for each parameter, subscript a refers to actual (e.g., measured) conditions, and subscript b refers to baseline conditions (e.g., as described above with respect to at least FIG. 5). Note that equation (6-1) is an example of an AQI in which larger values indicate improved performance (e.g., where $AQI_0$ is 100, larger numbers closer to 100 indicate better system performance), whereas equation (6-2) is an example of an AQI in which smaller values indicate improved performance (e.g., where $AQI_0$ is 0, smaller numbers closer to 0 indicate better system performance).

In other embodiments, Boolean operators (e.g., "if-than" conditions) may be used that eliminate one or more variables (e.g., temperature, humidity, etc.) if the difference between actual and baseline conditions is below a threshold amount or if the controller 400 does not detect the required sensors and/or monitoring equipment to determine real-time levels of certain parameters.

It should be appreciated that additional, fewer, and/or different parameters may be included in the AQI calculation. For example, Equations (6-1) and (6-2) may be generalized by separating parameters that directly relate to personal comfort from those that directly related to levels of pollutants (e.g., healthy air, etc.), as follows:

$$AQI = AQI_0 - \left[W_{CFI}CFI + \sum_1^N W_i\frac{(x_i - x_{i,0})}{x_{i,0}}\right] \quad (6\text{-}3)$$

and $$AQI = AQI_0 + \left[W_{CFI}CFI + \sum_1^N W_i\frac{(x_i - x_{i,0})}{x_{i,0}}\right] \quad (6\text{-}4)$$

where CFI corresponds to a (personalized) comfort index, $x_i$ is an amount and/or level of an ith pollutant, $x_{i,0}$ is a baseline or threshold pollutant level based on inputs to the controller 400, and $W_{CFI}$ and $W_i$ are weighting factors for comfort and various indoor pollutants, respectively. In at least one embodiment, the weighting factors determine the relative importance of each parameter comparison in determining the AQI metric, as shown in Equation (6-5) below:

$$W_{CFI} + \sum_1^N W_1 = 1 \quad (6\text{-}5)$$

As indicated above, the CFI represents a comfort index for the building space (e.g., representing deviations between environmental conditions in the building space that directly impact how an occupant "feels" within the building space such as too hot, too cold, sweaty, and/or a condition of the mind that expresses satisfaction with a surrounding environment, etc.). In at least one embodiment, the comfort index is a function of temperature and humidity as indicated in Equations (6-1) and (6-2) above, as follows:

$$CFI = W_T\frac{|T_a - T_b|}{T_b} + W_H\frac{|H_a - H_b|}{H_b} \quad (6\text{-}6)$$

In other embodiments, the comfort index may include additional, fewer, and/or different parameters. For example, the comfort index may also be a function of pressure levels within the building space, which can also affect occupant comfort. In this scenario, the comfort index $$CFI = W_T \frac{|T_a - T_b|}{T_b} + W_H \frac{|H_a - H_b|}{H_b} + W_B \frac{|B_a - B_b|}{B_b} \quad (6\text{-}7)$$

where B represents a barometric pressure within the building space. In other embodiments, the comfort index may be determined based on predicted sensations or balances felt by occupants of the building space. For example, the controller 400 may predictively determine a comfort index using a predicted mean value index (PMV) or a predicted percentage dissatisfied index (PPD) following ASHRAE/ISO standards (e.g., ISO 7730, ASHRAE 55, etc.), as shown in Equations (6-8) and (6-9).

$$CFI = PMV \quad (6\text{-}8)$$

$$CFI = PPD \quad (6\text{-}9)$$

where PMV predicts the average thermal sensation of a population or group by considering a variety of factors including environmental and/or personal factors that influence thermal comfort (e.g., metabolic rate and clothing insulation for an individual, simulated temperature and air velocity of a given environment, etc.). PPD further considers the predicted level of satisfaction of the occupants within the building space. Notably, these comfort indices vary depending on the building structure and where an occupant is located within the building space.

In at least one embodiment, the controller 400 is configured to personalize weighting factors for the AQI metric. For example, the controller 400 may include a human-machine interface that allows the users to manually input weighting factors for each parameter in the AQI calculation. In another embodiment, the controller 400 is configured to automatically determine a user's AQI (e.g., weighting factors, baseline AQI, etc.) based on sensor data, use history, and operation data. For example, the controller 400 may implement a machine learning algorithm (as described in further detail below) to determine how to control building equipment (HVAC equipment and non-HVAC equipment) to achieve desired levels of AQI. The controller 400 may also be configured to input user-defined preferences (e.g., control points, environmental settings, etc.) to the machine learning algorithm. The controller 400 may be configured to monitor these user-defined preferences over time to determine baseline values for the comfort index such as a baseline temperature, a baseline humidity, and/or others. At the same time, the control may receive and monitor building conditions such as environmental conditions and/or building arrangement conditions (e.g., from one or more sensors) that correspond (in time) with changes in user-defined preferences. The controller 400 is configured to input these user-defined preferences and building conditions as a training set into the machine learning algorithm, which evaluates trends in these conditions over time to determine values of the baseline parameters as a function of different building conditions.

The controller 400 may implement a similar approach to automatically determine weighting values for the AQI. For example, the controller 400 (e.g., the machine learning algorithm) may receive (e.g., via the training set) information that indicates how a user changes the user-defined parameters in response to changes in building humidity and/or temperature. For example, the controller 400 may receive a first request to reduce a temperature in a building space. The controller 400, in response to the first request, may activate an air conditioning unit to cool a space within the building. The controller 400 may continuously or semi-continuously monitor building conditions (e.g., a temperature of the building space, a humidity of the building space, etc.) until the measured temperature is the same as the user-defined temperature or is within a threshold range of the user-defined temperature. Operation of the air conditioning unit may also cause a reduction in the relative humidity within the building space. At a different time, the controller 400 (e.g., via the machine learning algorithm) may operate building equipment in a different manner to reduce temperature. For example, the controller 400, in response to a second request (which may be the same as the first request), may operate a vent fan to draw in cool outdoor air instead of operating the air conditioning unit. The controller 400 may again continuously or semi-continuously monitor building conditions until the measured temperature is the same as the user-defined temperature or is within a threshold range of the user-defined temperature. However, operation of vent fan instead of the air conditioning unit may cause higher humidity within the building space. Notwithstanding this, the controller 400 (e.g., the machine learning algorithm) may observe that no further changes in the user-defined temperature are requested for a second threshold period after operating in the vent fan. The controller 400 may observe that the second threshold period is similar to a first threshold period between changes in the user-defined temperature after operating the air conditioning unit. The controller 400, based on this data, may determine that the user is less sensitive to changes in humidity than temperature, and in response may increase the weighting factor associated with temperature. The controller 400 may continue this process iteratively to automatically determine appropriate weighting factors for AQI.

According to an illustrative embodiment, the controller 400 is also configured to perform diagnostic operations to identify the root cause of poor IAQ. For example, the controller 400 may be configured to compare each measured environmental condition with a respective one of the target environmental set points. In this way, the controller 400 can determine which of the target environmental set points is below or outside of target levels. Additionally, in some embodiments the controller 400 may be configured to determine a standard deviation of the measured environmental condition by comparing the measured environmental condition with similar conditions in different buildings (e.g., buildings within the same geographic area, etc.).

In at least one embodiment, the controller 400 is configured to utilize sensor data from at least one building arrangement sensor to determine actual IAQ and/or to identify the root cause of poor IAQ. For example, the controller 400 may be configured to receive data from a moisture sensor that is structured to determine an amount and/or presence of moisture on a window or exterior wall of the building. The controller 400, in response to an indication of moisture from the moisture sensor, may determine that the humidity within the building is too high for the temperature within the building space. In another example, the controller 400 may monitor window or door position sensors to identify exposure of the building space to the outdoor environment and/or to approximate an amount of vent flow entering the building space. Similarly, the controller can monitor door positions within the building to determine how tightly coupled adjacent rooms are (environmentally coupled in terms of temperature, humidity, pressure, etc.) within the building. The controller 400 can utilize this data to make algorithmic decisions about zoning (e.g., control of dampers and/or other actuators) and IAQ compensation (e.g., whether to activate a portable unit within the building space to compensate for increases in pollutants that could be associated with higher vent air flow).

Figure 11:
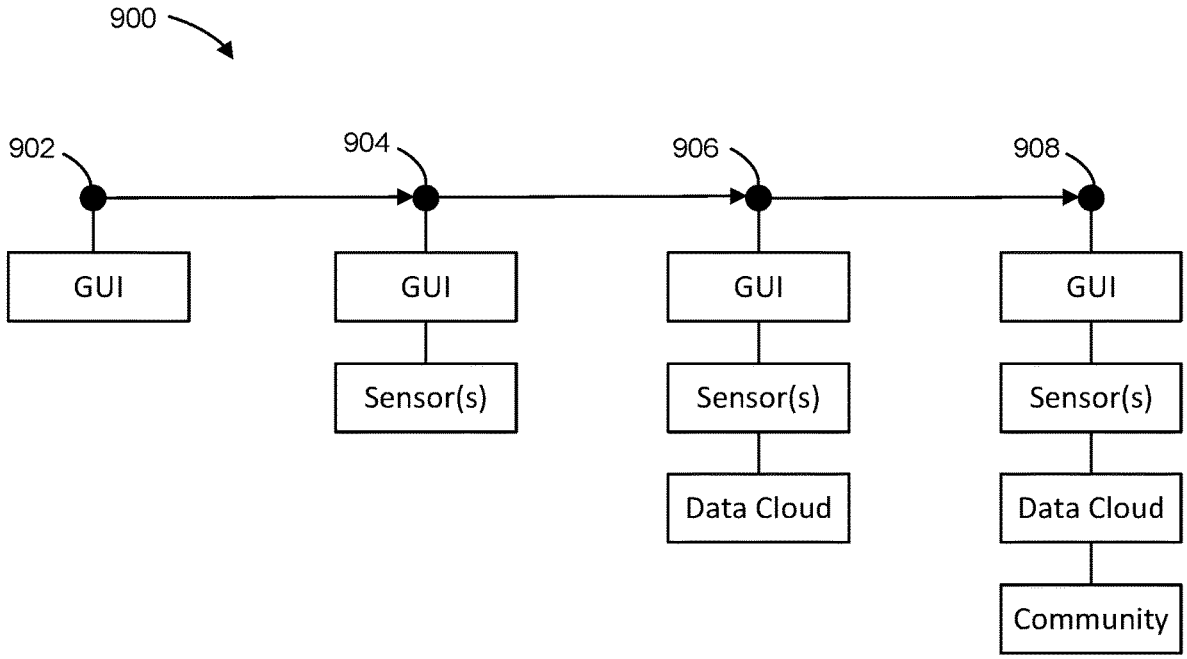
FIG. 11 is a roadmap of different control strategies for a whole building air quality control system, according to an embodiment.

According to an illustrative embodiment, the controller 400 is configured to periodically update the baseline IAQ to account for changes in any one of the baseline parameters. In particular, the controller 400 is configured to periodically update the baseline IAQ to continuously improve user comfort. Referring to FIG. 11, a roadmap 900 of four (4) different control strategies that may be implemented by the controller 400 is shown, according to an illustrative embodiment. As shown in FIG. 11, each successive control strategy, moving from left to right along the roadmap 900, includes an additional control factor (e.g., level of automation, etc.). The number and pairing of different control factors within each control strategy is provided for illustrative purposes only. It will be appreciated that various combinations and alterations are possible without departing from the inventive concepts disclosed herein.

As shown in FIG. 11, a first control strategy 902 of the roadmap 900 involves using a single control factor, the HMI (e.g., GUI, over air communication via voice commands, etc.), to periodically update the baseline IAQ (i.e., at least one environmental set point). In particular, the first control strategy 902 relies on a user's interaction with the HMI to provide the information needed for the update. According to an illustrative embodiment, after the initial baseline IAQ has been established, the HMI is configured to periodically query the user to solicit feedback regarding system operation. For example, in one embodiment the HMI may present the user with a questionnaire (including one or more questions or request form information) and prompt the user to take action. The questions may include, for example, "are you feeling overheated?," "how is your breathing today?," "are you feeling dry or humid?," "is the odor level in the house to high?," "are you sleeping well at night?," how is your energy bill?," and others. In another embodiment, the HMI may present the user with an image and/or pop-up. For example, a GUI may present the user with at least two images such as a first image showing a person shivering, and a second image showing a person sweating. The user may select the image that best corresponds with how they are currently feeling. The controller is configured to adapt the baseline IAQ based on the user inputs. In yet another embodiment, the images may be less descriptive, less literal, and/or more representational or symbolic; for example, the images may include a happy face and a sad face. In this scenario, the controller may be configured to adapt system performance in a semi-iterative fashion using a guess-and-check operation (e.g., by modifying an environmental set point by a predefined value and re-querying the user to determine if the change was helpful). The questionnaire and/or pop-up may be transmitted by the air quality controller (e.g., controller 400), for example, via e-mail, text message, push notification, a digital voice assistant (e.g., via a speaker), and/or microphone or other natural language processing components. In some embodiments, the controller 400 presents a questionnaire asking the user to rate a two or more conditions (e.g., a pair of conditions including a first condition and a second condition that is different from the first condition) against one another to determine a user's priority or preference. For example, the controller 400 may present a questionnaire to a user asking them to compare an option of (1) an "energy efficiency" that is indicative of how efficiently the system is operating; and (2) an "adjustment time" that is indicative of an amount of time the system takes to achieve a desired performance (e.g., a desired environmental condition after inputs are received from the user). The controller 400 may determine a priority of operation based on the user's response (e.g., to prioritize/authorize operation of less efficient components to improve reaction time or vice versa).

A second control strategy 904 of the roadmap 900 includes using real sensor data in combination with the user input. For example, the air quality control system may include a human-interface sensor configured to measure, for example, an occupants vital signs (e.g., heart rate, body temperature, blood pressure, etc.) in real time. The air quality controller 400 (FIG. 4) may be configured to adjust the baseline IAQ in real time based on the vital signs. For example, the controller 400 may be configured to determine, based on the vital signs, that the user/occupant's internal body temperature is above an average recommended value (e.g., 99° F. vs. 98.6° F. or some other medically recommended internal body temperature) and reduce the temperature set point to make the occupant feel more comfortable. The controller 400 may use a similar control strategy to adapt system operation to different occupant activities (e.g., exercise, etc.). Another example includes reducing the ventilation set point to reduce particulate matter in the air within the building and/or to increase fresh air flow if above average quantities of CO2 or another gas or VOC are detected within the home. Yet another example includes using occupancy data from an occupancy sensor to adaptively control baseline IAQ during different times of day (e.g., to adjust the baseline IAQ throughout the day based on occupancy habits). Yet another example includes using real time data from at least one outdoor environmental sensor to adaptively control baseline IAQ (e.g., reduce the ventilation set point in response to data that indicates above-average levels of particulate matter/pollen in the outdoor environment, etc.).

In yet other embodiments, the controller 400 is configured to use real-time data from a non-IAQ equipment sensor (e.g., a sensor that is not part of an IAQ control device or HVAC equipment, and/or is not configured to monitor IAQ parameters directly) to adapt and modify building conditions (IAQ). The controller 400 may be configured to receive data from any device that is communicably coupled to a local network for the building. For example, the controller 400 may be configured to receive data signals from a smart, connected exercise bike or treadmill that is communicably coupled to the local network. The controller 400 may identify the bike or treadmill via receipt of a unique identification or tag information (e.g., that is received from the bike or treadmill during a pairing process, etc.), and/or by pairing with the device over a local network having devices that comply with certain standards or matter protocol (e.g., the device may self-identify according to specific communication standards required for operation over the local network). The controller 400 may also receive location information that allows the controller 400 to map the bike or treadmill to an exercise space of the building in which the bike or treadmill is located. The controller 400 may receive data from the bike or treadmill indicating that a user is actively exercising within the exercise space and may benefit from an adjustment in temperature or air flow. The controller 400 may control dampers/actuators, and/or portable HVAC units, to cool the exercise space (e.g., based on the information mapping the bike or treadmill to the exercise space) without affecting conditions in other areas of the building. The controller 400 may also modify other building conditions in addition to temperature. For example, the controller 400 may activate fans or fresh air ventilation to exhaust CO2 from the exercise space (e.g., excess CO2 generated by the user while exercising).

A third control strategy 906 includes using artificial intelligence and machine learning to improve the performance of the whole building air quality control system. For example, the data cloud (e.g., the system cloud 156, 256, third-party cloud 158, 258, and/or supplier cloud of FIGS. 1 and 2, respectively) could be used to monitor a user's activities on the internet such as search terms that are entered by the user. The controller 400 can modify system operation based on this information. For example, the data cloud may determine that you are searching for health-related issues such as asthma and/or allergy reactions. In response to this information, the controller 400 may be configured to adjust the ventilation flow set point to reduce the ventilation rate of outdoor air to reduce an amount of particulate matter within the building.

The controller 400 may also include machine learning algorithms to improve its predictive capabilities. For example, the controller 400 may be configured to record historical trends of user activities and/or preferences to improve the way in which the environmental set points are modified (e.g., which parameter has the greatest impact on the user's comfort, the user's sensitivity to changes in each environmental set point, etc.).

In some embodiments, the controller 400 will implement computational algorithms such as multi-variate regression and others to identify the most critical features of the data inputs/sources that correlate to output measurements from the plurality of sensors to create a predictive model of system performance. The controller 400 may use a subset of recorded inputs and outputs as training data and a different subset of inputs and outputs to evaluate the effectiveness of the model. The controller 400, via the machine learning algorithm may then automatically tweak factors of the predictive system model and iteratively score the predictive power of the system to predict sensor outputs from the collection of system inputs and previous outputs. The controller 400 may use these automatically-tuned models (which predict IAQ control system behavior) as algorithmic instructions to control IAQ components and achieve the desired building conditions (e.g., IAQ environmental conditions, etc.). The controller 400 may be configured to continuously update using an ongoing collection of inputs and outputs to constantly refine the model and algorithmic control.

Figure 13:
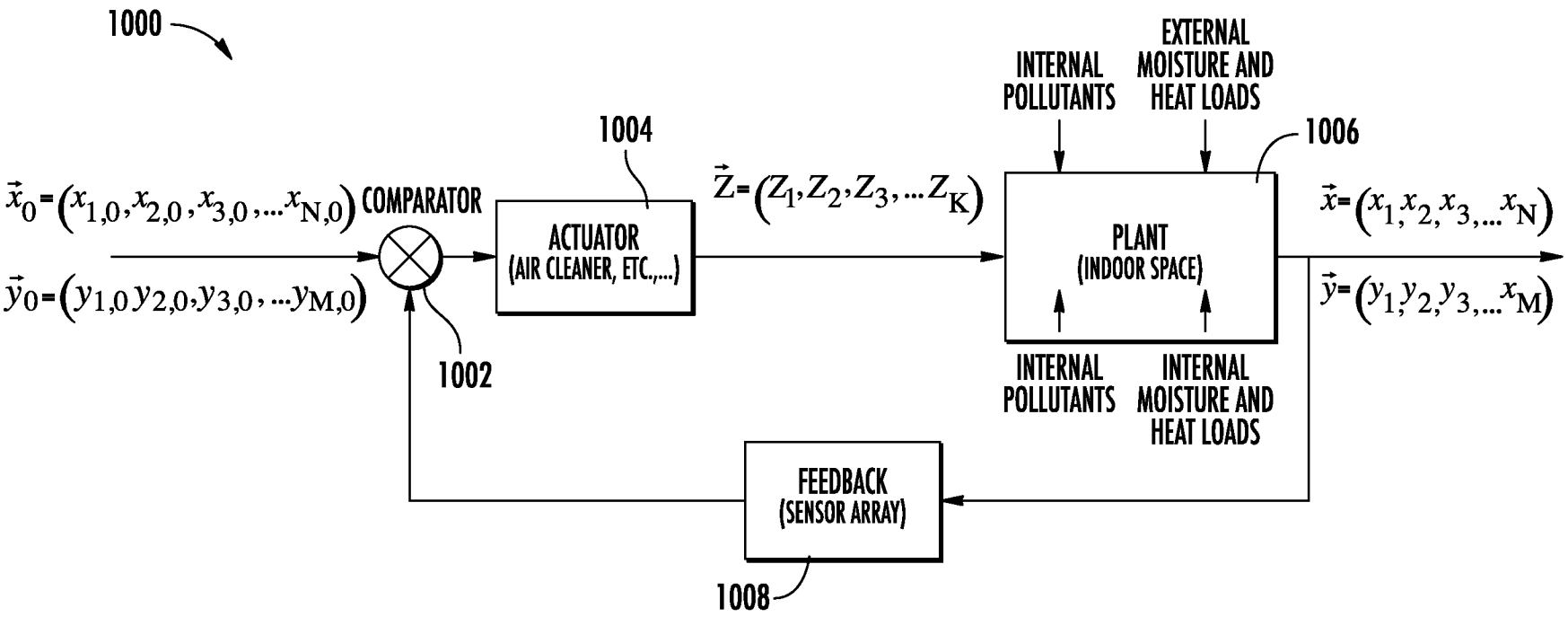
FIG. 13 is a block diagram of a multi-variable control architecture for a whole building air quality control system, according to an embodiment.

Referring to FIG. 13, a block diagram of a multi-variable control architecture for a whole building air quality control system 1000 is shown, according to an illustrative embodiment. In contrast to existing systems for building environmental control, the system 1000 of FIG. 13 may be configured to control IAQ within an indoor space (e.g., building space, room, floor, house, etc.) of a building based on a categorical variable that is different from a continuous parameter such as temperature, particulate matter level, and others. Beneficially, the categorical variable may account for multiple different environmental parameters to characterize performance at a macro level for the indoor space. The categorical variable may also be easier for a user to understand as compared to presenting raw data values or real-time environmental conditions measurements to the user (as the user may not understand what the raw data values mean and their impact on whole home IAQ).

As shown in FIG. 13, the system 1000 includes a comparator 1002, an actuator 1004, a plant 1006, and a feedback 1008. In other embodiments, the system 1000 may include additional, fewer, and/or different components. For example, in some embodiments, the building may consist of multiple plant blocks, with each plant block corresponding to a different indoor space within the building (e.g., a partitioned subspace within the building, such as a living room, basement, attic, etc.).

The system 1000 uses a machine learning algorithm to maintain the IAQ and user-comfort within the plant block 980 at desired levels. In one embodiment, the machine learning algorithm is, or includes, an artificial neural network (e.g., a simulated neural network, deep learning, etc.) that predicts outputs starting from a training set of data to form probability-weighted associations between inputs and the resulting outputs. In another embodiment, the machine learning algorithm is, or includes, another type or form of machine-learning (e.g., linear regression, logistic regression, etc.).

The system 1000 shown in FIG. 13 may be characterized by a set of vectors representing: (i) a plurality of building conditions of a building space, and (ii) the output and/or control state of the IAQ components within the system 1000 (e.g., within or adjacent to the building). The plurality of building conditions may include measurable inputs from at least one of the plurality of sensors within the system 1000. In at least one embodiment, the plurality of building conditions includes a state of indoor air quality (vector $\vec{x}$), and/or a state of indoor comfort (vector $\vec{y}$).

The state of IAQ ($\vec{x}$) may be indicative of an overall level of pollutants within the indoor space and may include a plurality of IAQ parameters that represent of an amount of specific types of pollutants within the indoor space. For example, IAQ parameters for the state of IAQ may include a PM1.0 particulate concentration (e.g., an amount or level of ultrafine particles within the indoor spacing having an aerodynamic diameter less than approximately 1 micrometer), a PM2.5 particulate concentration (e.g., an amount or level of fine particulate matter having an aerodynamic diameter less than approximately 2.5 micrometer), a CO2 concentration, a TVOC concentration, a formaldehyde concentration, a radon concentration, and/or another pollutant concentration within the indoor space.

The state of indoor comfort ($\vec{y}$) may be indicative of a level of personal comfort that an occupant experiences or feels within the indoor space and may include a plurality of IAQ parameters that represent user-perceptible environmental conditions. For example, IAQ parameters for the state of indoor comfort may include a dry bulb temperature, a humidity or dew point, a wet bulb temperature, an air velocity, an ambient air pressure, and/or another environmental condition within the indoor space.

It should be appreciated that in other embodiments, the plurality of building conditions may include additional, fewer, and/or different parameters. For example, the plurality of building conditions may include IAQ parameters representing inputs from non-IAQ sensors such as window sensors, condensation sensors, door position sensors, and the like. The plurality of building conditions may also include IAQ parameters representing (i) IAQ component capabilities as defined by their make, model, and/or specifications; (ii) user choices and operational preferences, (iii) outdoor environmental conditions outside of the building; (iv) operating conditions or measurements from smart appliances on a local network; (v) data from third-party data sources such as weather/levels of pollutants and allergens; (vi) records (e.g., historical records, etc.) of settings and sensors of the system 1000; and/or any other IAQ parameters described herein.

The output and/or control state ($\vec{z}$) may be indicative of control settings for IAQ components of the system 1000 that impact IAQ and may include a plurality of IAQ parameters that represent operational settings of the IAQ components (e.g., on or off states of the IAQ components, operating speeds, voltage and/or current supplied to the IAQ components, etc.). For example, IAQ parameters for the output and/or control state may include current and/or commanded operational settings for an air conditioning device, a heating device, a humidifying device, a dehumidifying device, an air filtration device, a VOC removal device, a radon removal device, a ventilating device, and/or other IAQ components.

Figure 14:
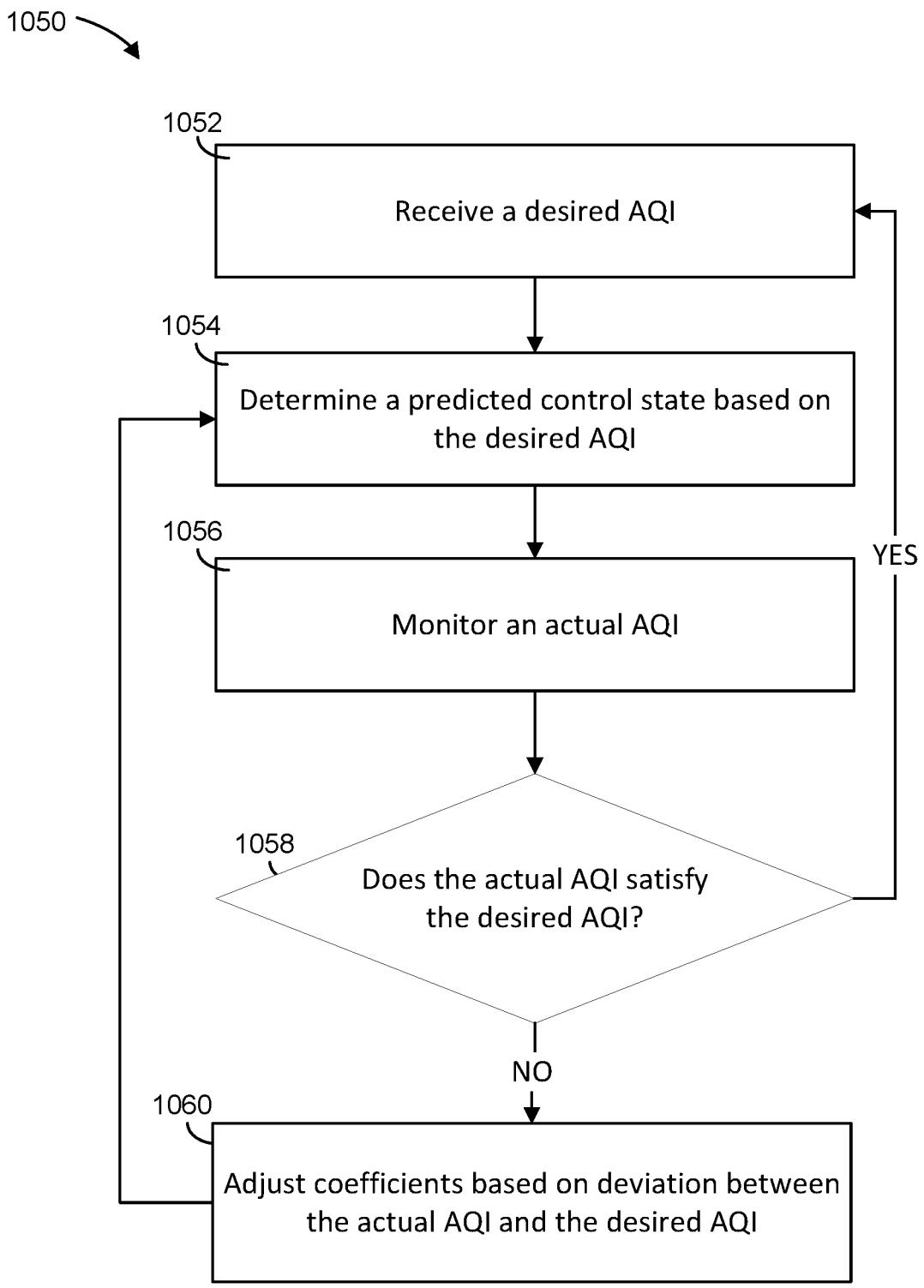
FIG. 14 is a flow diagram of a method of controlling IAQ equipment using an air quality controller, according to an embodiment.

Referring to FIG. 14, a method 1050 of controlling the system 1000 via the multi-variable control architecture of FIG. 13 is shown, according to an illustrative embodiment. The method 1050 may be implemented using the air quality controller 400 of FIG. 4, for example, through a software application installed on the controller 400. As such, reference will be made to the controller 400 when describing method 1050. The air quality controller 400 may form part of a local computing device (e.g., thermostat) or part of a cloud computing device (e.g., the system cloud, etc.) in some embodiments. It should be appreciated that the use of flow diagram and arrows is not meant to be limiting with respect to the order of flow operations. For example, in an illustrative embodiment, two or more of the operations of method 1050 may be performed simultaneously.

At operation 1052, the controller 400 receives a desired AQI, which may be the same as or similar to any one of the AQIs described above. For example, in one embodiment, the desired AQI is a categorical variable, or categorical AQI, that is indicative of a category of air quality that encompasses a range of values for at least one building condition. In such an embodiment, the desired AQI only changes when the at least one building condition is outside of the aforementioned range of values. In another embodiment, the desired AQI is a continuous numerical variable or parameter, or continuous AQI, that varies continuously with measured building conditions. In some embodiments, the controller 400 may be configured to determine a continuous AQI, and then calculate a categorical AQI based on the continuous AQI. As described above, the desired AQI may be a variable that is a function of multiple different building conditions.

Figures 15, 16:
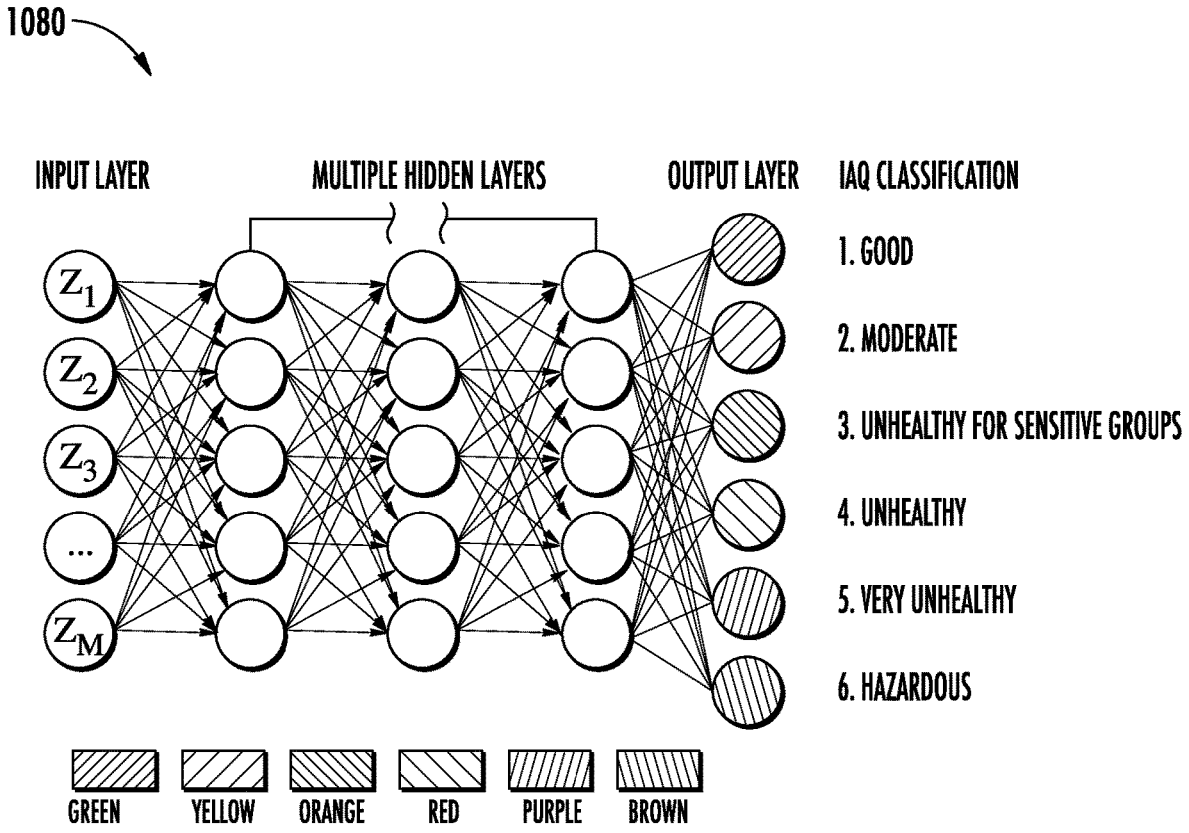
FIG. 15 is an air quality index (AQI) lookup table, according to an embodiment.
FIG. 16 is a schematic representation of an artificial neural network that may be implemented by a whole building air quality control system, according to an embodiment.

In embodiments in which the desired AQI used by the machine learning algorithm is a categorical variable, the value of the desired AQI corresponds with combinations of building conditions that lie within certain ranges (i.e., a categorical AQI that does not vary continuously with measured building conditions). For example, FIG. 15 shows an AQI lookup table 1070 for an embodiment in which the categorical variable includes six different values, which are listed along a first column of the table 1070. Each value of the categorical variable (e.g., "healthy", "moderate", etc.) corresponds with (i) a range of values of the continuous AQI, and (ii) a set of multiple building conditions that each fall within specific ranges. Stated differently, each value of the categorical variable corresponds with amounts and/or levels of a set of IAQ parameters that fall within particular IAQ parameter ranges. In some embodiments, the IAQ parameter ranges for each value of AQI are determined based on empirical data (e.g., lab testing, etc.) that characterizes potential health risks associated with high values of one or more IAQ parameters. In some embodiments, the controller 400 is configured to allow a user and/or service provider (e.g., the system cloud, etc.) to update IAQ parameter ranges in the AQI lookup table manually.

As shown in the AQI lookup table 1070 of FIG. 15, the categorical variable is indicative of a category of air quality that encompasses respective IAQ parameter ranges for each of a plurality of IAQ parameters. In some embodiments, each one of the plurality of IAQ parameters is indicative of an amount of a pollutant in the indoor space (e.g., as shown in FIG. 15). In other embodiments, the IAQ parameters may include other factors. For example, a first one of the plurality of IAQ parameters may be indicative of an amount of a pollutant within the indoor space and a second one of the plurality of IAQ parameters may be indicative of a level of comfort of an occupant within the building space (e.g., a CFI such as temperature, humidity, pressure, PMV, PPD, etc.). In yet other embodiments, the IAQ parameters may include parameters relating to energy consumption and/or efficiency of IAQ equipment, parameters relating to service life of IAQ equipment, building preservation, or any combination of these and those parameters listed above. As described above, in alternative embodiments, the desired AQI may be a continuous variable that varies continuously with the CFI and/or other parameters.

Operation 1052 may include retrieving the desired AQI from memory onboard the controller 400 (e.g., the desired AQI may default to at least the "moderate" value of the categorical AQI at startup). In other embodiments, operation 1052 includes receiving the desired AQI via the user interface (e.g., the desired AQI may be a user-specified input parameter, etc.). For example, operation 1052 may include presenting, via the HMI (e.g., a GUI, over-the-air communication, etc.), the plurality of categorical AQI values for user selection. In a scenario in which a GUI is used, the plurality of categorical AQI values may be presented as visually-perceptible text boxes 1072 as shown in FIG. 15. The text boxes 1072 may be labeled to indicate the relative health levels associated with each value of AQI. The text boxes 1072 may also be color coded (e.g., green for "good", yellow for "moderate", orange for "unhealthy for sensitive groups", red for "unhealthy", purple for "very unhealthy", and brown for "hazardous"). It should be appreciated that the labeling and/or color scheme may be different in other embodiments. A similar approach may be used when the desired AQI used by the machine learning algorithm is a continuous variable instead of a categorical variable. Among other benefits, using a categorical AQI improves user understanding of how changes may affect building IAQ (as opposed to a continuous AQI which would be presented to the user as a numerical value). In some embodiments, operation 1052 further includes determining a threshold value of the continuous AQI that corresponds with the categorical AQI (e.g., determining that any values of the continuous AQI that are less than 50 will be outside of the range of a "good" value of the categorical AQI in the AQI lookup table 1070 of FIG. 15).

At operation 1054, the controller 400 determines a predicted control state based on the desired AQI. According to an illustrative embodiment, operation 1054 includes determining a predicted control state based on the desired AQI via an artificial neural network (e.g., artificial neural net, deep learning algorithm, etc.). In some embodiments, operation 1054 include receiving a training set of data (e.g., processing example including a predefined input and result, etc.) and training the artificial neural network by determining the difference between a processed output of the artificial neural network (e.g., a predicted output, a predicted control state, etc.) and a target output from the training set. For example, operation 1054 may include receiving a training set of data from a system used in a neighboring building (e.g., a building located within the same area, having a similar layout, having similar IAQ components, etc.) and/or from a manufacturer or system cloud (e.g., a set of empirically determined control states that are known to produce certain values of AQI, etc.).

Operation 1054 may include using multi-variable regression techniques and/or other computational algorithms to adjust weighting parameters (e.g., coefficient values, etc.) based on a deviation (e.g., an error value) between the plurality of building conditions and the desired AQI to cause the artificial neural network to produce output which is increasingly similar to the target output.

FIG. 16 shows a schematic representation of the artificial neural network 1080 that may be implemented by the controller 400. The artificial neural network 1080 of FIG. 16 predicts outputs and/or control states (e.g., predicted control states) for the IAQ component(s) (e.g., vector i) based on desired values of a categorical variable (e.g., the desired AQI) instead of continuous parameters. Operation 1054 may include determining the relationship between the outputs and/or control states and the categorical variable using multinomial logistic regression, by determining multiple coefficient values in the following set of equations:

$$\ln\left(\frac{p_1}{p_2}\right) = b_{1,0} + b_{1,1}z_1 + b_{1,2}z_2 + \ldots + b_{1,K}z_K \quad (7\text{-}1)$$

$$\ln\left(\frac{p_3}{p_2}\right) = b_{3,0} + b_{3,1}z_1 + b_{3,2}z_2 + \ldots + b_{3,K}z_K \quad (7\text{-}2)$$

$$\ln\left(\frac{p_4}{p_2}\right) = b_{4,0} + b_{4,1}z_1 + b_{4,2}z_2 + \ldots + b_{4,K}z_K \quad (7\text{-}3)$$

$$\ln\left(\frac{p_5}{p_2}\right) = b_{5,0} + b_{5,1}z_1 + b_{5,2}z_2 + \ldots + b_{5,K}z_K \quad (7\text{-}4)$$

$$\ln\left(\frac{p_6}{p_2}\right) = b_{6,0} + b_{6,1}z_1 + b_{6,2}z_2 + \ldots + b_{6,K}z_K \quad (7\text{-}5)$$

$$p_1 + p_2 + p_3 + p_4 + p_3 + p_4 = 1 \quad (7\text{-}6)$$

in which $p_1$ through $p_6$ represent the probability associated with specific values of the AQI (e.g., $p_1$ is the probability of the AQI being "good", $p_2$ is the probability associated with the AQI being "moderate", etc.), and the coefficients $b_{i,j}$'s are determined iteratively in real time by the algorithm. This set of equations for the artificial neural network has been found to be well-suited to machine learning based on categorical variables. However, it should be appreciated that multinomial logistic regression can also be used in embodiments in which the desired AQI is a continuous variable. Embodiments of the machine learning algorithm described herein should not be considered limiting. In other embodiments, another form of machine learning algorithm can be used to effectuate IAQ component control using a desired AQI (and/or qualitative parameter as described in further detail herein).

Operations 1056-1060 describe the method of iteratively updating the coefficient values in the multi-variable regression algorithm. At operation 1056, the controller 400 monitors the actual AQI resulting from the predicted output and/or control state. Operation 1056 may include receiving, via the communication interface, real-time measured and/or derived building conditions from the sensors within or adjacent to the indoor space. Operation 1056 may include calculating the actual AQI from the building conditions received and/or derived from sensor data. Operation 1056 may include accessing an AQI lookup table (e.g., AQI lookup table 1070 of FIG. 15). In other embodiments, operation 1056 may include transmitting the building conditions off-site to the system cloud in exchange for corresponding values of the actual AQI (e.g., the system cloud may use a shared AQI lookup table or algorithm to determine the actual AQI across multiple buildings). In some embodiments, operation 1056 includes calculating a real-time value of the continuous AQI based on one of Equations (6-1)-(6-4) above and determining a real-time value of the categorical AQI that corresponds with the real-time value of the continuous AQI (e.g., using the AQI lookup table 1070 of FIG. 15, etc.).

At operation 1058, the controller 400 determines whether the actual AQI satisfies the desired AQI. The controller 400 may compare the actual AQI with the desired AQI. In the event that the actual AQI matches the desired AQI the calculation ends and the method returns to 1052 to query the user interface for additional input and/or changes to the desired AQI. In the event that the actual AQI is different from the desired AQI, the method proceeds to operation 1060. At operation 1060, the controller 400 adjusts the predicted control state based on a deviation between the actual AQI and the desired AQI. Operation 1060 may include adjusting coefficient values in the machine learning algorithm if at least one building condition of the plurality of building conditions does not satisfy an IAQ parameter range of a respective one of the IAQ parameters. In some embodiments, operation 1060 may include adjusting coefficient values based on a deviation between the at least one building condition and the IAQ parameter range. After updating the coefficient values, the controller 400 returns to operation 1054 to repeat operations 1054 through 1058. This process repeats itself, iteratively modifying the coefficient values until the actual AQI matches the desired AQI at operation 1058.

Among other benefits, the machine learning algorithm implemented by the controller 400 is never static and continuously updates to accommodate changes in building conditions (e.g., changes in building arrangements such as the opening of windows or doors in the summertime, occupant activities such as cooking and exercising, changes in the environment outside of the building, etc.). Additionally, the machine learning algorithm may identify trends in building arrangements and/or occupant activities over time. For example, the machine learning algorithm may observe, over time, that a user prepares food at a similar time each day. Based on this information, the machine learning algorithm may be able to predict when the user will begin using kitchen appliances and take action proactively (e.g., before cooking begins) to mitigate potential reduction in IAQ. For example, the machine learning algorithm may predict that the user will begin operating a stove or air fryer at 6 PM and may activate a range fan in advance (e.g., at 5:30 PM) to prevent spikes in VOC within the indoor space. In another example, the machine learning algorithm may be configured to predict, based on historical data, when the user will take a shower and may pre-emptively activate a vent fan in the bathroom to mitigate moisture accumulation on bathroom walls. In yet another example, the machine learning algorithm may be configured to predict changes in conditions outside of the building (e.g., changes in weather, etc.) based on recorded trends in sensor data and/or based on information from third parties and/or the system cloud. The machine learning algorithm, in response to the weather prediction, may be configured to adjust IAQ component operation to compensate for potential changes in humidity as a result of the weather prediction (e.g., by activating an air conditioning unit within the building to remove moisture from the air, etc.). The machine learning algorithm may also be configured to predict when user activities will end, in a similar manner, to deactivate fans after the activity is complete and IAQ has returned to desired levels.

Referring again to FIG. 11, a fourth control strategy 908 includes using information regarding other user's preferences and control system configurations to improve the baseline IAQ. For example, the data cloud may be configured to monitor the environmental set points used in neighboring devices and to make recommendations and/or changes based on what others are doing in the community. For instance, the controller 400 may change the ventilation set point to match those used in a neighboring building, rather than relying solely on weather data and IAQ equipment information. Among other benefits, the control strategies described above eliminate the need for users to manually select the environmental set points for the air quality system. Additionally, these control techniques reduce user errors by leveraging multiple data sources and industry control strategies that may not be familiar to the user/occupant.

Referring to FIG. 12, another roadmap 950 of five (5) different control strategies that may be implemented by the controller 400 is shown, according to an embodiment. The roadmap 950 is similar to the roadmap 900 described with reference to FIG. 11, but includes additional details regarding how the functionality of the controller 400 may evolve and change based on the types of available sensors (sensors & calculations row 952), historical data, and controls approaches (AQI assessment row 954 and intelligence row 956). The AQI deliverable row 958 indicates the improvement in controller capabilities as the system evolves (e.g., as more sensors are integrated into the system and as advanced algorithms are incorporated into controller logic).

User Interaction with the Whole Building Air Quality Control System

According to an illustrative embodiment, the controller 400 (see FIG. 4) allows the user to control the IAQ equipment based on qualitative parameters, rather than traditional, user-specified environmental set points. The controller 400 uses the qualitative parameters to determine a set of control points for the IAQ equipment (e.g., upper and lower thresholds and/or tolerance bands for environmental set points, relative duty cycles for different pieces of IAQ equipment, etc.). The qualitative parameters (e.g., parameters, options, indices, etc.) are not the same as traditional environmental set points such as temperature, humidity, air flow rate, particulate size and density, etc. In other words, the qualitative parameters are not measurable environmental parameters. Rather, the qualitative parameters relate to the effects associated with different macro scale control paradigms for the whole building air quality control system. For example, in one embodiment, the qualitative parameter is a comfort metric that is indicative of how the regulation of environmental conditions within the building makes the occupant "feel" (e.g., a state of physical ease, etc.). In another embodiment, the qualitative parameter is an energy metric that is indicative of an energy efficiency of the whole building air quality control system. The energy metric may relate to the type of IAQ equipment being used, the required duty cycle of the equipment (e.g., how often the equipment is running during a predefined time period), and the operational condition of the equipment. For example, the energy metric may change as particulate filters become more restrictive, or based on the operating speed of the air driver (e.g., the flow rate through the system) for a system of fixed sized.

In another embodiment, the qualitative parameter is a health metric that is indicative of how well the system is adjusted to suit the health of its occupants. The health conditions may be specific to a single occupant. For example, the health conditions may include a specific medical condition such as asthma, seasonal allergies, COPD, heart conditions, and other maladies. Additionally, the health conditions may be related to needs of all the occupants of the building. For example, in a scenario where the system is installed in a retirement home, the health condition may be related to the average age of the occupants (e.g., temperature sensitivity, etc.). By changing the desired health metric, a user can tailor the control points used by the controller to suit the specific health needs of its occupants.

In another embodiment, the qualitative parameter is a building preservation metric that is indicative of how well the environmental conditions support the building structure and the preservation of materials within the building. For example, many materials are susceptible to water damage in environments with high humidity. In contrast, wood flooring and other materials may crack if the humidity levels drop below certain thresholds. Additionally, the introduction of particulate matter into the building from the outdoor environment can result in the accumulation of dust on the upper surfaces of materials within the building, and areas of the building structure (e.g., floors, trim, etc.). Additionally, the building and the materials inside of the building may also be susceptible to damage over time due to temperature fluctuations (e.g., adhesive materials, seals, etc.). In yet other embodiments, the building preservation metric may be indicative of a balance between different environmental conditions within the building or building space. For example, the building may include a wine cellar, humidor (e.g., cigar humidor, etc.), clean room, negative pressure room (e.g., a quarantine room in a hospital, etc.), and/or another space requiring a balancing of certain environmental conditions. In a scenario in which the building includes a wine cellar, the building preservation metric may be indicative of how well temperature and humidity are maintained within desired levels over time (e.g., a level of temperature or humidity fluctuations over time, or a standard deviation of temperature and humidity over a monitoring period from desired levels such as 55° F. and 65% relative humidity).

In another embodiment, the qualitative parameter is a system preservation metric that is indicative of how well the environmental conditions support prolonged operation of the IAQ equipment (e.g., extended service life). In one aspect, the system preservation metric relates to the duty cycle of the IAQ equipment (e.g., how often the IAQ equipment is operated throughout the day, etc.). As such, the system preservation metric will be lower in configurations where the ventilation flow rates and/or duty cycle of IAQ equipment is high. In these scenarios, the service filters and/or IAQ equipment will experience reduced service life. In contrast, by increasing the system preservation metric, the controller 400 (FIG. 4) will adjust control points used by the controller to back off on the rates of IAQ equipment operation (e.g., back off on air cleaning to preserve filter, etc.) such that the user/occupant can expect extended durations between maintenance events.

In yet another embodiment, the qualitative parameter is a community metric that is indicative of how similar the environmental conditions are to those of other neighboring buildings. This metric allows the user to leverage the setup and configuration that has been established in other systems, which may have very similar needs. For example, increasing the qualitative parameter may proportionally scale the allowable tolerance range of at least one environmental set point to be closer to those used in the community or region in which the building is located. In other embodiments, the system may include additional, fewer, and/or different qualitative parameters.

Figure 17:
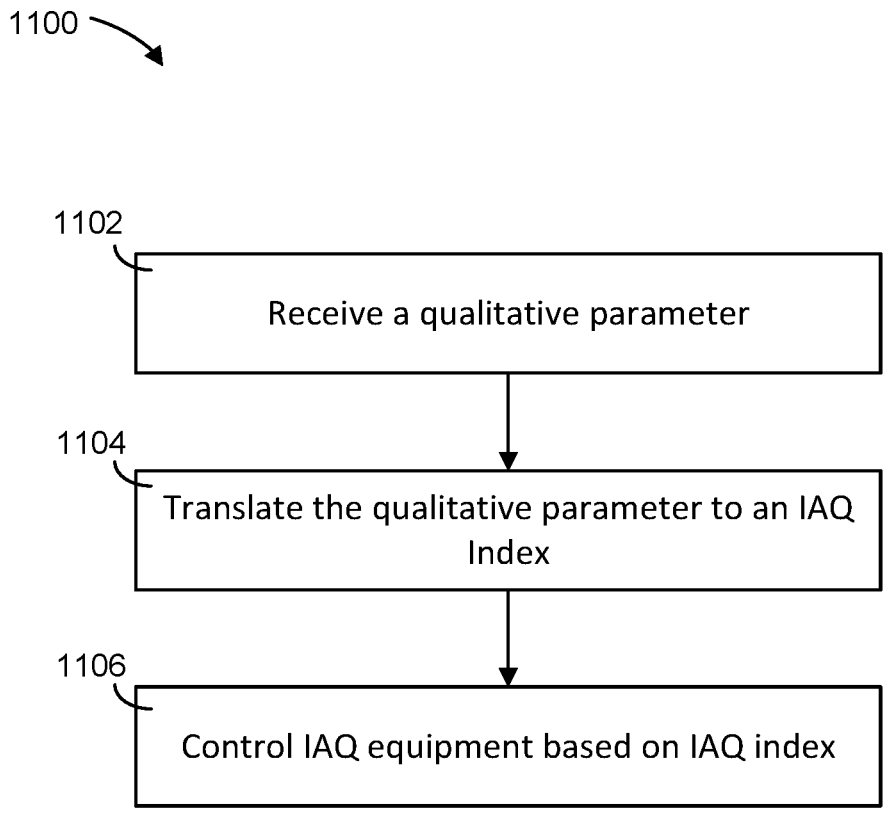
FIG. 17 is a flow diagram of a method of controlling IAQ equipment using an air quality controller, according to another embodiment.

Referring now to FIG. 17, a flow diagram of a method 1100 of controlling IAQ equipment utilizing one or more qualitative parameter inputs is shown, according to an illustrative embodiment. Similar to the method 500 described with reference to FIG. 5, the method 1100 of FIG. 17 may be implemented using the air quality controller 400 of FIG. 4, for example, through a software application of the air quality controller 400. As such, reference will be made to the air quality controller 400 when describing method 500. In another embodiment, the method 1100 may be implemented through the cloud (e.g., the system cloud 156 of FIG. 1, etc.) such that the control and processing components of the system can be located remotely and/or users can adjust the qualitative parameter(s) remotely using, for example, a mobile phone, a laptop computer, a tablet, or another type of remote computing device. In another embodiment, the method 1100 may include additional, fewer, and/or different operations.

At 1102, the controller 400 receives a qualitative parameter (e.g., subjective input). Operation 1102 may include receiving a value of the qualitative parameter from the HMI (e.g., HMI 260 of FIG. 2), based on user inputs, as will be described with reference to FIGS. 20-24. At operation 1104, the controller translates the qualitative parameter to an IAQ index. Operation 1104 may include, for example, retrieving a predefined algorithm from memory (e.g., memory 406 of FIG. 4) that relates the qualitative parameter value to the IAQ index. Operation 1004 may further include evaluating the IAQ index using the algorithm. In another embodiment, operation 1104 includes retrieving a lookup table from memory that includes a list of IAQ indices as a function of different values of the qualitative parameter. For example, in the case where energy efficiency is used as a qualitative parameter, the controller may be configured to operate the fan for a reduced amount of time, and/or only under certain conditions to increase energy savings. For example, the air controller 400 may be configured to determine the maximum allowable airflow over a period of time to achieve a desired energy consumption using ideal and/or empirically derived relationships for fan power as a function of pressure drop and flow rate, using reference tables and/or calculations as shown in Equation (8) below:

$$P_i = dp * q \tag{8}$$

where $P_i$ represents ideal power consumption for a fan (without losses), dp represents the pressure rise across the fan, and q represents the air flow volume delivered by the fan.

At 1106, the controller 400 operates the IAQ equipment based on the IAQ index. Operation 1106 may include transmitting control points (e.g., upper and lower thresholds for environmental set points, relative duty cycles between multiple pieces of IAQ equipment, etc.) to individual user control devices (e.g., a thermostat, a humidistat, etc.). Alternatively, or in combination, operation 1106 may include generating individual control signals for each piece of IAQ equipment (e.g., controlling at least one piece of IAQ equipment directly). The controller 400 may adjust operation of the IAQ equipment individually or in a predefined sequence until the actual IAQ metric is approximately equal to the IAQ index. For example, in a scenario where a user desires to increase energy efficiency, the air controller 400 may be configured to selectively control the IAQ equipment based on occupancy information and/or time of day to reduce overall energy consumption. For example, the air controller 400 may selectively control operation of a portable installed in a bedroom of the building during nighttime hours rather than activating a whole home HVAC system. In some embodiments, the air controller 400 may be configured to "learn" methods for controlling IAQ equipment throughout the home to achieve certain values of the IAQ index.

Figure 18:
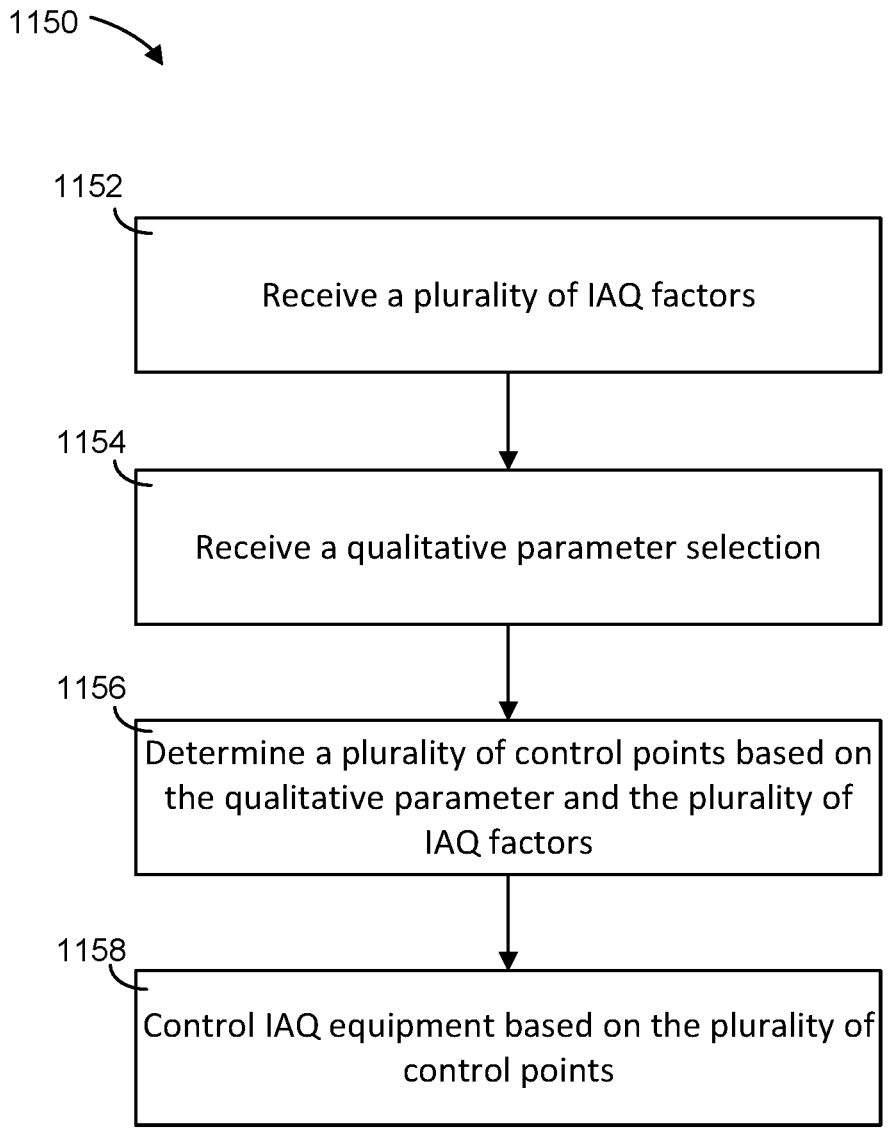
FIG. 18 is a flow diagram of a method of controlling IAQ equipment using an air quality controller, according to yet another embodiment.

Referring now to FIG. 18, a flow diagram of a method 1150 of controlling the IAQ equipment by changing a qualitative parameter is shown, according to another illustrative embodiment. Similar to the method 500 described with reference to FIG. 5, the method 1150 of FIG. 18 may be implemented using the air quality controller 400 of FIG. 4, for example, through a software application installed on the air quality controller 400. As such, reference will be made to the air quality controller 400 when describing method 500. In another embodiment, the method 1150 may be implemented through the cloud (e.g., the system cloud 156 of FIG. 1, etc.) such that the "brains" of the system can be located remotely and/or users can adjust the qualitative parameter(s) remotely using, for example, a mobile phone, a laptop computer, a tablet, or another type of remote computing device. In another embodiment, the method 1150 may include additional, fewer, and/or different operations.

At 1152, the controller 400 receives a plurality of IAQ factors. In one embodiment, the IAQ factors are multiple sets of scaling factors (e.g., weighting factors, etc.), where each individual set of scaling factors is associated with a single value of one qualitative parameter. Additionally, each scaling factor of an individual set of scaling factors is associated with a respective one of the environmental parameters. For example, a first scaling factor of the set of scaling factors may be associated with a temperature set point. A second scaling factor of the set of scaling factors may be associated with a humidity set point. In particular, the first and second scaling factors may relate to an allowable tolerance for the temperature set point and the humidity set point, respectively. In other words, the first and second scaling factors may relate to a maximum allowable deviation of the temperature and the humidity from predetermined set points (e.g., +/−2° F., +/−5° F., +/−5% RH, etc.).

In another embodiment, at least one scaling factor of a given set of scaling factors is associated with a preferred cooperative operating arrangement between different pieces of IAQ equipment. For example, a third scaling factor of the set of scaling factors may be associated with the proportion of time that an air conditioning unit is used to control the temperature of the building as opposed to a dehumidifier, and/or as opposed to increasing a flow rate of ventilation air from the outdoor environment (e.g., increasing the flow of fresh/cool air throughout the building). This type of scaling factor is particularly useful in the context of the energy metric. For example, in a situation where the energy metric is increased (i.e., the desired energy efficiency of the system is increased), the controller may cause the air conditioner to operate less frequently to cool the building, and to instead rely on the ventilation air from the outdoor environment to maintain the environmental set points within the allowable ranges.

Figures 19, 20:
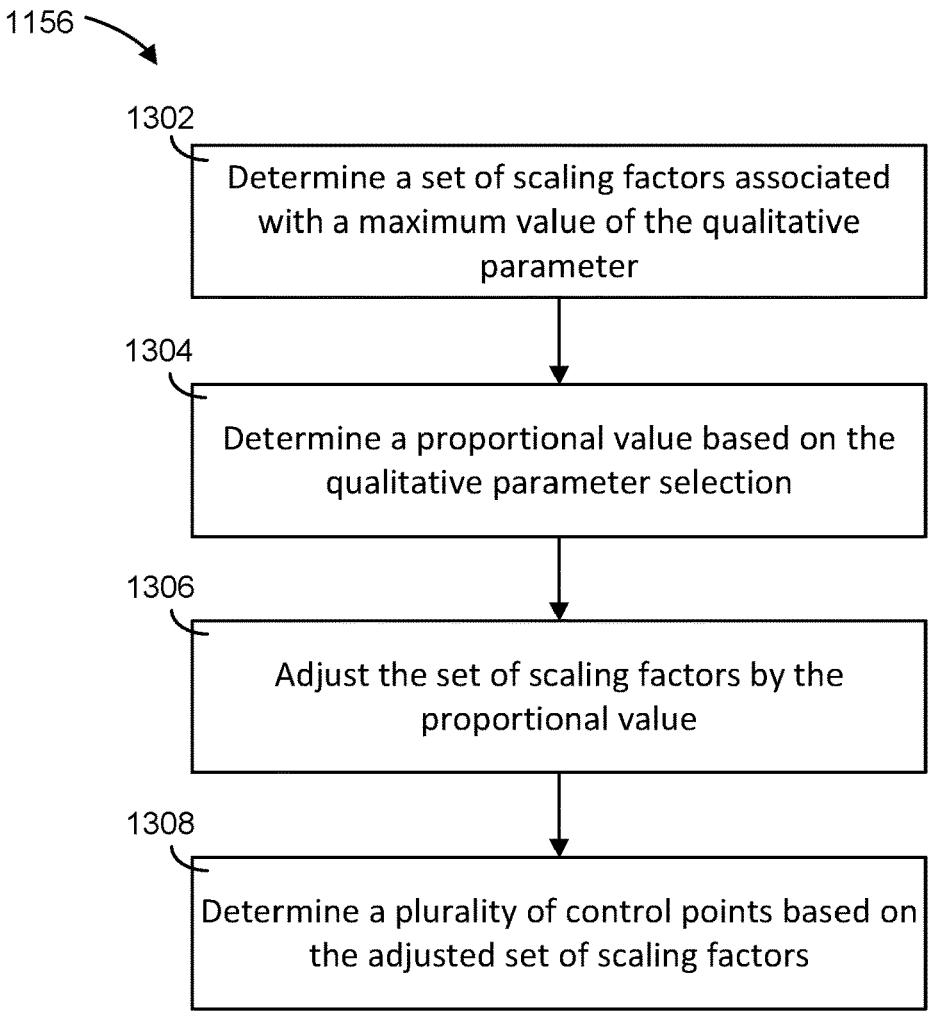
FIG. 19 is a table of scaling factors for an air quality controller, according to an embodiment.
FIG. 20 is a flow diagram of a method of determining control points for IAQ equipment based on a qualitative parameter, according to an embodiment.

In one embodiment, the controller 400 is configured to control the operation of the IAQ equipment based on multiple qualitative parameters simultaneously. FIG. 19 shows a table 1200 that details the IAQ factors that may be used for two different qualitative parameters. A first set of scaling factors 1202 is associated with the comfort metric and a second set of scaling factors 1204 is associated with the energy metric. In particular, values for each scaling factor are shown at a maximum range of the comfort metric and the energy metric. It will be appreciated that the values of each scaling factor shown in FIG. 19 are provided for illustrative purposes only and that the actual value of each scaling factor used by the control algorithm (e.g., stored in controller memory) may be different in other embodiments.

Returning to FIG. 18, the method 1150 additionally includes receiving a qualitative parameter selection (operation 1154). Operation 1154 may include receiving a value of the qualitative parameter from the HMI (e.g., HMI 260 of FIG. 2, etc.), based on user inputs, as will be described with reference to FIGS. 20-24. At operation 1156, the controller 400 determines a plurality of control points based on the qualitative parameters and the IAQ factors. In one embodiment, the control points are thresholds above and/or below each environmental set point. For example, with respect to temperature, the control points may be an allowable operating threshold of +/−2° F., +/−5° F., or another suitable threshold. With respect to the parameter labeled A/C in FIG. 19, the control points may relate to duty cycle for the air conditioning system and/or another piece of IAQ equipment.

Referring now to FIG. 20, a flow diagram of operation 1156 is shown, according to an example illustrative embodiment. In other embodiments, operation 1156 may include additional, fewer, and/or different operations. At 1302, the controller 400 determines a set of scaling factors that is associated with a maximum value of the qualitative parameter (e.g., a set of scaling factors that is used if the user selects a maximum value of the qualitative parameter). Operation 1302 may include retrieving a set of scaling factors stored in memory (e.g., memory 406 of FIG. 4). For example, the controller 400 may be configured to access lookup tables that include each qualitative parameter and sets of scaling factors that correspond with the maximum values of each qualitative parameter. In the table shown in FIG. 19, an example set of scaling factors is shown that corresponds with the maximum value of comfort (column 1202) and the maximum value of energy (column 1204). The range of the scaling factor used to adjust control points related to temperature is between 0 and 5, where 0 corresponds to a upper and lower temperature threshold of +/−0° F., and 5 is the maximum multiplier for the upper and lower temperature thresholds used at baseline conditions (e.g., +/−5° F. if the baseline control point is +/−1° F.). A similar range of scaling factors is used to adjust the control points related to humidity. The range of the scaling factors used to adjust the relative duty cycles of the air conditioning and ventilation system (A/C) is between 0 and 1, where 0 indicates that the full load is carried by the ventilation fan/system and 1 indicates that an air conditioning unit carries the full load. In this example, a control point of 0.5 for A/C means that the load is shared equally between an air conditioning unit and a ventilation fan (e.g., the air conditioning unit and the ventilation fan are controlled so that they have approximately the same duty cycle to maintain the environmental set point(s)). Similarly, scaling factors may be provided for different IAQ equipment that control the duty cycle of the equipment as a function of an amount of deviation from set point values. For example, in a scenario where the humidifier is capable of variable capacity/modulating operation, the humidifier could be controlled to increase capacity with the deviation from set point humidity levels (e.g., a reference table could be used scale capacity from low to high based on the measured deviation from set point values). In this scenario, a scaling factor could be used to scale back operation of the humidifier (e.g., limit the maximum operating capacity even at large deviations in relative humidity to save energy, etc.). The lookup tables may be saved into memory by a manufacturer and/or industry expert, and may be updated periodically by the system cloud. In some embodiments, the scaling factors may be provided by the manufacturer of each piece of IAQ equipment (e.g., via at least one supplier cloud). In another embodiment, an algorithm (e.g., an empirical algorithm) is used to determine each set of scaling factors.

At 1304, the controller 400 determines a proportional value of the scaling factors based on the qualitative parameter selection. Operation 1304 may include, for example, determining a percentage of the maximum value of the qualitative metric that is selected by a user/occupant. In an alternative embodiment, operation 1304 includes accessing a lookup table that includes proportional values as a function of different values and combinations of qualitative parameters.

At 1306, the controller 400 scales a set of the plurality of IAQ factors by the proportional value. Operation 1306 may include multiplying the proportional value and a difference between (i) each scaling factor shown in FIG. 19; and (ii) the scaling factors used in the baseline IAQ using linear interpolation as shown in Equation (9) below:

$$SF_Q=(T_B-T_Q)C+T_Q \tag{9}$$

where $SF_Q$ is the adjusted scaling factor, $T_B$ is the value of the scaling factor at baseline IAQ (e.g., 1), $T_Q$ is the value of the scaling factor that corresponds to the maximum value of the qualitative parameter, and C is the proportional value.

At 1308, the controller 400 determines a plurality of control points based on the adjusted set of scaling factors. Operation 1308 may include multiplying each control point based on a respective one of the adjusted set of scaling factors. For example, with respect to temperature, and in a configuration where maximum comfort has been selected, operation 1308 may include multiplying the relevant adjusted scaling factor (0.5 in FIG. 19) by the control point used for the baseline IAQ (e.g., (+/−2° F.)*(0.5)=(+/−1° F.)).

Returning to FIG. 18, the method 1150 further includes controlling the IAQ equipment based on the plurality of control points (operation 1158). Operation 1158 may include transmitting instructions to at least one user control interface (e.g., the user control device 120 and 220 of FIGS. 1 and 2, respectively) to adjust control thresholds/tolerances for the environmental set points. Additionally, operation 1158 may include transmitting a control signal to the IAQ equipment to cause the IAQ equipment to operate at a duty cycle that corresponds with the control point.

Referring to FIG. 19, a block diagram of a multi-variable control architecture for a whole building air quality control system 1350 is shown, according to yet another illustrative embodiment. The system 1350 of FIG. 21 may include the same elements as the system 1000 of FIG. 13 and may operate in a similar manner as system 1000. The system 1350 is further configured to control the IAQ component(s) based on both a desired AQI and a qualitative parameter. For example, the system 1350 may be configured to control the IAQ component(s), in response to user inputs, to achieve particular operating objectives that cannot be realized through AQI-based control alone. For example, the system 1350 may include an objective function (e.g., a cost function, a loss function, etc.), shown as energy function 1352, configured to increase an overall energy efficiency of the IAQ component(s) while maintaining a desired AQI. The objective function may be layered onto the machine learning algorithm (e.g., disposed downstream of the real-time plant model 1006 and feeding into the actuator model 1004. In other embodiments, the objective function may be at least partially incorporated into the machine learning algorithm (e.g., as part of the plant model 1006).

The system 1350 may also include other objective functions directed to other qualitative parameters. For example, the system 1350 may further include an objective function, shown as quality function 1354, configured to improve aspects of the AQI that are specific to an individual's preferences. For example, in a scenario in which the user is sensitive to seasonal allergens, the quality function 1354 may be used to reduce concentrations of particulate matter within a range of sizes that is specific to the allergen (and while maintaining a desired value of the AQI). The system 1350 may also include an objective function, shown as comfort function 1356, configured to improve a user/occupant's feeling of comfort (e.g., comfort level, etc.).

Figure 21:
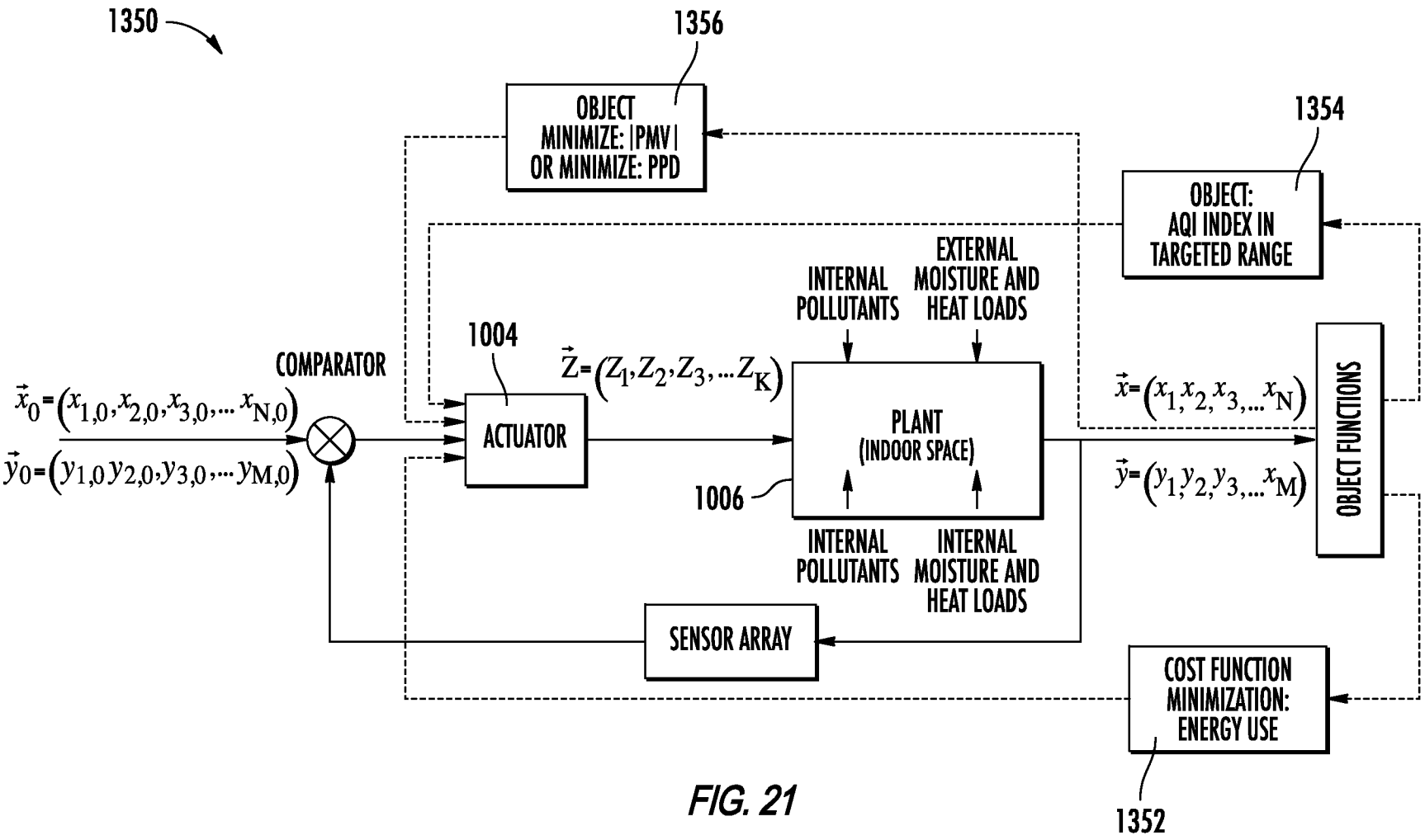
FIG. 21 is a block diagram of a multi-variable control architecture for a whole building air quality control system, according to another embodiment.
Figure 22:
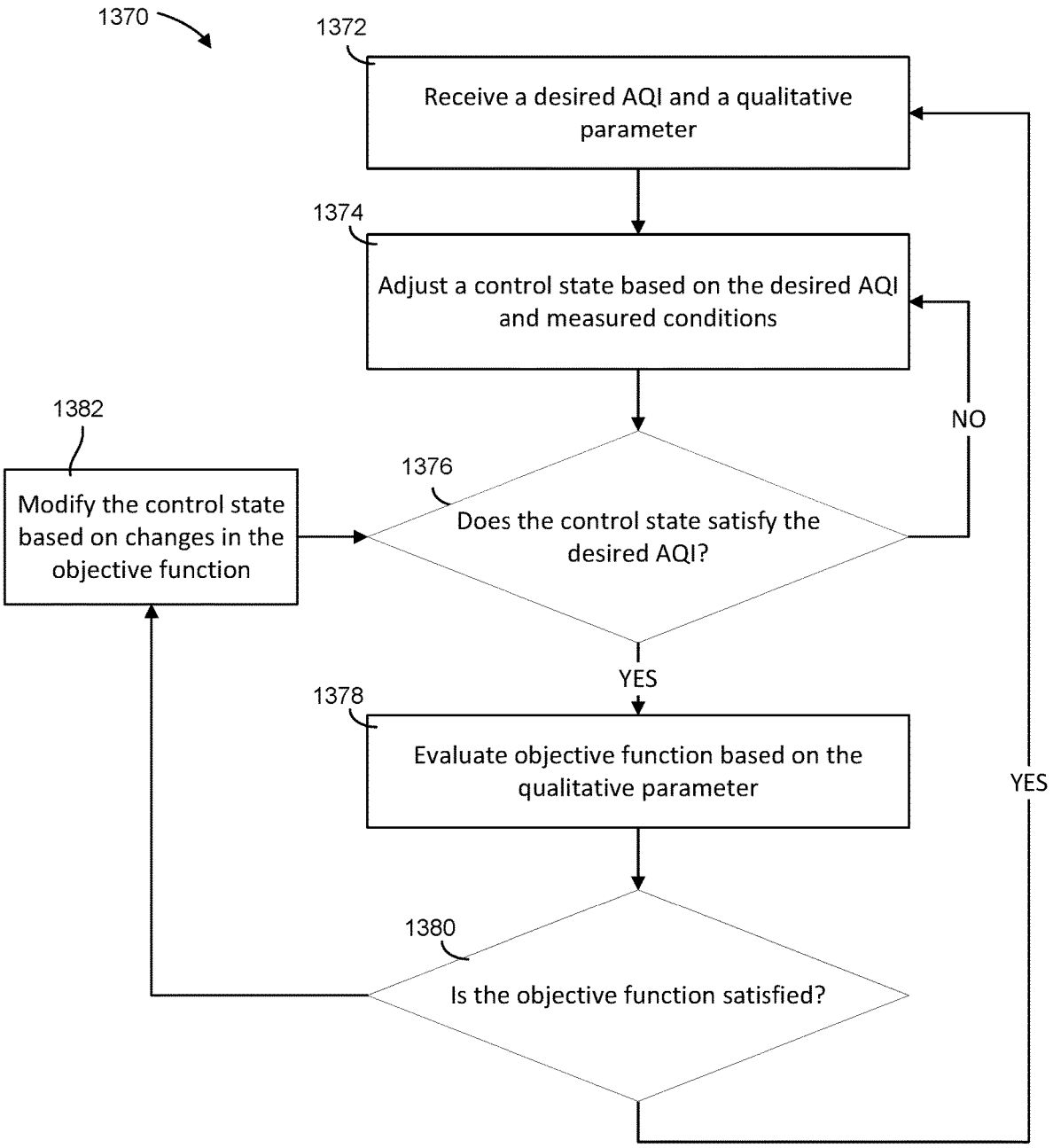
FIG. 22 is a flow diagram of a method of controlling IAQ equipment using an air quality controller, according to yet another embodiment.

Referring to FIG. 22, a method 1370 of controlling the system 1000 using the control architecture of FIG. 21 is shown, according to an illustrative embodiment. The method 1370 may be implemented using the air quality controller 400 of FIG. 4, for example, through a software application installed on the controller 400. As such, reference will be made to the controller 400 when describing method 1370. The air quality controller 400 may form part of a local computing device (e.g., thermostat) or part of a cloud computing device (e.g., the system cloud, etc.) in some embodiments. It should be appreciated that the use of flow diagram and arrows is not meant to be limiting with respect to the order of flow operations. For example, in an illustrative embodiment, two or more of the operations of method 1370 may be performed simultaneously.

At operation 1372, the controller 400 receives a desired AQI and a qualitative parameter. Operation 1372 may include receiving the desired AQI and/or qualitative parameter from a user interface (e.g., via manual user inputs) and/or via inputs from a remote computing device that is communicably coupled to the controller 400. In another embodiment, the desired AQI may be retrieved from memory (e.g., a default value of the desired AQI may be stored in memory, etc.). At operations 1374-1376, the controller 400 determines a predicted control state of at least one IAQ component based on the desired AQI using a machine learning algorithm such as an artificial neural network. According to an illustrative embodiment, operations 1374-1376 are the same as or similar to operations 1054-1060 in the method 1050 of FIG. 14.

At operation 1378, the controller 400, in response to determining that the plurality of building conditions satisfies the desired AQI, evaluates an objective function based on the qualitative parameter. In a scenario in which the energy function is used (in which the user desires greater energy efficiency), operation 1378 may include determining the overall energy consumed by the IAQ component(s), as described in Equation (10):

$$E=E_1+E_2+\ldots+E_M \tag{10}$$

where $E_1$ represents the cost (e.g., in \$/day, \$/week, etc.) associated with a current operating state of a first IAQ component, $E_2$ represents the cost associated with a current operating state of a second IAQ component, and $E_M$ represents the cost associated with a current operating state of an Mth IAQ component.

In a scenario in which the quality function is used (in which the user desires greater reduction of a specific type or combination of pollutants), operation 1378 may include determining the specific amounts and/or levels of a specific type or combination of pollutants. In a scenario in which the comfort function is used (in which the user desires a greater feeling of comfort), operation 1378 may include determining a difference between actual environmental conditions such as temperature, humidity, and pressure to baseline conditions, and/or evaluating an appropriate comfort index parameter such as the PMV or PPD.

At operation 1380, the controller 400 determines whether the objective function is satisfied. In some embodiments, operation 1380 includes determining whether the system 1350 has achieved one of a minimum value or a maximum value of the objective function (e.g., by comparing to previous iterations of method 1370, etc.). In other embodiments, operation 1380 includes determining whether the system 1350 has achieved a value of the objective function that satisfies (e.g., is greater than, is less than, is equal to, etc.) a representative level of the objective function that the user desires (e.g., somewhere between greatest performance and greatest efficiency). The controller 400 may determine the representative level based on historical data in combination with the qualitative parameter. For example, if the qualitative parameter is less than the maximum value of the qualitative parameter that can be achieved by the system (based on historical data), then the controller 400 may set the representative level equal to an equivalent fraction of the maximum value.

In the event that the objective function is not satisfied, the method 1370 proceeds to operation 1382. At operation 1382, the controller 400 modifies the control state based on changes in the objective function. Operation 1382 may include modifying the control parameters within a known range of the desired AQI using an optimization algorithm. In other embodiments, operations 1378-1382 includes determining one of a minimum value or maximum value of the objective function using a multi-variable optimization algorithm. In yet other embodiments (e.g., embodiments in which the desired AQI includes parameters related to occupant comfort (e.g., the CFI, etc.), etc.), operation 1382 may be incorporated as part of the underlying machine learning algorithm for the building space without any separate optimization or secondary machine-learning operations (e.g., the desired AQI may be a function of occupant comfort, efficiency, and/or other parameters beyond levels of pollutants within the building space).

As shown in FIG. 22, after modifying the control state, the method 1370 returns to operation 1376 to verify that the modified control state still satisfies the desired AQI. This controller 400 may continue to iteratively modify the control state until the plurality of building conditions satisfy both the desired AQI and the objective function. Once this happens, the method 1370 returns back to operation 1372 to repeat the process based on changes in user inputs.

User Interface

Figure 23:
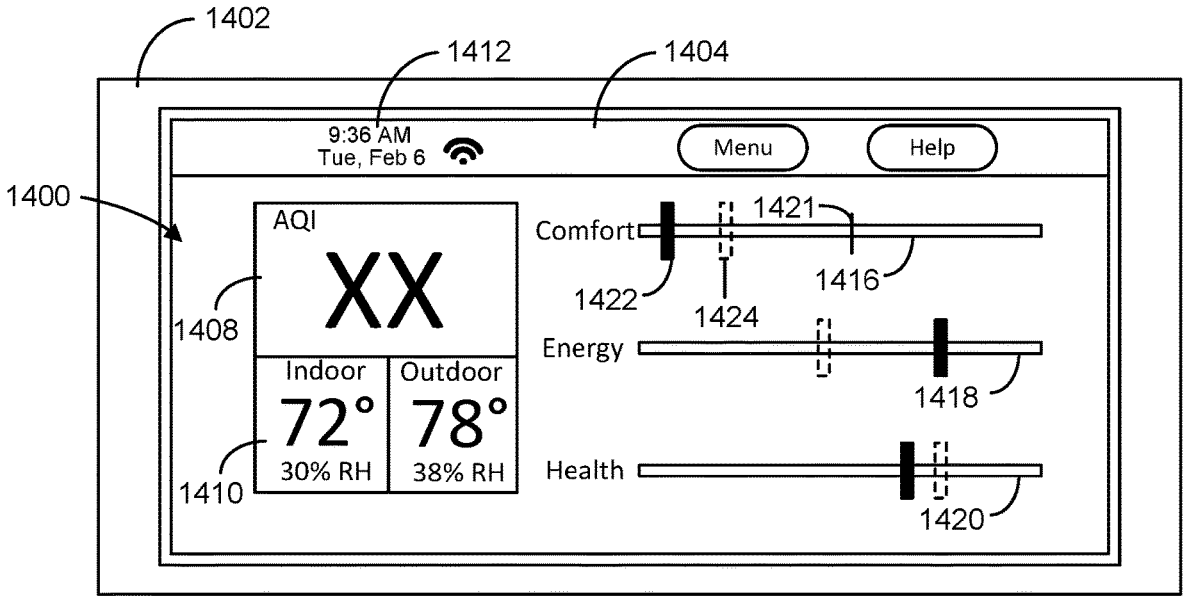
FIG. 23 is a block diagram of a graphical user interface (GUI) for an air quality controller, according to an embodiment.

Referring to FIG. 23, a GUI 1400 of a control device is shown, according to an illustrative embodiment. The GUI 1400 is presented on a screen 1404 (e.g., LCD, LED, etc.) of an electronic control device 1402 (e.g., a touch-screen display). In another embodiment, the GUI 1400 is at least partially implemented through the use of mechanical actuators. The control device may include a user control device that is installed into the building such as a thermostat, humidistat, smart building control panel, or a remote computing device such as a mobile phone, tablet, laptop, or another wirelessly connected de vice. In other embodiments, the GUI 1400 is implemented on the supplier cloud (e.g., the supplier cloud 156 and 256 of FIGS. 1-2, respectively). As such, the GUI 1400 may be accessible from other computing devices via the internet and/or another form of wireless supplier portal. According to an illustrative embodiment, the GUI 1400 may be implemented as a software application on the control device.

As shown in FIG. 23, the GUI 1400 is configured to present multiple operating conditions and parameter settings to a user/occupant. For example, the GUI 1400 includes an IAQ indicator 1408 that displays the value of the actual IAQ within the building. The GUI 1400 also includes condition indicators 1410 that display at least one measurable environmental condition. As shown in FIG. 23, the condition indicators 1410 display various indoor environmental conditions such as the indoor temperature and indoor relative humidity (e.g., based on sensor data, etc.). The GUI 1400 may also display similar environmental conditions for the outdoor environment.

As shown in FIG. 23, the GUI 1400 also includes at least one status indicator 1412 that displays various operating information to the user. For example, the status indicator 1412 may provide the current date and time. The status indicator 1412 also includes a Wi-Fi status that is representative of the strength and/or quality of the wireless signal between the control device and the other components of the whole building air quality control system. The GUI 1400 may also include various navigating and/or command buttons to switch between different control modes and display configurations. In alternative embodiments, the GUI 1400 may present additional, fewer, and/or different information.

As shown in FIG. 23, the GUI 1400 is configured to provide an interactive display through which the user can select a desired operating strategy for the whole building air quality control system. In particular, the GUI 1400 may be implemented by a user to specify a desired value for at least one qualitative parameter. The control device receives and interprets the selected value of the qualitative parameter, and translates the user's selection into control algorithms for the IAQ equipment.

As shown in FIG. 23, the GUI 1400 includes at least one parameter axis 1414 that is indicative of a qualitative parameter. In the embodiment of FIG. 23, the GUI 1400 includes three separate parameter axes that each correspond to a different qualitative parameter. A first parameter axis 1416 corresponds to the comfort metric, which is indicative of how comfortable the user is within the indoor environment. A second parameter axis 1418 corresponds to the energy metric, which relates to how efficiently the IAQ equipment is being operated. A third parameter axis 1420 corresponds to the health metric, which relates to the system's impact on the health of the building's occupants. In other embodiments, the GUI 1400 may include additional, fewer, and/or different parameter axes. As shown in FIG. 23, a mid-point 1421 along each parameter axis corresponds with the baseline IAQ control strategy (e.g., baseline IAQ control points). In other embodiments, the position along each parameter axis that corresponds with the baseline IAQ control strategy may be different (e.g., at a left hand side of each parameter axis, etc.).

As shown in FIG. 23, the GUI 1400 further includes a plurality of selection indicators 1422. Each selection indicator 1422 is paired with a respective one of the parameter axes. The selection indicator 1422 may be manually manipulated by the user to input their desired preference of the qualitative parameter. In the embodiment of FIG. 23, each selection indicator 1422 is a slider that moves along a parameter axis. A user may reposition the slider by pressing his/her finger against the screen 1404 (at the location of the slider) and moving their finger across the screen 1404 in a horizontal direction (e.g., left-to-right, right-to-left, etc.). Alternatively, a user may press their finger onto the screen 1404 at any location along the parameter axis to quickly reposition (e.g., snap) the slider to that location. In another embodiment, the selection indicator 1422 is a lever of a rheostat or another type of mechanical actuator. In yet another embodiment, the GUI includes a text entry box in which the user may specify a value of the quantitative parameter (e.g., using a keypad, etc.).

As shown in FIG. 23, the GUI 1400 also includes a real-time parameter indicator 1424 indicative of a current operating setting that is being implemented by the control device 1402. In particular, the real-time parameter indicator 1424 shows the actual value of at least one qualitative parameter setting. The real-time parameter indicator 1424 is shown as a dashed slider in FIG. 23. According to an illustrative embodiment, the dashed slider is brought into alignment with the selection indicator 1422 once the desired change has been fully implemented by the control device (e.g., once the control points have been updated and fully implemented by the control device).

In some embodiments, the qualitative parameters may be at least partially interrelated. In other words, changing one of the qualitative parameters using the selection indicator 1422 will result in changes to at least one other qualitative parameter. For example, control points that change as a result of increasing the comfort metric may also cause increases in the health metric. Because of this, the GUI 1400 may be configured to automatically update the position of the selection indicator 1422 that is associated with the health metric in response to changes in the position of the selection indicator 1422 that is associated with the comfort metric (and vice versa). In another embodiment, only the real-time parameter indicator 1424 that is associated with the health metric is updated. In another embodiment, the selection indicator 1422 that is associated with the health metric may be updated to show at least a minimum value of the health metric that results from the selected change (e.g., the health metric is no less than indicated by the current position of the selection indicator 1422 along the third parameter axis 1420, etc.).

The design and arrangement of GUI 1400 of FIG. 23 is provided for illustrative purposes only. It will be appreciated that various alternatives are possible, without departing from the inventive concepts disclosed herein. For example, in some embodiments, the parameters axes may be oriented vertically or arranged at an angle. The number of parameter axes (e.g., selectable qualitative parameters) may also differ in various illustrative embodiments. Additionally, in some embodiments, the parameter axis may be replaced with individual dial indicators or another indicator type. In some embodiments, the GUI may be of a three axis design which creates a control surface that a user may interact with, such that changing a parameter selection along the surface adjusts settings for multiple different qualitative parameters.

Figure 24:
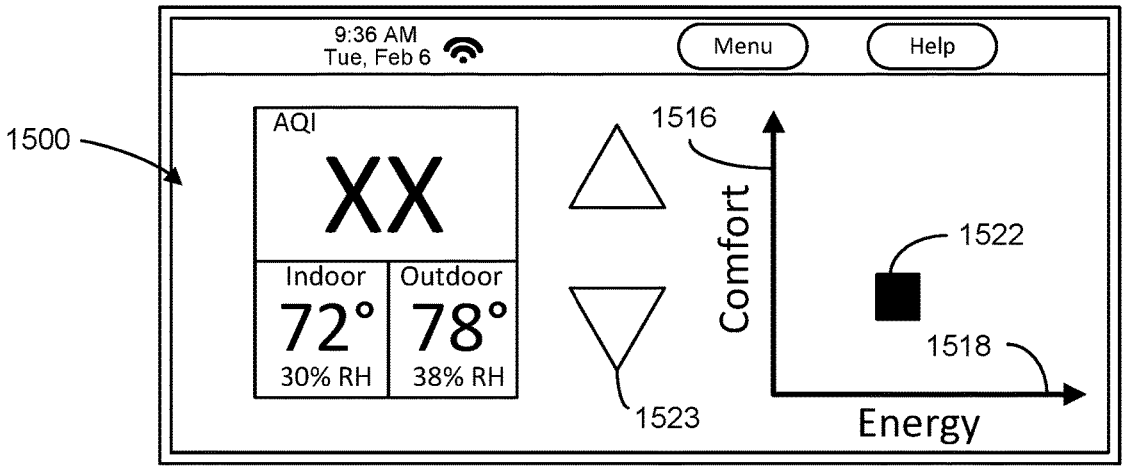
FIG. 24 is a block diagram of a GUI for an air quality controller, according to another embodiment.

Referring to FIG. 24, a GUI 1500 for a control device is shown that includes a single selection indicator 1522 that allows the user to selectively designate multiple qualitative parameters simultaneously. In particular, the parameter axes are arranged as a two dimensional graph in which values of the comfort metric are shown along the y-direction parameter axis 1516 and values of the energy metric are shown along the x-direction parameter axis 1518. The selection indicator 1522 is a generally rectangular box that is positioned on the graph. In other embodiments, the shape of the selection indicator 1522 may be different. According to an illustrative embodiment, the origin of the graph (zero position along the y-direction parameter axis 1516 and the x-direction parameter axis 1518) corresponds with the baseline IAQ control strategy. In other embodiments, the y-direction parameter axis 1516 and the x-direction parameter axis 1518 may be extended such that negative values of the comfort metric and the energy metric may also be shown and selected. The GUI 1500 of FIG. 24 also includes an environmental parameter selection indicator 1523, which may be used to manually adjust specific environmental parameters (e.g., to override the set points determined by the controller 400). In this way, the GUI 1500 allows for the combined input of both qualitative and quantitative parameters, if so desired by the user. By controlling both qualitative and quantitative parameters simultaneously, a user can balance tradeoffs in energy efficiency without impacting the parameters that are most important to them (e.g., prioritizing reduction in the operation of portables, while ensuring ventilation performance is not impacted within the building, etc.).

Figure 25:
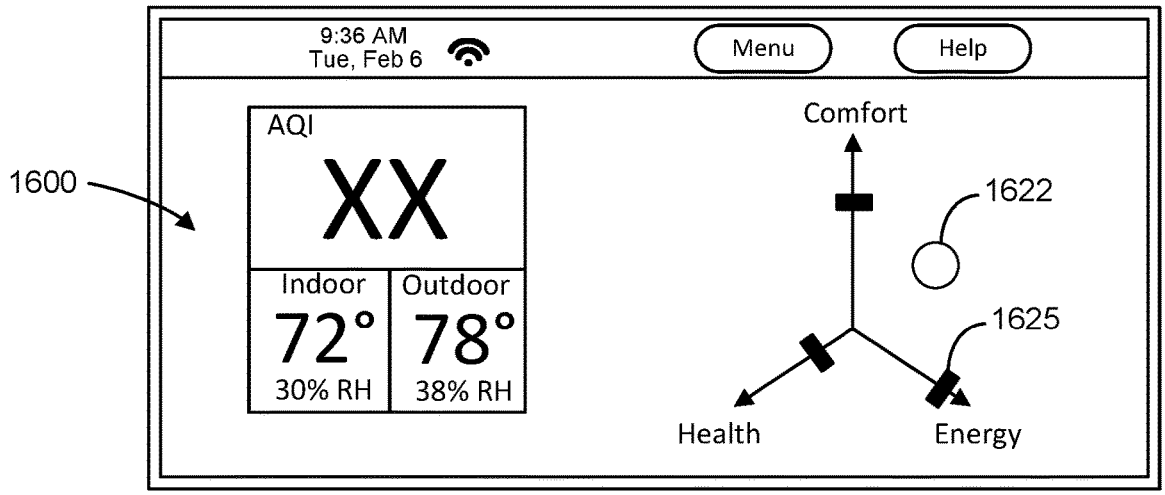
FIG. 25 is a block diagram of a GUI for an air quality controller, according to another embodiment.

FIG. 25 shows a GUI 1600 that includes axes defining a three dimensional graph of the comfort metric, the health metric, and the energy metric. In other embodiments, the GUI 1600 may include additional, fewer, and/or different qualitative parameters. Again, the GUI 1600 includes a single selection indicator 1622 that may be used to selectively designate multiple qualitative parameters simultaneously (i.e., any combination of the three qualitative parameters). The GUI 1600 also includes metric-specific selection indicators 1625 that may be used to selectively designate the value of one of the qualitative parameters separately from the others.

Figure 26:
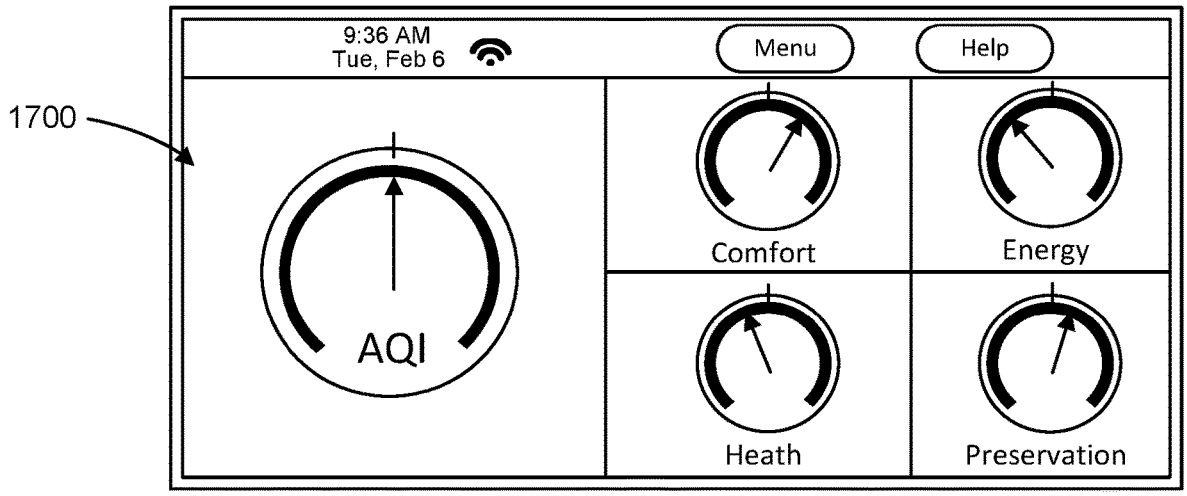
FIG. 26 is a block diagram of a GUI for an air quality controller, according to another embodiment.

FIG. 26 shows a GUI 1700 that includes real-time parameter indicators for each qualitative parameter. In particular, real-time parameter indicators are shown for the actual IAQ metric, the comfort metric, the energy metric, the health metric, and the preservation metric (e.g., system preservation). The real-time parameter indicators are represented as dial indicators. In other embodiments, the type of indicator used may be different. For example, each indicator may be shown as a single value along a parameter axis, etc. A top dead center position on each of the dial indicators corresponds to the baseline IAQ control strategy. According to an illustrative embodiment, the GUI 1700 shown in FIG. 26 may be accessed using a mode and/or menu button from the qualitative parameter selection GUI (e.g., GUI 1400 of FIG. 23, etc.).

Figure 27:
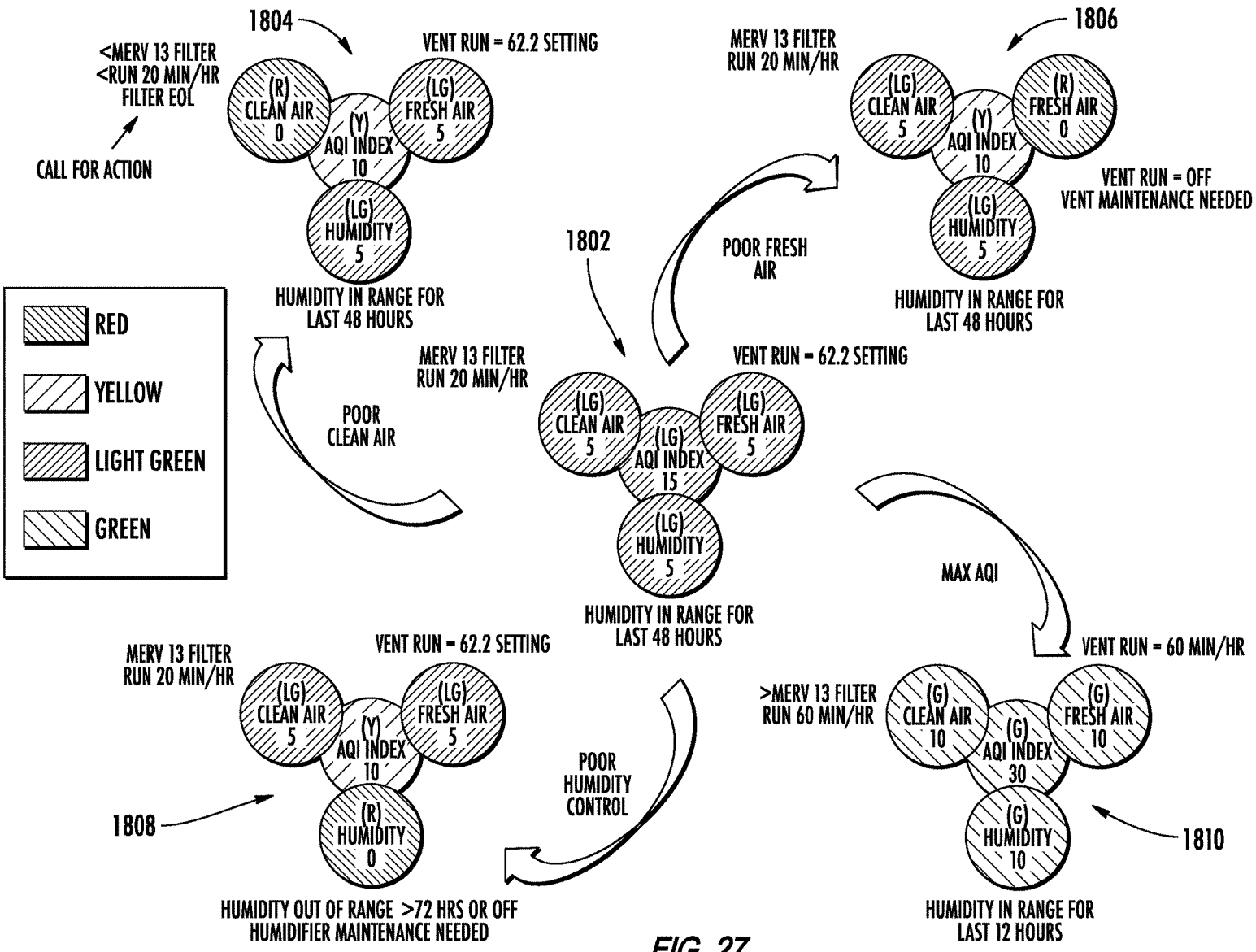
FIG. 27 is a block diagram of a GUI for an air quality controller, according to another embodiment.

FIG. 27 shows a GUI 1802 that includes real-time parameter indicators for each individual qualitative parameter, and an IAQ metric indicator that provides a visual indication of the actual composite IAQ metric for the whole air quality control system (e.g., a sum of the scores for each individual qualitative parameter). In particular, the GUI 1802 shown in FIG. 27 provides visual indication of three different qualitative parameters (e.g., aspects) of the IAQ system, including clean air control (e.g., providing a visual indication of the particulate matter in the air), fresh air control (e.g., providing a visual indication of an amount of vent air from the outdoor environment, CO2 levels, VOC levels, etc.), and humidity control (e.g., providing a visual indication of the relative humidity within the building in comparison to desired set point values over time). In other embodiments, the GUI may provide visual indication of additional, fewer, and/or different parameters (e.g., two, four, five, etc.).

As shown in FIG. 27, each of the indicators is a visually-perceptible icon that is displayed on the user interface. In the embodiment of FIG. 27, the real-time parameter indicators are arranged about (e.g., to substantially surround) a centrally located IAQ metric indicator. The real-time parameter indicators are circular icons arranged in a substantially triangular shape. In other embodiments, the shape and/or arrangement of the icons may be different.

The real-time parameter indicators corresponding with each qualitative parameter report scoring factors (e.g., numbers) based on the performance of the control system in each of these three areas. The real-time parameter indicators also provide a qualitative indication of performance to the user through color coded icons (e.g., "(R)" for red, "(Y)" for yellow, "(LG)" for light green, and "(G)" for dark green). Five different operating conditions are illustrated in FIG. 27. GUI 1802 shows the status of the indicators when the control system is operating nominally. GUI 1804 shows the status of the indicators when clean air control falls outside of the nominal range of operation. For example, GUI 1804 may correspond with a condition in which the filter element has reached the end of its service life (e.g., when the pressure drop across the filter element, due to particulate loading, exceeds threshold values and can no longer provide the desired performance). In some embodiments, the visual indication provided by the GUI 1804 serves as a "call for action" that notifies the user or occupant to change equipment settings and/or their behavior to bring the system back into nominal operating range. The "call for action" may be a visual indication that IAQ equipment is in need of service (e.g., filter change in an air cleaner, etc.) or a visual indication that notifies the user and/or occupant that their behavior needs to change (e.g., stop smoking in the building, activate the range hood when cooking food on the stove, etc.). The "call for action" may correspond with a color change of one or more indicators in the GUI, and/or may include a textual description of the issue. In some embodiments, information relating to the "call for action" may be obtained by selecting a sub-menu in the GUI related to one or more real-time parameters. For example, the user may select a visually perceptible icon associated with the real-time parameter, which may trigger the GUI to preset details and suggestions for remedial action related to the real-time parameter. In other embodiments, the air quality controller may be configured to supplement visual indications in the GUI with audio notifications and/or may trigger transmission of the "call for action" to the cloud or a user device (e.g., a text notification, etc.).

GUI 1806 shows the status of the indicators when fresh air control falls outside of the nominal range of operation. For example, GUI 1806 may correspond with a condition in which the vent control system fails to operate as intended (e.g., damper actuator failure, vent blockage and/or damage, etc.). GUI 1808 shows the status of the indicators when humidity control falls outside of the nominal range of operation. For example, GUI 1808 may correspond with a condition in which the humidity falls outside of the humidity set point for a threshold time interval (e.g., relative humidity value drops below the humidity set point for a period of at least 72 hours, etc.). In each of these scenarios, the real-time parameter turns color (e.g., from green to red) to indicate that a respective one of the qualitative parameter has fallen outside of acceptable limits. The IAQ metric indicator also changes color (e.g., from green to yellow) to indicate that at least one real-time qualitative parameter has fallen outside of the acceptable range. Conversely, GUI 1810 shows the status of the indicators when each of the clean air control, fresh air control, and humidity control exceed nominal values. As shown, all of the real-time qualitative parameter indicators (and the IAQ metric indicator) have changed color (e.g., from light green to dark green) to notify the user that the control system is exceeding the nominal range of operation (e.g., the baseline IAQ, etc.).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the apparatus and control system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present application. For example, any element disclosed in one embodiment may be incorporated or utilized with any other embodiment disclosed herein.

What is claimed is:

1. A whole building air quality control system, comprising:

an indoor air quality (IAQ) component having at least one control state;

a plurality of sensors configured to measure a plurality of building conditions of a building space; and a controller communicably coupled to the IAQ component and the plurality of sensors, the controller comprising memory storing a desired air quality index (AQI) and a plurality of IAQ parameter ranges for each of the plurality of building conditions, the desired AQI comprising a categorical variable having a number of values, each value of the categorical variable corresponding to a subset of the plurality of IAQ parameter ranges for each of the plurality of building conditions, the controller configured to iteratively modify a control state of the IAQ component using a machine learning algorithm until the plurality of building conditions of the building space satisfy the desired AQI.

2. The whole building air quality control system of claim 1, further comprising a user interface that is communicably coupled to the controller, wherein the controller is further configured to:

receive a first desired AQI;

obtain a first subset of the plurality of AQI ranges based on the desired AQI, wherein the first subset includes a first range of a first IAQ parameter and a first range of a second IAQ parameter;

iteratively modifying the control state of the IAQ component using the machine learning algorithm until the plurality of building conditions of the building space satisfies the first range of the first IAQ parameter and the second range of the second IAQ parameter;

receive a second desired AQI;

obtain a second subset of the plurality of AQI ranges based on the desired AQI, wherein the first subset includes a second range of the first IAQ parameter that is different from the first range of the first IAQ parameter and a second range of the second IAQ parameter that is different from the first range of the second IAQ parameter; and iteratively modifying the control state of the IAQ component using the machine learning algorithm until the plurality of building conditions of the building space satisfies the second range of the first IAQ parameter and the second range of the second IAQ parameter.

3. The whole building air quality control system of claim 2, wherein the first IAQ parameter is indicative of an amount of a pollutant in the building space and the second IAQ parameter is indicative of a level of comfort of an occupant within the building space.

4. The whole building air quality control system of claim 2, wherein the first IAQ parameter is indicative of an amount of a first pollutant in the building space and the second IAQ parameter is indicative of a temperature of the building space.

5. The whole building air quality control system of claim 1, wherein iteratively modifying the control state comprises:

determining a predicted control state based on the desired AQI via the machine learning algorithm;

transmitting a command to the IAQ component based on the predicted control state; and updating the control state based on a deviation between the plurality of building conditions and the desired AQI.

6. The whole building air quality control system of claim 5, wherein determining the predicted control state comprises determining a relationship between the categorical variable and the control state of the IAQ component using an artificial neural network.

7. The whole building air quality control system of claim 5, wherein the categorical variable is indicative of a category of air quality, and wherein modifying the predicted control state comprises:

receiving the plurality of building conditions; and modifying the predicted control state if at least one building condition of the plurality of building conditions does not satisfy a respective one of the IAQ parameter ranges of the subset of the plurality of IAQ parameter ranges.

8. The whole building air quality control system of claim 7, wherein the controller is configured to modify the predicted control state based on a deviation between the at least one building condition and the respective one of the IAQ parameter ranges.

9. The whole building air quality control system of claim 1, further comprising a user interface configured to receive user input comprising a qualitative parameter, wherein, in response to a determination that the plurality of building conditions satisfies the desired AQI, the controller is further configured to:

evaluate an objective function based on the qualitative parameter; and iteratively modify the control state until the plurality of building conditions satisfy both the desired AQI and the objective function.

10. The whole building air quality control system of claim 9, wherein the qualitative parameter comprises at least one of an efficiency metric that is indicative of an overall efficiency of the IAQ component and a comfort index that is indicative of a level of comfort of an occupant within the building space.

11. The whole building air quality control system of claim 9, wherein iteratively modifying the control state until the plurality of building conditions satisfies the objective function comprises determining one of a minimum value or maximum value of the objective function using a multivariable optimization algorithm.

12. A non-transitory computer-readable medium having instructions stored thereon that, upon execution by a computing device, cause the computing device to perform operations comprising:

receiving from a plurality of sensors, a plurality of building conditions of a building space;

receiving a desired AQI, the desired AQI comprising a categorical variable having a number of values, each value of the categorical variable corresponding to a subset of a plurality of IAQ parameter ranges for each of the plurality of building conditions;

determining a predicted control state of an IAQ component based on the desired AQI using a machine learning algorithm;

transmitting a command to the IAQ component based on the predicted control state;

iteratively modifying the predicted control state using the machine learning algorithm until the plurality of building conditions of the building space satisfy the desired AQI.

13. The non-transitory computer-readable medium of claim 12, wherein determining the predicted control state comprises determining a relationship between the categorical variable and a control state of the IAQ component using an artificial neural network.

14. The non-transitory computer-readable medium of claim 12, wherein the categorical variable is indicative of a category of air quality, and wherein the instructions are further configured cause the computing device to modify the predicted control state in response to a determination that at least one building condition of the plurality of building conditions does not satisfy a respective one of the IAQ parameter ranges of the subset of the plurality of IAQ parameter ranges.

15. The non-transitory computer-readable medium of claim 14, wherein the instructions are further configured to cause the computing device to modify the predicted control state based on a deviation between the at least one building condition and the respective one of the IAQ parameter ranges.

16. The non-transitory computer-readable medium of claim 12, wherein the instructions are further configured to cause the computing device to:

receiving a qualitative parameter;

evaluating an objective function based on the qualitative parameter; and iteratively modifying the predicted control state until the plurality of building conditions satisfy both the desired AQI and the objective function.

17. A control device, comprising:

a communications interface configured to communicably couple the control device to an IAQ component and a plurality of sensors configured to measure a plurality of building conditions of a building space;

a user interface configured to receive user input comprising a qualitative parameter;

a memory storing a desired AQI and a plurality of IAQ parameter ranges for each of the plurality of building conditions, the desired AQI comprising a categorical variable having a number of values, each value of the categorical variable corresponding to a subset of the plurality of IAQ parameter ranges for each of the plurality of building conditions;

a processing circuit communicably coupled to the communications interface, the user interface, and the memory, the processing circuit configured to:

determine a predicted control state based on both the qualitative parameter and the desired AQI using a machine learning algorithm; and transmit a control signal to the IAQ component based on the predicted control state.

18. The control device of claim 17, wherein determining the predicted control state comprises determining a relationship between the categorical variable and a control state of the IAQ component using an artificial neural network.

19. The control device of claim 17, wherein the categorical variable is indicative of a category of air quality, further comprising:

receiving, from the plurality of sensors, the plurality of building conditions of the building space; and modifying the predicted control state in response to a determination that at least one building condition of the plurality of building conditions does not satisfy a respective one of the IAQ parameter ranges of the subset of the plurality of IAQ parameter ranges.

20. The control device of claim 19, wherein, in response to determining that the plurality of building conditions satisfies the desired AQI, the processing circuit is configured to:

evaluate an objective function based on the qualitative parameter; and iteratively modify the predicted control state until the plurality of building conditions satisfy both the desired AQI and the objective function.

* * * * *